US011326387B2

(12) United States Patent
Osann, Jr.

(10) Patent No.: US 11,326,387 B2
(45) **Date of Patent: *May 10, 2022**

(54) AUTOMATIC ACCESS CONTROL DEVICES AND CLUSTERS THEREOF

(71) Applicant: Robert Osann, Jr., Port Angeles, WA (US)

(72) Inventor: Robert Osann, Jr., Port Angeles, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/106,047

(22) Filed: Nov. 27, 2020

(65) Prior Publication Data

US 2021/0156186 A1 May 27, 2021

Related U.S. Application Data

(63) Continuation of application No. 16/802,816, filed on Feb. 27, 2020, now abandoned, which is a (Continued)

(51) Int. Cl.
*E05F 15/73* (2015.01)
*E05D 15/58* (2006.01)
(Continued)

(52) U.S. Cl.
CPC ..... *E05F 15/73* (2015.01); *E05D 15/58* (2013.01); *E05F 15/60* (2015.01); *E05F 15/608* (2015.01);
(Continued)

(58) Field of Classification Search
CPC ..... E05F 17/002; E05G 5/02; E05G 5/003
See application file for complete search history.

(56) References Cited

U.S. PATENT DOCUMENTS 677,294 A * 6/1901 Van Kannel ..... E06B 3/90 49/68
1,558,058 A * 10/1925 Spottswood ..... E05G 5/02 109/8
(Continued)

FOREIGN PATENT DOCUMENTS

DE 9105066 4/1991
FR 2610361 8/1988
(Continued)

*Primary Examiner* — Catherine A Kelly
(74) *Attorney, Agent, or Firm* — Cherskov Flaynik & Gurda, LLC

(57) ABSTRACT

Electro-mechanical and electronically controlled access devices are described for automatically controlling passage between two areas, and where a plurality of such access control devices may be ganged or clustered to provided additional throughput and directional control, including stacking a plurality of access control devices side by side within a cluster. Each access control device contains multiple rotatable and moveable door panels. The door panels are controlled by various drive mechanisms to enable passage through the device, while ensuring by the use of sensors that door panels avoid touching subjects as they traverse the device. The direction of flow through a device according to these embodiments is electronically controlled and may be changed from time to time. At any instant in time while being traversed, the flow through each device is unidirectional. Multiple devices within a cluster can be directionally controlled according to traffic, demand, time of day, or other factors.

23 Claims, 48 Drawing Sheets

Related U.S. Application Data continuation of application No. 15/588,617, filed on May 6, 2017, now Pat. No. 10,590,693, which is a continuation of application No. 14/690,245, filed on Apr. 17, 2015, now Pat. No. 9,644,417, which is a continuation-in-part of application No. 14/485,705, filed on Sep. 13, 2014, now Pat. No. 9,010,025, and a continuation-in-part of application No. PCT/US2014/015634, filed on Feb. 10, 2014, which is a continuation of application No. 13/952,409, filed on Jul. 26, 2013, now Pat. No. 8,832,997, said application No. 14/485,705 is a continuation of application No. 13/952,409, filed on Jul. 26, 2013, now Pat. No. 8,832,997, which is a continuation-in-part of application No. 12/502,997, filed on Jul. 14, 2009, now Pat. No. 8,499,494.

(60) Provisional application No. 61/906,893, filed on Nov. 20, 2013, provisional application No. 61/775,522, filed on Mar. 9, 2013, provisional application No. 61/763,943, filed on Feb. 12, 2013, provisional application No. 61/135,322, filed on Jul. 18, 2008.

(51) Int. Cl.

| | |
|---|---|
| ***E05F 17/00*** | (2006.01) |
| ***E05F 15/608*** | (2015.01) |
| ***E05G 5/00*** | (2006.01) |
| ***E05F 15/79*** | (2015.01) |
| ***E05F 15/627*** | (2015.01) |
| ***E05F 15/646*** | (2015.01) |
| ***E05G 5/02*** | (2006.01) |
| ***E05F 15/60*** | (2015.01) |
| *E05F 15/00* | (2015.01) |

(52) U.S. Cl.

CPC ..... *E05F 15/627* (2015.01); *E05F 15/646* (2015.01); *E05F 15/79* (2015.01); *E05F 17/002* (2013.01); *E05G 5/003* (2013.01); *E05G 5/02* (2013.01); *E05F 15/00* (2013.01); *E05F 2015/765* (2015.01); *E05F 2015/767* (2015.01); *E05F 2017/008* (2013.01); *E05Y 2400/82* (2013.01); *E05Y 2900/132* (2013.01)

(56) References Cited

U.S. PATENT DOCUMENTS 2,925,081 A * 2/1960 Shooter ..... F24C 15/026 126/190
3,924,546 A * 12/1975 Pretini ..... E05G 5/003 109/3
3,967,411 A * 7/1976 Ulmann ..... E06B 11/08 49/68
4,122,783 A 10/1978 Pretini
4,308,803 A * 1/1982 Pretini ..... E05G 5/003 109/21
4,380,201 A * 4/1983 Dion ..... E05G 5/02 109/17
4,586,441 A 5/1986 Zekich
4,628,496 A * 12/1986 Lee ..... G01S 15/04 367/93
4,738,052 A 4/1988 Yoshida
4,741,275 A 5/1988 Lewiner et al.
4,843,761 A * 7/1989 Sandling ..... E06B 3/90 49/41
5,195,448 A 3/1993 Sims
5,311,166 A 5/1994 Frye
5,542,211 A 8/1996 Colombo
5,625,176 A 4/1997 Davis et al.
5,634,295 A 6/1997 Bunzl
5,694,867 A 12/1997 Diaz-Lopez
5,711,111 A 1/1998 Nyffenegger et al.
5,845,692 A * 12/1998 Kellem ..... E06B 11/00 160/118
6,076,303 A * 6/2000 Orsini ..... E05G 5/003 109/6
6,084,367 A * 7/2000 Landert ..... E05F 15/70 318/466
6,176,044 B1 1/2001 Nixon
6,298,603 B1 10/2001 Diaz
6,308,644 B1 10/2001 Diaz
6,456,231 B1 * 9/2002 McEwan ..... G01S 7/2927 342/159
6,472,984 B1 10/2002 Risi
6,484,650 B1 11/2002 Stomski
6,543,185 B1 4/2003 Borelli
6,615,894 B1 9/2003 McKeon
6,742,301 B1 6/2004 Schwarz
6,931,987 B2 8/2005 Pax
7,477,758 B2 * 1/2009 Piirainen ..... B60J 10/00 382/100
8,127,989 B2 * 3/2012 Choi ..... G07C 9/27 235/382
8,499,494 B2 * 8/2013 Robert, Jr. ..... E05G 5/003 49/254
8,665,333 B1 * 3/2014 Sharma ..... G08B 13/19643 348/159
8,832,997 B2 * 9/2014 Osann, Jr. ..... E05F 15/608 49/254
9,010,025 B2 * 4/2015 Osann, Jr. ..... E05G 5/02 49/254
9,268,054 B2 * 2/2016 Osann, Jr. ..... G01V 5/0008
9,644,417 B2 * 5/2017 Osann, Jr. ..... E05G 5/003
9,850,696 B2 * 12/2017 Sugaya ..... E05F 15/72
10,590,693 B2 * 3/2020 Osann, Jr. ..... E05G 5/02
2004/0161133 A1 * 8/2004 Elazar ..... G06K 9/00771 382/115
2004/0239216 A1 * 12/2004 Castillo ..... E05D 15/58 312/322
2004/0262383 A1 12/2004 Zielinski et al.
2006/0086894 A1 4/2006 Shepherd
2006/0160484 A1 * 7/2006 Falk ..... E06B 3/90 454/195
2006/0187305 A1 * 8/2006 Trivedi ..... G06K 9/00241 348/169
2006/0218863 A1 10/2006 Eshel et al.
2007/0047837 A1 3/2007 Schwab et al.
2007/0094720 A1 * 4/2007 Galambos ..... G08B 13/1961 726/9
2007/0122003 A1 * 5/2007 Dobkin ..... G08B 13/19645 382/115
2008/0244978 A1 10/2008 Soyugenc
2011/0107673 A1 * 5/2011 Ippolito ..... E05G 5/02 49/150
2011/0167727 A1 * 7/2011 Kamise ..... E06B 11/085 49/70
2019/0345765 A1 * 11/2019 Glayse ..... E06B 11/085

FOREIGN PATENT DOCUMENTS

GB 2491185 A * 11/2012 ..... E05G 5/02
JP 63-027677 U 2/1988
JP 7026836 A 1/1995
JP 2003-214045 7/2003
JP 2004-183300 A 7/2004
WO WO2007136244 11/2007

* cited by examiner

Doors move:
(a) In and out from side in linear fashion
(b) Forward and back in the direction of flow, and
(c) Doors rotate Gap filler by telescoping extension Gap filler by sliding filler panel Sliding roof panels replace moving arms to drive moving door panels Sliding roof panels replace moving arms to drive moving door panels.
Panels slide in an out of optional receptacles at each end

AUTOMATIC ACCESS CONTROL DEVICES AND CLUSTERS THEREOF

PRIORITY CLAIM

This application claims priority as a continuation of U.S. application Ser. No. 16/802,816 filed on Feb. 27, 2020, presently pending, which in turn claimed priority as a continuation of U.S. application Ser. No. 15/588,617 filed on May 6, 2017, issued as U.S. Pat. No. 10,590,693 on Mar. 17, 2020, which in turn claimed priority as a continuation of U.S. Ser. No. 14/690,245 filed on Apr. 17, 2015, issued as U.S. Pat. No. 9,644,417 on May 9, 2017. U.S. application Ser. No. 14/690,245 is a continuation in part of U.S. Ser. No. 14/485,705, filed on Sep. 13, 2014, which issued as U.S. Pat. No. 9,010,025 on Apr. 21, 2015. U.S. application Ser. No. 14/485,705, in turn, claims priority as a continuation of U.S. patent application Ser. No. 13/952,409 filed on Jul. 26, 2013, which issued as U.S. Pat. No. 8,832,997 on Sep. 16, 2014, which in turn claimed priority as a continuation in part of U.S. patent application Ser. No. 12/502,997 filed on Jul. 14, 2009, which issued as U.S. Pat. No. 8,499,494 on Aug. 6, 2013, and also as a non-provisional application of U.S. Provisional Application Ser. No. 61/763,943 filed on Feb. 12, 2013, and also as a non-provisional application of U.S. Provisional Application Ser. No. 61/775,522 filed on Mar. 9, 2013. U.S. patent application Ser. No. 12/502,997, in turn, claimed the priority benefit as a non-provisional Application of U.S. Provisional Application Ser. No. 61/135,322 filed on Jul. 18, 2008. U.S. application Ser. No. 14/690,245 also claims priority as a continuation in part of PCT Application US 14/15634, filed on Feb. 10, 2014, currently expired. Application US 14/15634, in turn, claims priority to U.S. patent application Ser. No. 13/952,409 filed on Jul. 26, 2013, which issued as U.S. Pat. No. 8,832,997 on Sep. 16, 2014. Application US14/15634 also claims priority to U.S. Provisional Patent Application No. 61/763,943, filed on Feb. 12, 2013, U.S. Provisional Patent Application No. 61/775,522, filed on Mar. 9, 2013, and U.S. Provisional Patent Application No. 61/906,893, filed on Nov. 20, 2013. The contents of each application is hereby incorporated by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

The current invention generally relates to secure entry points and access control devices that control the passage of pedestrians or vehicles in such a way as to provide a more secure access path to a building, premises, or secured area.

BACKGROUND

A wide variety of security access control devices exist today which attempt to control access to secure areas. Security checkpoints at airports include metal detection and various forms of x-ray and scanning capability, however, if a person carrying a weapon was determined to pass through such a security checkpoint while knowing they would be instantly detected, they could do so, and until they were apprehended they could use their weapon within the airport. Metal detectors at the entrance to banks will warn if someone carries a gun into a bank, however, it will not stop them from doing so.

Many security systems combine identification mechanisms such as cards, fingerprints, or optical scan in order to identify an individual and allow them access. Unfortunately, the perpetrator of the crime is sometimes one normally allowed access to a facility or area, and the use of an identification card will not hinder them. In the case of large gatherings such as lecture halls at universities, schools in general, sporting events, and large business facilities, if a person with suicidal tendencies is determined to wreak havoc and destruction upon a large number of people, today's security access devices will not prevent them from entering if they are carrying a weapon and intend to use it.

Therefore, a new security access control device is needed that will not only detect a person carrying a weapon and attempting to pass through an access point, but will absolutely prevent that person from passing if a decision is made to prevent them—that decision often being made automatically. Also, and given the fact that many of the institutions mentioned above normally allow unhindered access into areas where large gatherings occur, it is important that any new security access device allow high traffic flow at peak times while still being capable of stopping a person carrying a weapon.

A form of access mechanism still popular today is that of a revolving door. It provides continuous flow in both directions, and in spite of the fact that entry into a revolving door can be a little intimidating for some people, revolving doors are deemed to be safe, people understand how to use them, and they continue to be designed into new buildings including hotels, banks and airports. As a side benefit, a revolving door minimizes energy loss due to the manner in which air passes through the door.

There are negatives relative to using a conventional revolving door in a security application and especially in applications where the amount of traffic is substantial. Conventional revolving doors provide a fixed amount of traffic flow, and the level of flow is always equal in both directions. Thus at a time of day when most people will be exiting a facility, a revolving door will have one-half of its capacity unutilized, and therefore a conventional revolving door is space-inefficient. In other words, given an entry passageway to a facility or area of a certain width, a conventional revolving door would be wasting half of that width at times of peak flow in primarily one direction.

If a person in a revolving door was detected to be suspect of carrying a weapon, the revolving door would be stopped and possibly reversed; however, if another person was simultaneously exiting in the opposite direction within the same revolving door, they would be stuck in the door, or forced to back up.

Full height turnstiles with multiple crossbars can be useful but have similar problems. Only half the width of a conventional turnstile unit is used for passage, and the other half is not usable because of the style of construction of these units. Also, because a conventional turnstile is stationary, placing two of them in series in order to stop a detected perpetrator between them creates the requirement for both of them to be closed at the same time, and also that they both should never be open simultaneously. As a result, a person cannot enter such a turnstile complex, while the person ahead of them is simultaneously leaving. Thus the use of a conventional turnstile tends to impede the flow of traffic and is space-inefficient in a manner similar to a revolving door.

What is needed is a security access control device that is space-efficient, extremely high throughput, and offers great flexibility in directional control, while at the same time will absolutely prevent a person carrying a weapon from entering a secured area. Applicant has identified these, as well as other shortcomings and needs in the current state of the art in coming to conceive the subject matter described and claimed throughout in this patent application.

SUMMARY OF THE INVENTION

The embodiments of the invention described herein are electro-mechanical and electronically controlled access devices for controlling access to a building, premises, or area in a secure manner such that a person who is deemed ineligible for access will be barred entry and may be optionally retained. One or more access control devices, according to this invention, would be deployed such that the only way to enter a secured area would be through an access control device. A subject wishing to enter a secured area protected by such devices would find the spaces adjacent to and above the access control device sealed, allowing the only route of passage to be through an access control device. The direction of flow through a device according to these embodiments, is electronically controlled and may be changed at any point in time. At any instant in time, the flow through the device is unidirectional. The terms "access control device" and "security portal" and "portal" are herein used synonymously.

One object of the various embodiments of this invention is to provide a security access control device that is space (width) efficient while offering extremely high throughput, such that subjects attempting to walk through the security access control device may do so while walking continuously through the security access control device. The security access control device should be suitable for operation at the entrance to different forms of facilities where people may gather, including the following:

Airport main entrances
Train and Bus stations
Hotels
Banks
Churches, Synagogues, and Mosques
Marketplaces and Malls
Stadiums and conference halls
Government and office buildings
Factories
High schools, colleges, and universities One object of the various embodiments is that multiple access control devices such as those described herein may be stacked side by side to allow further increased traffic flow, and that the width is as small as possible to allow a large number of such access devices to be stacked side-by-side thereby further increasing traffic flow when the space available for such access devices is limited. When multiple access control devices are used, the number of devices allowing flow in one direction relative to the opposite direction may be varied according to time of day and according to demand. For instance, if used at the entrance to a building at a time when individuals are expected to be mostly entering the secure area, the majority of the access controlling devices would be controlled to allow flow in the direction consistent with entering. Control of which portals within a stack or gang are in "enter" mode and which are in "exit" mode may be optionally performed automatically by a central control system that controls multiple portals. Such a central control system may make decisions on the directional flow of individual portals within a gang based on information describing the aggregate directional flow of a crowd of subjects as determined by sensor(s) that observe the areas on the exit and entrance sides of a stack or gang of multiple portals. Such sensor(s) may use visual, sonic, IR, or RF imaging to observe aggregate traffic flow to determine the overall magnitude of flow and the aggregate magnitudes of flow in each of entrance and exit directions. As part of this control, a particular portal may need to change direction from time to time. When a portal is about to change direction, a message can be displayed on that particular portal that in a specific time period, it will change direction and cease to allow passage for those currently in line should a queue exist. Such a message can also count down the time remaining so that individuals who will need to move to a different portal are properly and fairly notified in plenty of time to make a move. Upon an emergency such as a fire or earthquake, all devices could be set to a mode consistent with exiting the secured premises. Alternately, the device is capable of being electronically controlled to be placed in a mode where all doors contained therein are fully open, and individuals have an unimpeded capability to exit a premises in an emergency.

In various embodiments, a variety of sensor technologies may be incorporated into the device, such that as an individual is entering and is subsequently contained within the doors of the device, the individual and their belongings are scrutinized to determine if a weapon is present. Such technologies may include but are not limited to metal detectors, chemical, explosive, biological, and radiological sensors, and different scanning technologies, including x-ray imaging and penetrating RF imaging such as (UWB) radar imaging or millimeter-wave imaging. Such sensors and associated sensor-related components may be incorporated into any components of the structure comprising the linear revolving door mechanism, including the sidewalls, floor, ceiling, and any surfaces of the moving door panels. Video imaging may also be included such that a subject's face may be observed as they walk through the access control device. Observing and analyzing the expressions on a subject's face have been shown to offer clues as to a subject's state of mind—especially when they are contemplating a violent act and/or self-destruction.

Another object of the various embodiments is that each door panel should move automatically without requiring or allowing any contact with subjects passing through the access control device, and by sensing the proximity and movement of subjects passing through, will automatically adjust the rate of movement of the different door panels within the access control device to match the speed of movement of a subject, thus maximizing the throughput rate of the access control device by adapting to the rate of movement of each subject passing through. In order to do this, door panels are driven by electromechanical means controlled by a computer/processor. In addition, proximity sensors in the door panels and/or the side panels sense the location of individuals approaching the access control device and passing through it, and the rate of movement and position of the door panels is controlled such that panels never touch individuals passing through. The movement of the door panels can be controlled to track the pace of the subject walking through and match their pace to allow maximum throughput, as long as there is still enough time while both door panels are "closed" to form a detection chamber and take a reading of included threat sensors.

Various types of proximity/position sensors are known in the art and may be used, including sound, IR, and RF-based sensors. Additionally, emitters and receivers for position and/or proximity sensing may be placed in the top cover and/or the floor of the portal.

Another object of the various embodiments is that weapon passing from one perpetrator to another through the access control device is not possible. To fulfill this objective, any gaps that exist between a door panel and a side panel at any point during the motion of that door panel may be optionally filled by additional sliding panels which move adjacent to a side panel in the vicinity of a door panel and are electromechanically controlled such that any gap that may emerge is filled, these additional sliding "panels" being controlled such that their motion does not interfere with the movement of any door panel. Alternately, each of the moving door panels may contain a telescopic extension that extends to fill the gap between that panel and a side panel of the access control device. To further prevent the passing of weapons through the portal, and also to enable temporary sealing of a "detection chamber" that is briefly formed when the moving door panels of a portal are parallel, additional gap filling and sealing embodiments are included between the moving door panels and the top cover of the portal to temporarily block air movement in and out of the "detection chamber" and also to prevent the passing of weapons through the portal.

Another object of the various embodiments is that it be constructed with door panels and side panels fabricated from bulletproof material such that a perpetrator who becomes trapped within the device cannot shoot their way out, or if they are carrying an explosive device, the blast will be at least partially contained if the explosive device is activated from within the access control device. A clear bulletproof material such as polycarbonate may be suitable, as well as certain composite materials such as Kevlar.

Another object of the various embodiments is to provide a provision for disabled individuals in wheelchairs to pass through. In order to do this, it may be appropriate to utilize a security verification mechanism such as a card reader, fingerprint reader, or retina scan mechanism used in conjunction with the access control device—such security verification mechanisms authenticating that the individual is in fact disabled and has the right to pass through the access control device in a wheelchair.

Another object of the various embodiments is to allow a parent with a child to pass together through the security access control device. A similar capability will allow a second person to accompany a disabled person through the portal. If that person is a guard carrying a weapon, a biometric device can be available to allow the guard to be properly identified and allowed to pass through along with a disabled person or child that has also been properly identified. Sensors in the portal can validate that only the persons being biometrically identified are in the portal.

Another object of the various embodiments is that the access control device can be optionally programmed so that when an alarm is set off, the door panel behind the individual opens, thereby allowing the person to exit in the reverse direction. To avoid false alarms when large numbers of individuals are passing through the security access control devices during peak traffic times, the access control device may be used in conjunction with a pre-chamber where individuals who believe they might set off an alarm, possibly due to equipment they are carrying or embedded metallic medical devices in their body, can determine if they will pass successfully before attempting to pass through the access device whereby they gain entry to the building, premises, or secured area. Objects that set off the alarm can be separately screened in a security screening conveyer similar to those found at airports.

Another object of the various embodiments is that the access control device may be used in conjunction with a crowd motion sensing means, such that the directionality of individual devices within a cluster of access control devices according to this invention may be controlled from moment to moment in such a way as to match directional throughput capability of the cluster with the requirements indicated by crowd movement.

Another object of the various embodiments is that the access control device is capable of operating unattended for extended periods of time. A stack or gang of access control devices according to this invention may also operate unattended, or alternately may require only minimal attendance, for instance a single security guard who presides over a stack or gang of multiple access control devices.

Another object of the various embodiments is that the access control device may include ducting for controlled air flow such that air in the vicinity of the subject entering and within the device may be moved and passed through sensor devices which may detect chemical, biological, and/or radiological hazards.

Another object of the various embodiments is that the access control device may include ducting for controlled airflow such that air moving from within a building into the access control device is at least partially re-circulated back into the building rather than released to the outdoors in order to conserve energy.

Another object of the various embodiments is that a single access control device may be used at an entrance by providing a bi-directional operation sequence wherein a first subject passes through in a first direction and a second subject passes through in a second direction, the first and second directions being opposite one another, and the first and second subjects being allowed to pass on successive cycles of the access control device.

Another object of the various embodiments is that the moving door panels of the access control device are suspended from sliding roof panels and are driven from mechanisms incorporated into the moving roof panels, the moving roof panels also providing a top cover that prevents weapon passing.

BRIEF DESCRIPTION OF THE DRAWINGS

FIGS. 4A, 4B, and 4C show different moments in time during the operation of the security access control device.

FIGS. 5A, 5B, and 5C show different moments in time during the operation of a security access control device.

FIG. 13A shows the first point in time where a second door panel is positioned between a first door panel and a sidewall. FIG. 13*b* shows a second point in time where a second door panel is not positioned between a first door panel and a sidewall, and a telescoping extension is deployed to fill the space between the first door panel and the sidewall.

FIG. 17A is a top view showing multiple slots in a floor panel and a drive socket below movable by a belt or chain drive.

FIG. 17B is a side view showing the anchor assembly having descended and engaged with a drive socket, the anchor assembly including a tined fork that has passed through the multiple slots shown in FIG. 17A.

FIG. 19A is a top view of a door panel and an arrangement of sprockets and belt or chain drive that are located below the floor panel. FIG. 19B is a side view cross-section where a tined fork passes through slots in the floor panel to engage with a drive socket below, the drive socket being attached to a drive belt or chain as shown in FIG. 19A.

FIG. 20B is a top view of the same door panel and drive arrangement; however, as viewed from above the floor panel, and showing a plurality of slots in the floor panel to allow a multi-tined drive fork to pass through.

FIG. 21 also shows structures for forming slots in the floor panel.

FIG. 22 also shows structures for forming slots in the floor panel.

FIGS. 38*a* and 38*b* show all moving door panels positioned to allow unimpeded pedestrian passage for an emergency situation.

FIG. 41*a* shows normal operation, and 41*b* shows operation with a brake mechanism deployed.

DETAILED DESCRIPTION

The invention is illustrated by way of example and not by way of limitation in the figures of the accompanying drawings in which like references indicate similar elements. References to embodiments in this disclosure are not necessarily to the same embodiment, and such references mean at least one. While specific implementations are discussed, it is understood that this is done for illustrative purposes only. A person skilled in the relevant art will recognize that other components and configurations may be used without departing from the scope and spirit of the invention.

In the following description, numerous specific details are set forth to provide a thorough description of the invention. However, it will be apparent to those skilled in the art that the invention may be practiced without these specific details. In other instances, well-known features have not been described in detail so as not to obscure the invention.

In accordance with the embodiments of the invention, there are described devices and methods for controlling secure passage between two or more locations. Each of these devices can contain multiple rotatable door panels that can be positioned behind one another. In various embodiments, the door panels can be controlled by mechanized arms or other control devices in order to perform the functionality described herein.

It is noted that the term "perpendicular," as used throughout the various embodiments of this disclosure, is not necessarily limited to the precise geometrical perpendicularity of ninety degrees. Rather, this term should be construed as substantially perpendicular with respect to the sidewalls and/or direction of traffic flow so as to cause a closed position of the door panel(s) in order to block the passage of an individual or object through the security portal.

Figure 1:
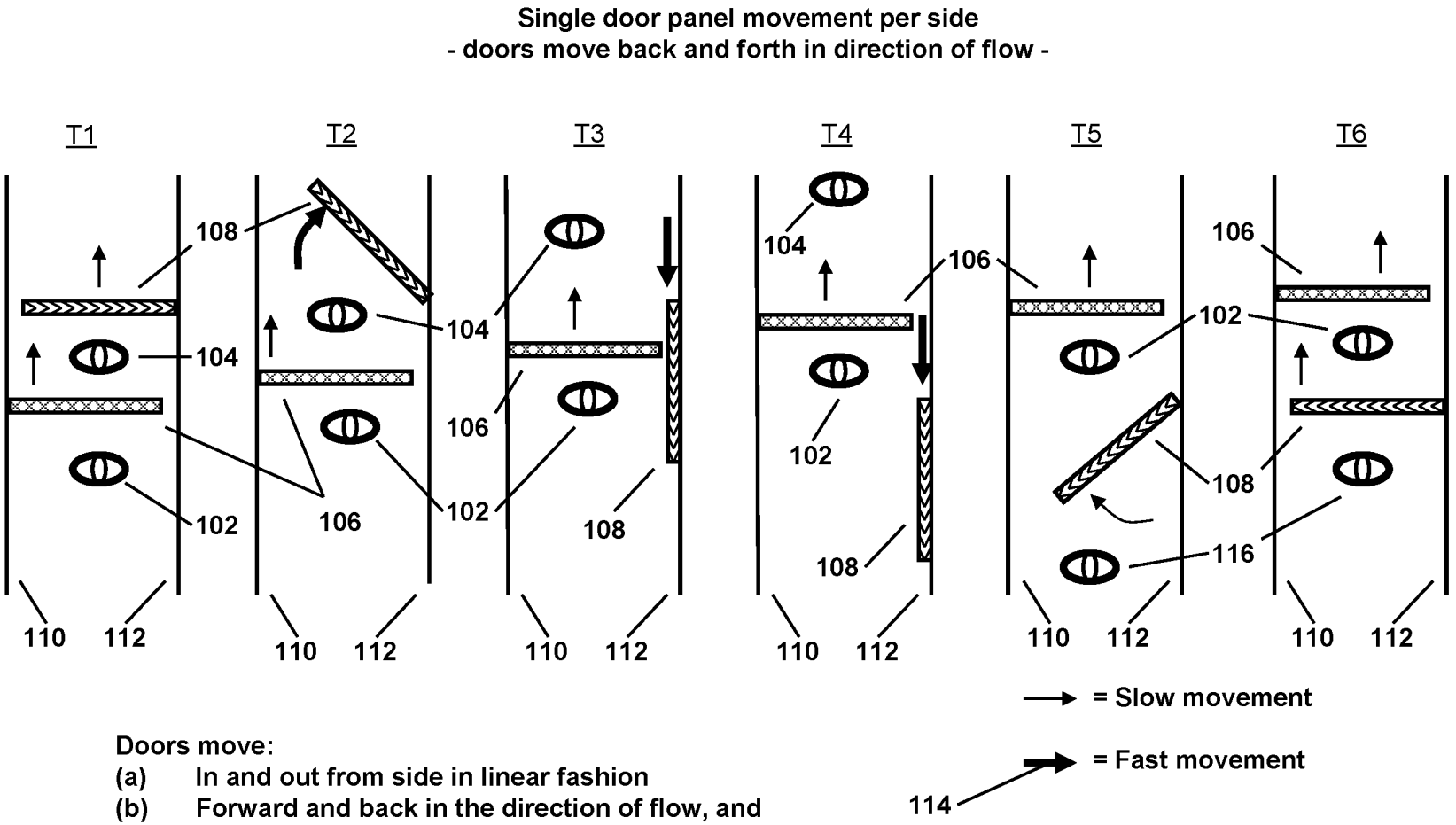
FIG. 1 is a top view illustrating the functionality of an embodiment of a security access control device in accordance with the present invention.
Figures 2A, 2B:
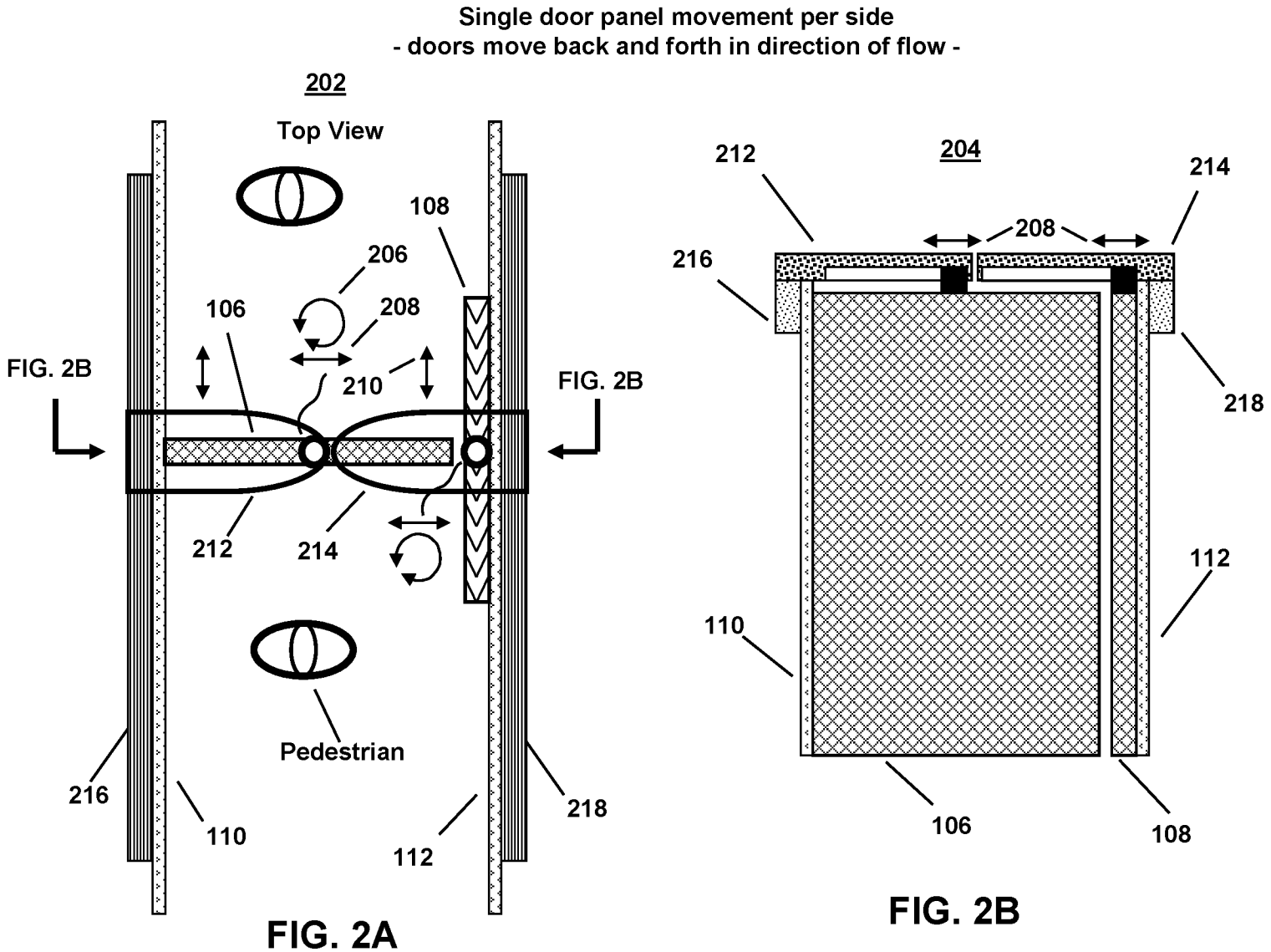
FIG. 2A is a top view.
FIG. 2B is a cross-sectional view of an embodiment of a security access control device, in accordance with the present invention.
Figure 3:
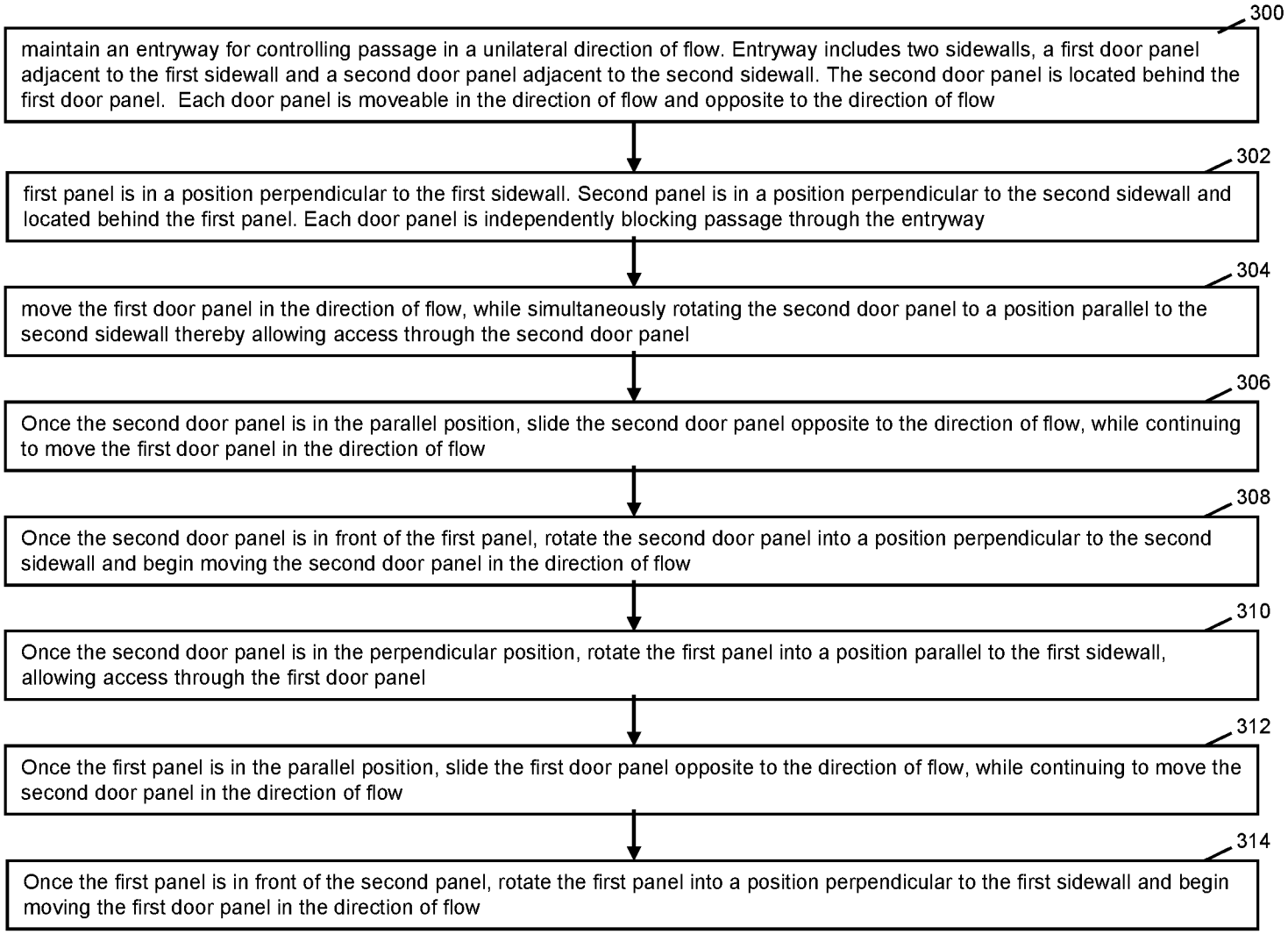
FIG. 3 is a flow chart diagram of a process for operating the security access control device of FIG. 1.

One exemplary and non-limiting embodiment for the invention is shown in FIGS. 1, 2, and 3. FIG. 1 shows the sequence of events whereby one individual 102 may be entering the access control device simultaneously with another individual 104 leaving the device, thereby enhancing throughput. In the embodiment shown in FIGS. 1 and 2, each door panel is electronically controlled to rotate 206 and move both laterally 208 and longitudinally 210 relative to the direction of flow. In timeframe T1, an individual 104 is within the access control device while another 102 is entering, and both first door 106 and second door 108 are instantaneously parallel to one another and preferably moving forward simultaneously, thus for that instant forming a detection chamber. When the moving door panels are parallel, they may move together in the direction of flow for a programmable amount of time to control the duration of time for which the detection chamber exists. In T2, second door 108 is moving forward and rotating in a manner emulating a revolving door allowing the individual 104 within the access control device to begin to exit. Simultaneously in T2, first door 106 is moving forward, allowing the next individual 102 to enter. In T3, the individual 102 just entering continues to move forward behind first door 106 while second door 108 moves to become adjacent to the side panel 112 and then slides along the side panel 112 at a faster rate 114 until it is behind the person 102 currently entering as shown in T4. In T5, second door 108 now begins to rotate and move laterally in a manner emulating a revolving door, eventually assuming a position behind the person 102 who has just entered as shown in T6 where the two moving door panels 106 and 108 are instantaneously parallel to one another and thus for that instant form a detection chamber. During T5 and T6, both first door 106 and second door 108 are also moving forward in the direction of flow, thus always allowing persons entering the access control device to be continually moving. Subsequent to timeframe T6, the sequence of T1 through T6 essentially repeats; however, this time, second door 108 is in front of the person 116 about to enter the access control device, and first door 106 is in front of the person 102, who is currently within the access control device.

Note that at certain points in the sequence of operation, there appear to be gaps between a door panel and the side panel opposite that where that door panel's control arm attaches. To prevent these gaps being used by a perpetrator for passing weapons to another perpetrator, any gaps that exist between a door panel and a side panel at any point during the motion of the door panel may be optionally filled by additional sliding panels which move adjacent to a side panel in the vicinity of a door panel and are electromechanically controlled such that any gap that may emerge is filled, these additional sliding "filler panels" being controlled such that their motion does not interfere with the movement of any door panel.

FIG. 2A is a top view 202 and FIG. 2B is a cross-section view 204 of an access control device according to an embodiment of the invention. Each of the panels represented as first door 106 and second door 108 is suspended from control arms shown as first arm 212 and second arm 214. These control arms contain electromechanical mechanisms which cause the attached door panel to rotate 206, and also move the door panel attachment point laterally 208 relative to the direction of flow. In addition, each control arm is capable of moving longitudinally 210, the arm being driven by an electromechanical mechanism, thereby allowing the attached door panel to be moved longitudinally as the control arm it is suspended from moves longitudinally. The control arm moves longitudinally along a track 216, 218 which is mounted at the top of the side panel 110, 112.

FIG. 3 is a flow chart diagram of the process for operating the security access control device, in accordance with the embodiment illustrated in FIG. 1. Although this figure depicts functional steps in a particular sequence for purposes of illustration, the process is not necessarily limited to this particular order or steps. One skilled in the art will appreciate that the various steps portrayed in this figure can be changed, rearranged, performed in parallel, or adapted in various ways. Furthermore, it is to be understood that certain steps or sequences of steps can be added to or omitted from this process, without departing from the spirit and scope of the invention.

As shown in step 300, the device includes two sidewalls, a first panel and a second panel, as previously described. For ease of understanding, the process illustration begins with both door panels in the closed position, as shown in step 302. While both moving door panels are positioned perpendicular to the sidewalls and parallel to each other, as shown in step 302, a subject enclosed between the first and second moving door panels may be scanned with one or more threat sensors to determine if they represent a threat. Should a threat be detected, the sequence of door panel movements may be subsequently altered to be different from that shown in FIG. 3 and may open the door behind the subject and allow them to exit the portal in reverse.

In step 304, the first door panel is moved in the direction of flow, while the second door panel is simultaneously rotated into a position parallel to the sidewall, allowing passage through the second door. Once the second panel is in the open position, it begins to slide in the direction opposite from the direction of flow until it passes the first door panel (step 306). At this point, the second door panel is now in front of the first door panel.

In step 308, once the second door panel is in front of the first, it rotates into a closed position (perpendicular to the sidewalls). At this point, the second door panel begins to move in the direction of flow while being maintained in the closed position. After the second panel has been closed and is moving along the direction of flow, the first panel is rotated into an open (parallel) position, allowing passage therethrough, as shown in step 310.

In step 312, the first panel is slid opposite to the direction of flow until it passes the second panel. In the meanwhile, the second door panel continues to move in the direction of flow. In step 314, once the first panel is in front of the second panel, it is rotated back into the closed position and begins to move once again in the direction of flow. At this point, the process can loop back to step 304, where the second panel is rotated to the open position.

The process shown in FIG. 3 can continue indefinitely or can be stopped and (re)started automatically or as needed. It should also be noted that the unidirectional traffic flow through the entryway can be reversed, as will be clearly evident to one of ordinary skill in the art in light of this disclosure.

Figures 4A, 4B, 4C:
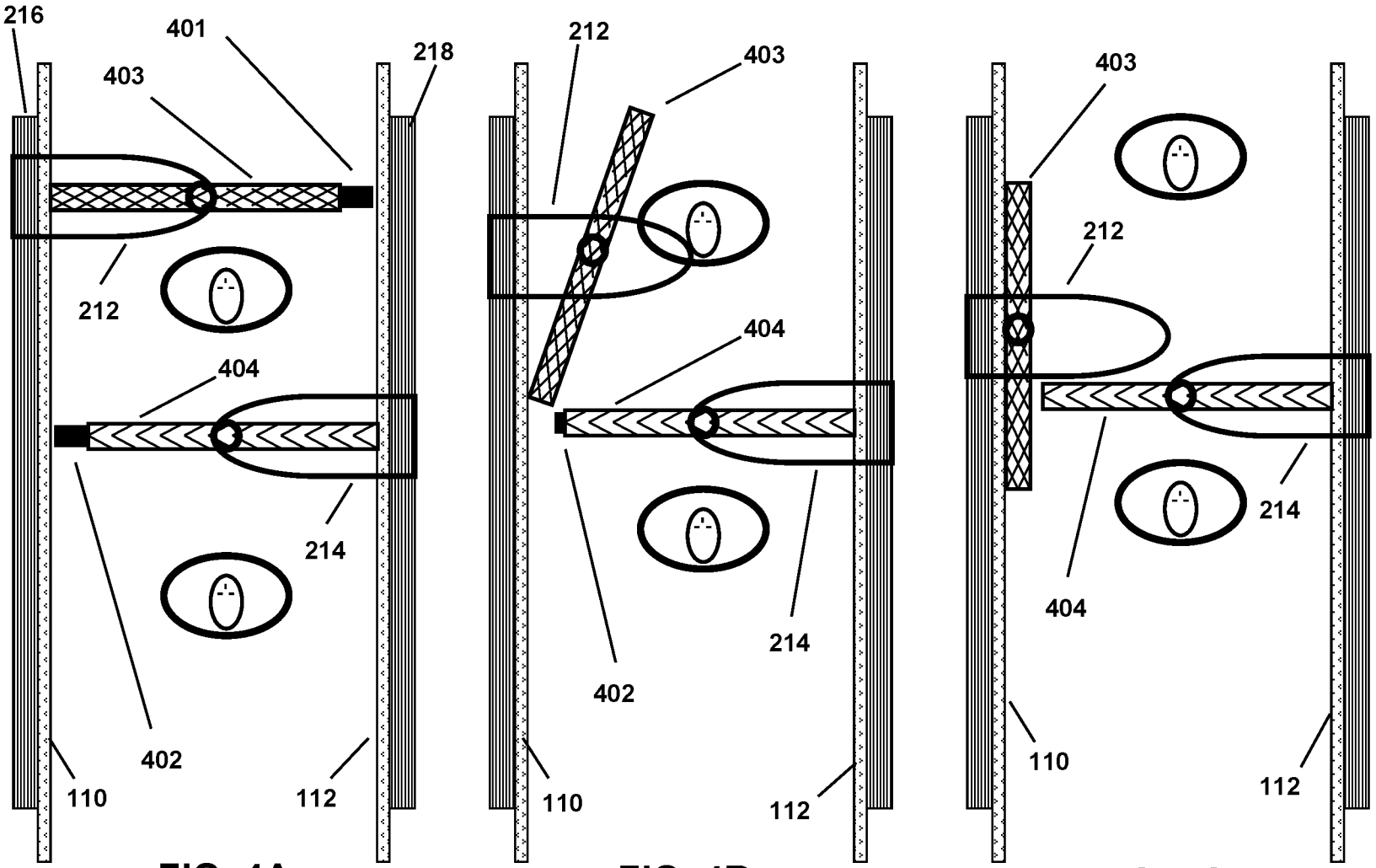
FIGS. 4A-4C illustrate an embodiment of a method and device for filling a gap between a moving door panel and a sidewall of a security access control device in accordance with the present invention.

As mentioned earlier, it can be preferable that there not be a moment in time where a gap exists that would allow passage of even a small weapon (for instance, a small gun or grenade) through the portal. As shown in FIGS. 4A-5C it can be desirable to have means for filling the gap between a moving door panel and a sidewall. Thus, the scenario may be prevented where two or more subjects work together such that a first subject who does not carry a weapon may pass through the portal first, and subsequently, a second subject might toss a weapon through the gap in the portal to the first subject who is already on the inside of the facility being protected by the portal. For the embodiment of FIG. 1 where each moving door panel must occasionally pass alongside the other moving door panel during the operation of the portal, there must be a gap available for this passage to occur. As shown in FIG. 4A, this gap is filled by telescoping extensions 401 and 402 that project from door panels 403 and 404, respectively under control of the portal's control system. In FIG. 4B, as door panel 403 moves closer to a position parallel with the sidewall, telescoping extension 402 starts to withdraw into door panel 404 to create a gap for panel 403 to pass. In FIG. 4C, door panel 403 is now parallel and adjacent to the sidewall and is passing alongside door panel 404, telescoping extension 402 having now been completely withdrawn into door panel 404.

Figure 5C:
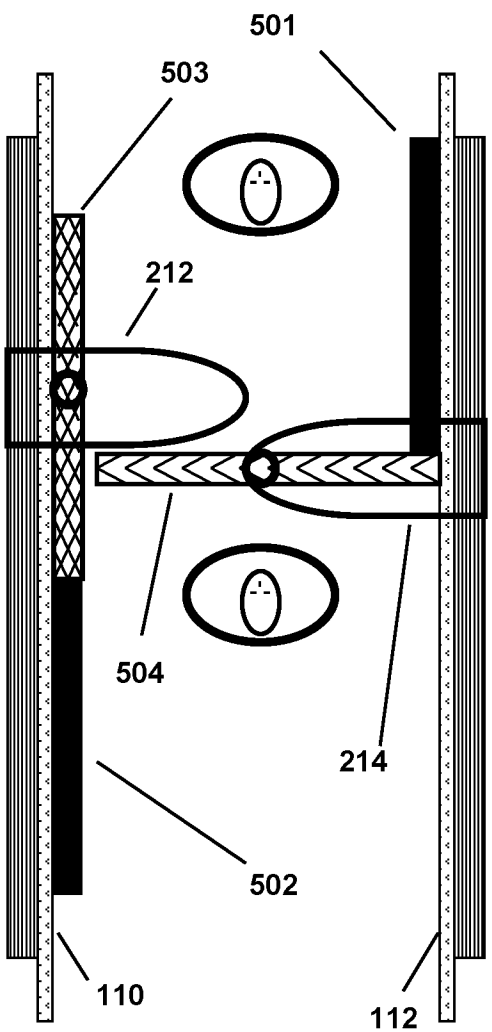
FIGS. 5A-5C illustrate an alternative embodiment of a method and device for filling a gap between a moving door panel and a sidewall of a security access control device in accordance with the present invention.
Figure 5B:
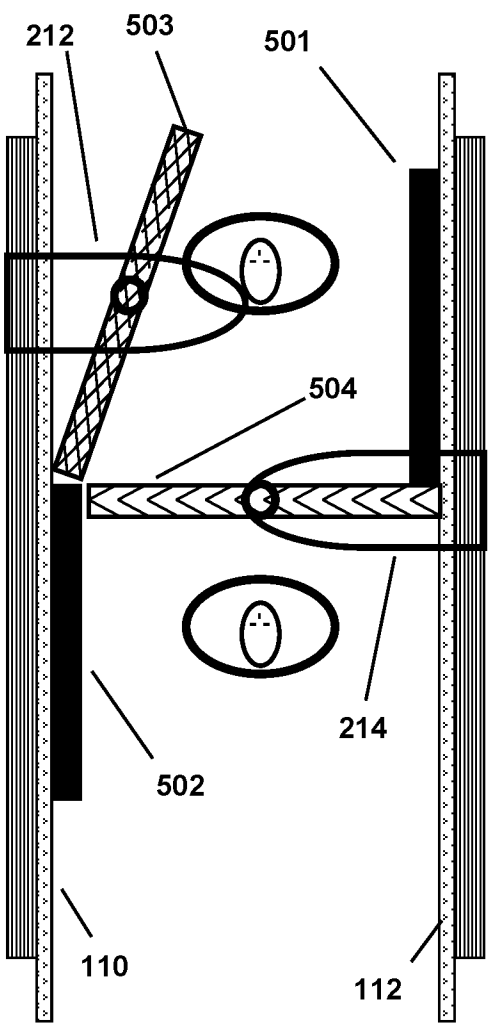
Figure 5A:
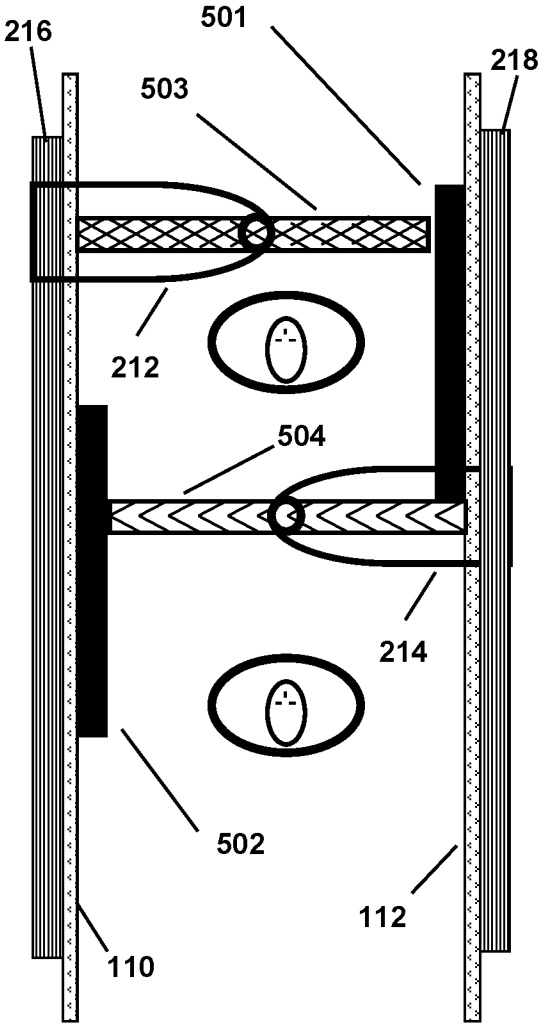

A similar scenario exists in FIGS. 5A-5C where sliding filler panels 501 and 502 performing similar tasks to the telescoping extensions of FIGS. 4A-4C. In FIG. 5A, sliding filler panels 501 and 502 fill the gaps adjacent to door panels 503 and 504, respectively. In FIG. 5B, door panel 503 is moving towards the sidewall and starting to pass through the gap adjacent to door panel 504, while sliding filler panel 502 is beginning to withdraw from the gap which door panel 503 will shortly occupy. In FIG. 5C, door panel 503 is now fully adjacent to the sidewall and is in the gap adjacent to door panel 504, filler panel 502 having withdrawn to allow the passage of door panel 503. At another point in the sequence of operation, sliding filler panel 501 performs a similar function to filler panel 502, moving aside to allow door panel 502 to pass through a gap between door panel 503 and the opposite sidewall.

Figure 6:
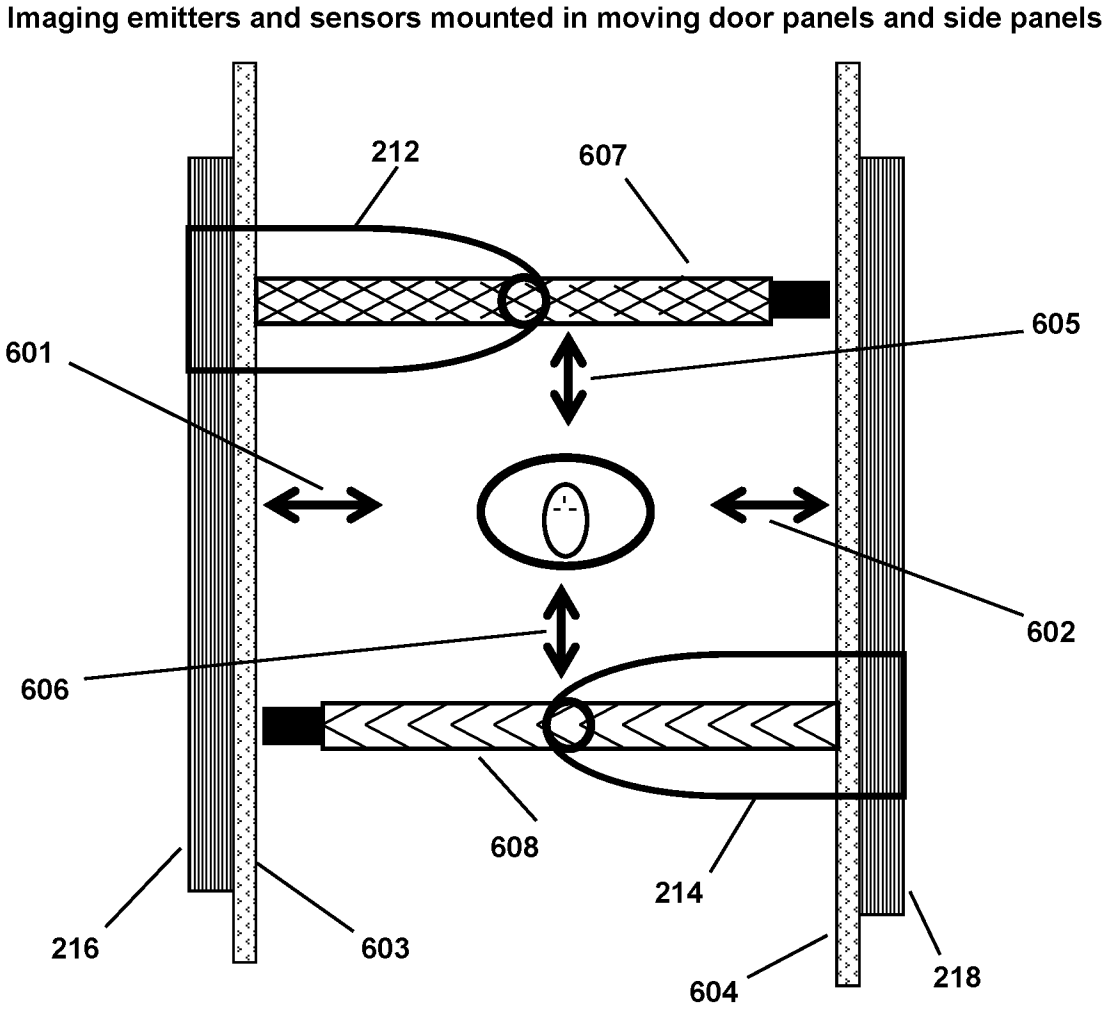
FIG. 6 is an illustration of imaging sensors and emitters usable with embodiments of moving door panels and side panels in accordance with the present invention.

As shown in FIG. 6, when moving door panels 607 and 608 are parallel, a detection chamber is formed with sidewalls 603 and 604 forming the other two walls of the chamber. In addition to conventional metal detection technologies and various chemical, explosive, and bio-detection technologies, there are imaging technologies that may be employed to observe the subject, the subject's clothing, and objects that the subject may be carrying, whether concealed or visible. For example, various radio frequency (RF) imaging technologies exist such as ultra-wideband (UWB) radar and whole-body imaging (WBI) technologies exist such as millimeter-wave scanner and backscatter x-ray that enable a view of the subject that penetrates any clothing to reveal shapes that may correspond to the shape of various weapons. Emitters and/or detectors for these imaging technologies may be located in both the moving door panels and the side panels, and the paths of RF and x-ray radiation within the detection chamber may be represented by arrows 601 and 602 when emitters and/or detectors are mounted in the sidewalls, and by arrows 605 and 606 when emitters and/or detectors are mounted in the moving door panels. Note that the moving door panels may be continuously rotated 360° in either direction and that depending upon their position in the operational sequence when a detection chamber is created, either side of a moving door panel may in fact be facing the detection chamber. Thus, any imaging emitters and/or detectors mounted on a moving door panel should be mounted redundantly on both sides of the door panel.

Similarly, video cameras for optical imaging of a subject may be mounted on both sides of the moving door panels and optionally on the sidewalls as well. Video imaging may be included such that a subject's face may be observed as they walk through the access control device. Observing and analyzing the expressions on a subject's face have been shown to offer clues as to a subject's state of mind—especially when they are contemplating a violent act and/or self-destruction. To ensure that the subject's face is properly viewed such that the image can be properly analyzed by computer, the system can prompt a subject—by voice or signage or both—to look straight ahead for consistent and proper video capture. When thus prompted, if the subject does not comply, the system may optionally stop allowing forward progress of the subject until they comply, or alternately may deny passage and back them out of the portal.

As a further aid to monitoring the position of a subject passing through the portal and further to ensure the number of subjects within the portal, position detection may also be performed by mounting emitters and/or sensors in either the floor or top cover of the portal or both. These positions sensors may be of IR, sonic, or some other technology.

Figure 7:
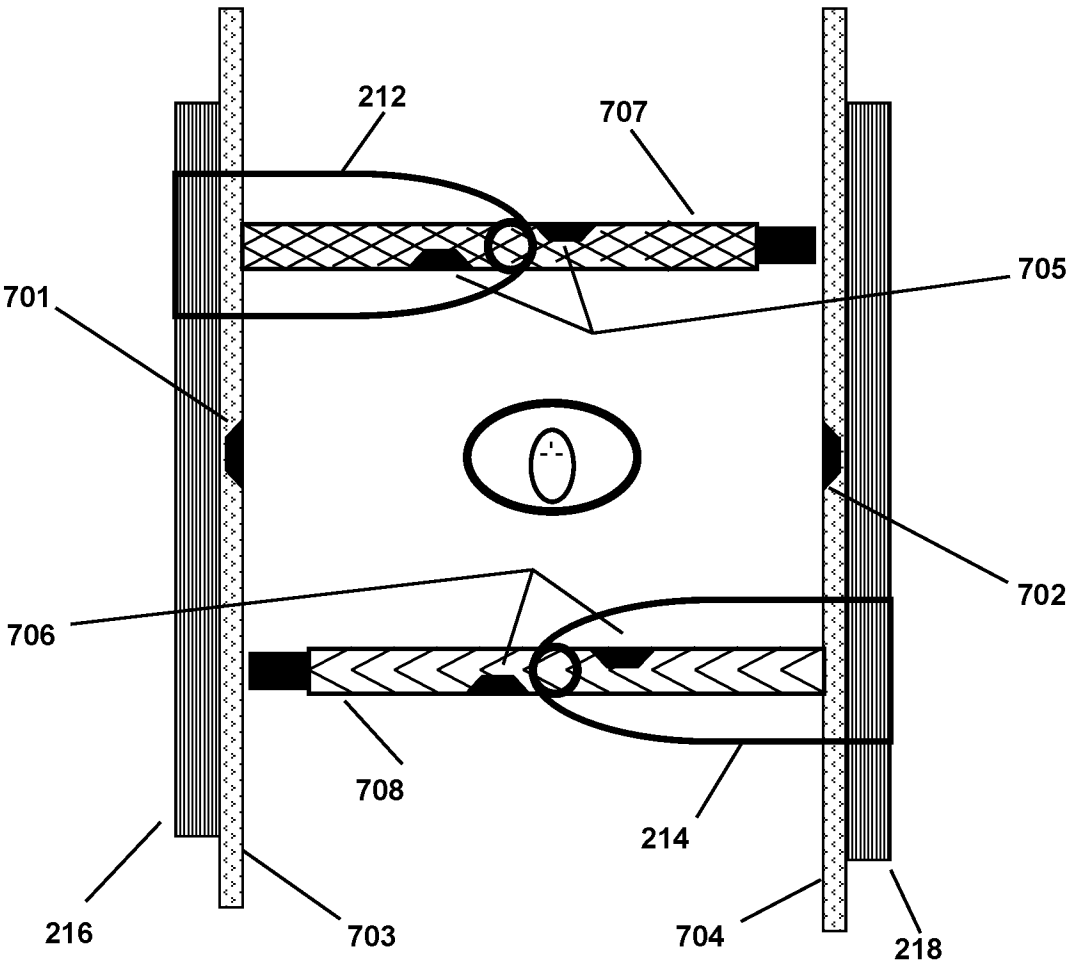
FIG. 7 is an illustration of biometric ID sensors and/or ID input devices usable with embodiments of moving door panels and side panels in accordance with the present invention.

At times, it may be useful to identify a subject who is within the detection chamber of an access control device according to this invention. This circumstance may occur if a security guard wishes to pass through the portal and is carrying a weapon. As shown in FIG. 7, to allow this person to pass, the operational sequence of the portal may pause at the point where the moving door panels 707 and 708 are parallel forming a detection chamber. The subject may then interact with a biometric detection device such as 705 and 706 located in a moving door panel, or 701 and 702 located in sidewalls 703 and 704, respectively. A common way to perform this biometric validation would be a fingerprint identification mechanism. Alternately, or in combination, a device capable of performing a retinal scan may also be included. Thus, if the system confirms that there is only one person in the detection chamber and that person is positively identified as being allowed to pass while carrying a weapon, the sequence of operation of the portal will continue and allow the person to enter the secured area. Another circumstance where biometric specification is useful is to identify disabled persons that may need to pass through the portal along with various metallic devices such as a wheelchair, crutches, or cane. Again, if this person is certified to be safe to pass and the detection mechanisms in the detection chamber within the portal determine that only this person is present and they are validated, then the operation of the portal may proceed further and allow them to pass. Yet another circumstance may arise where a security guard may assist a disabled person or child in passing through the portal. Again, the security guard can identify themselves to the biometric sensing system and be allowed to pass along with the person they are escorting.

Although typically described herein as supporting a unidirectional traffic flow, a portal according to the invention may also be used for bi-directional traffic where successive subjects may travel through the portal in different directions. Once activated to allow a subject to pass, travel is unidirectional for that subject. When two subjects approach a portal simultaneously from two different directions, the arbitration for deciding which subject is allowed to pass first may be decided by a number of well-understood mechanisms. These include sensor systems that determine which subject approached the portal first and/or sensor systems that determine the number of subjects queued for passage on each side of the portal and subsequently decide which direction of passage to allow first based on the greater demand.

Figure 8:
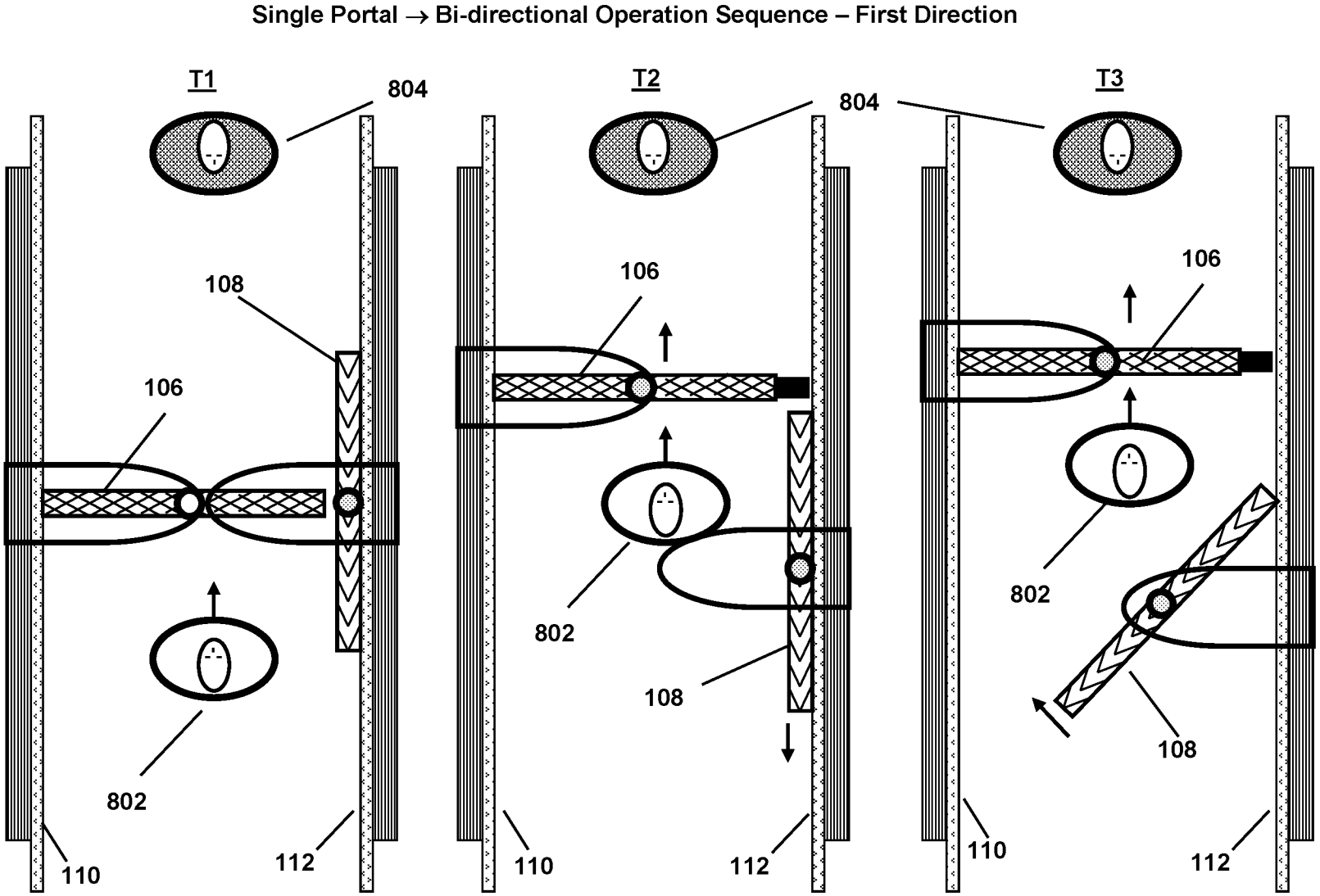
FIG. 8 is the first of four figures that demonstrate a bi-directional operation sequence for an embodiment of a single linear revolving door (LRD) Portal in accordance with the present invention.
Figure 9:
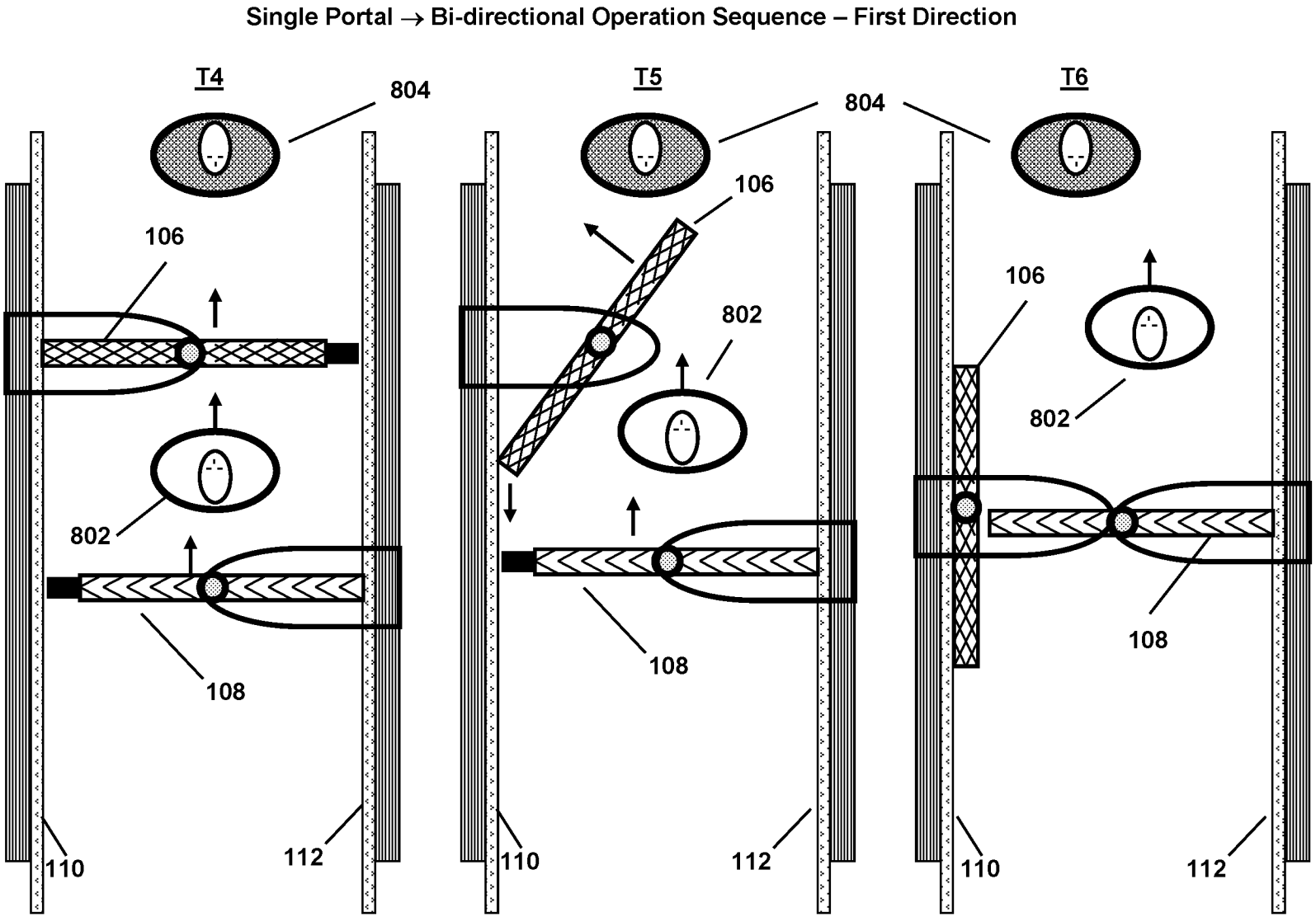
FIG. 9 is the second of four figures that demonstrate a bi-directional operation sequence for an embodiment of a single LRD Portal in accordance with the present invention.

For bi-directional operation, a portal starts in a neutral position where according to timeframe T1 in FIG. 8, a first door panel 106 is oriented perpendicular to the sidewalls and is separated from sidewall 112 by a second door panel 108. From this neutral starting position, passage in either direction can begin. Next in timeframe T2, a first subject 802 begins passage in a first direction with door panel 106 moving forward in front of them and door panel 108 moving in a reverse direction adjacent to sidewall 112. Next in timeframe T3, door panel 106 continues to move forward while door panel 108 starts to swing behind subject 802. In timeframe T4 of FIG. 9, both door panels 106 and 108 are perpendicular to the sidewalls, for an instant forming a detection chamber. At this point in time, if the subject 802 is traveling in a direction where security must be maintained, passage will be blocked if a weapon is detected, and subject 802 would typically the allowed to reverse direction and back out of the portal with a door panel 108 opening to allow such reverse travel. In timeframe T5, door panel 106 swings open, allowing subject 802 to begin to exit the portal while door panels 108 and 106 have assumed a neutral starting position similar to timeframe T1 except that now door panel 108 is positioned perpendicular to the sidewalls and door panel 106 is positioned adjacent sidewall 110 and between door panel 108 and sidewall 110. From this neutral starting position passage by a second subject 802 may begin in a second direction which is opposite the first direction, as further described in FIGS. 10 and 11.

Figure 10:
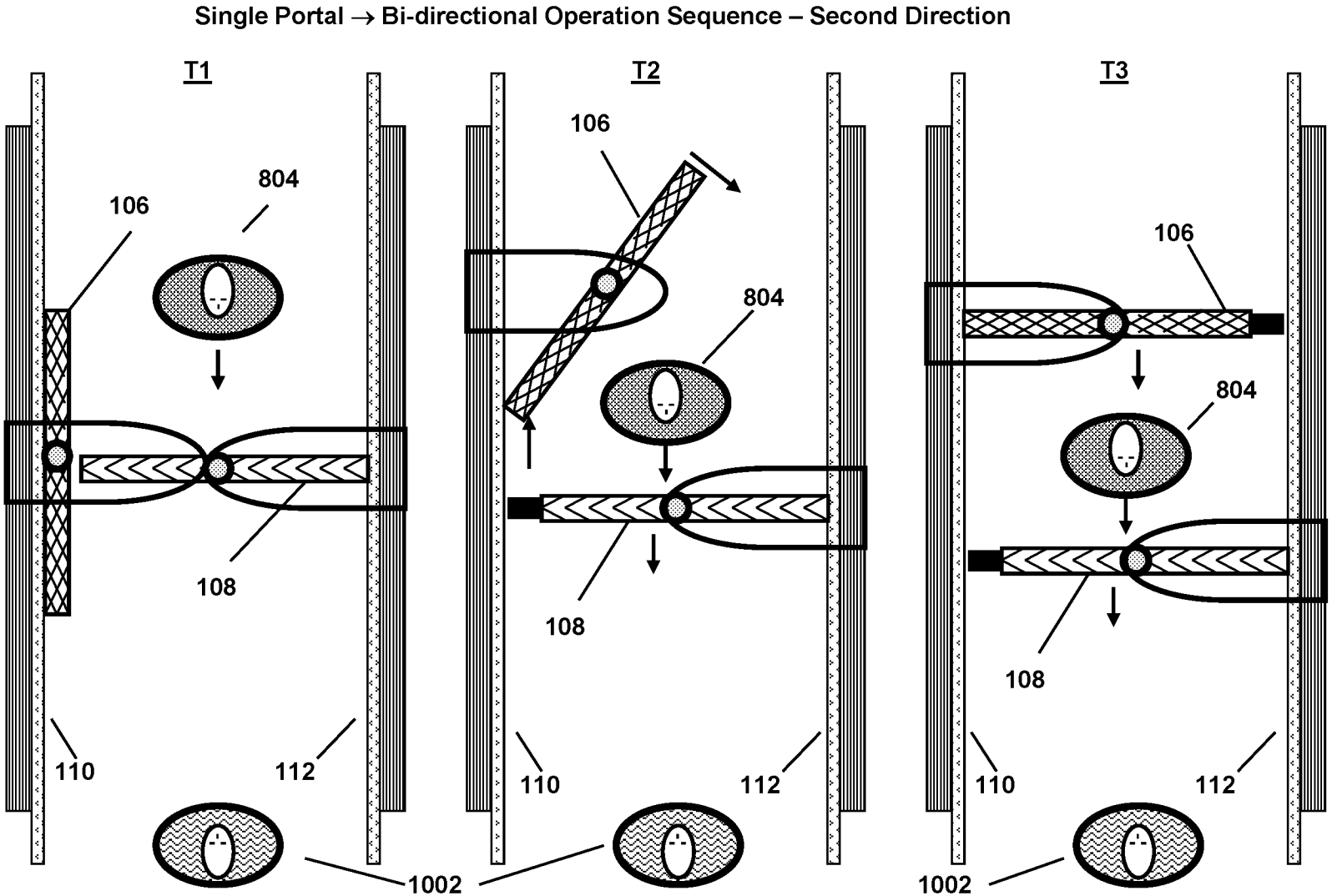
FIG. 10 is the third of four figures that demonstrate a bi-directional operation sequence for an embodiment of a single LRD Portal in accordance with the present invention.
Figure 11:
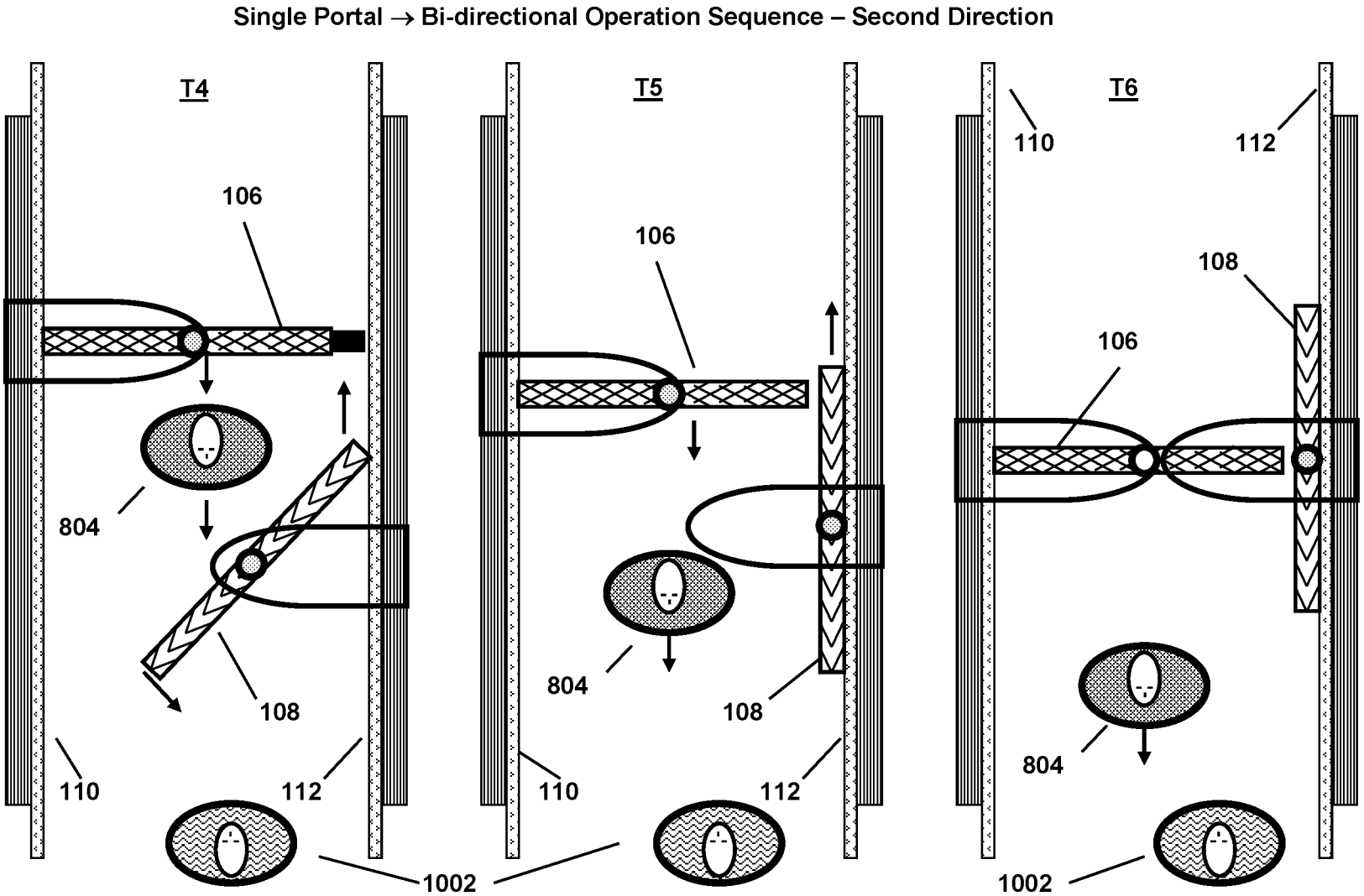
FIG. 11 is the fourth of four figures that demonstrate a bi-directional operation sequence for an embodiment of a single LRD Portal in accordance with the present invention.

As shown in time frame T1 of FIG. 10, subject 804 approaches the portal traveling in a direction which is the reverse of that previously traveled by subject 802. Here, the door panels are positioned in the neutral starting position with panel 108 perpendicular to the sidewalls and panel 106 adjacent sidewall 110. Subsequently, in timeframe T2, door panel 106 slides in a reverse direction relative to that of subject 804's direction of travel and begins to rotate around behind subject 804. Next in timeframe T3, door panel 106 has rotated to a position perpendicular to the door panels, and for a moment, both door panels are likewise perpendicular to the sidewalls forming a detection chamber. If the direction of travel of subject 802 was the direction where security is maintained, then typically, the reverse direction traveled by subject 804 would be a direction where security is not necessary, and as such, no threat detection test would be performed while the detection chamber of timeframe T3 is temporarily formed. Next in timeframe T4 of FIG. 11, door panel 108 begins to swing open, allowing subject 804 to begin to exit the portal. Subsequently, in timeframe T5, door panel 108 has become positioned adjacent to sidewall 112 and is sliding in a reverse direction relative to the direction of travel of subject 804. Last, in timeframe T6, door panels 106 and 108 have again assumed a neutral position where this time door panel 106 is perpendicular to the sidewalls, and door panel 108 is parallel to sidewall 112 and is positioned between door panel 106 and sidewall 112. Therefore, a demonstration of bi-directional travel through a single portal according to the invention has been described with respect to FIGS. 8 through 11.

Embodiments described with respect to FIGS. 2A and 2B and FIGS. 4A through 11 showed door panels suspended from and driven by mechanisms attached to moving arms such as 212 and 214. When moving arms are utilized as such, they do not fully seal the top of the portal, and therefore some form of top cover must be added. Mechanisms or components must then also be added to seal gaps above the door panels to prevent weapon passing when two or more attackers work in unison.

In an alternative embodiment, as shown in FIGS. 12A through 16, each moving arm of previous figures is replaced with a sliding roof panel from which a door panel is suspended and driven. The rotational drive mechanism for a door panel is moveable laterally with respect to the sliding roof panel, for example, with the drive mechanism recessed into a groove on the underside of the roof panel and being moveable laterally within the groove. The two sliding roof panels abut each other and together form a surface that seals the top of the portal to prevent weapons from being passed over a door panel.

Figures 12A, 12B:
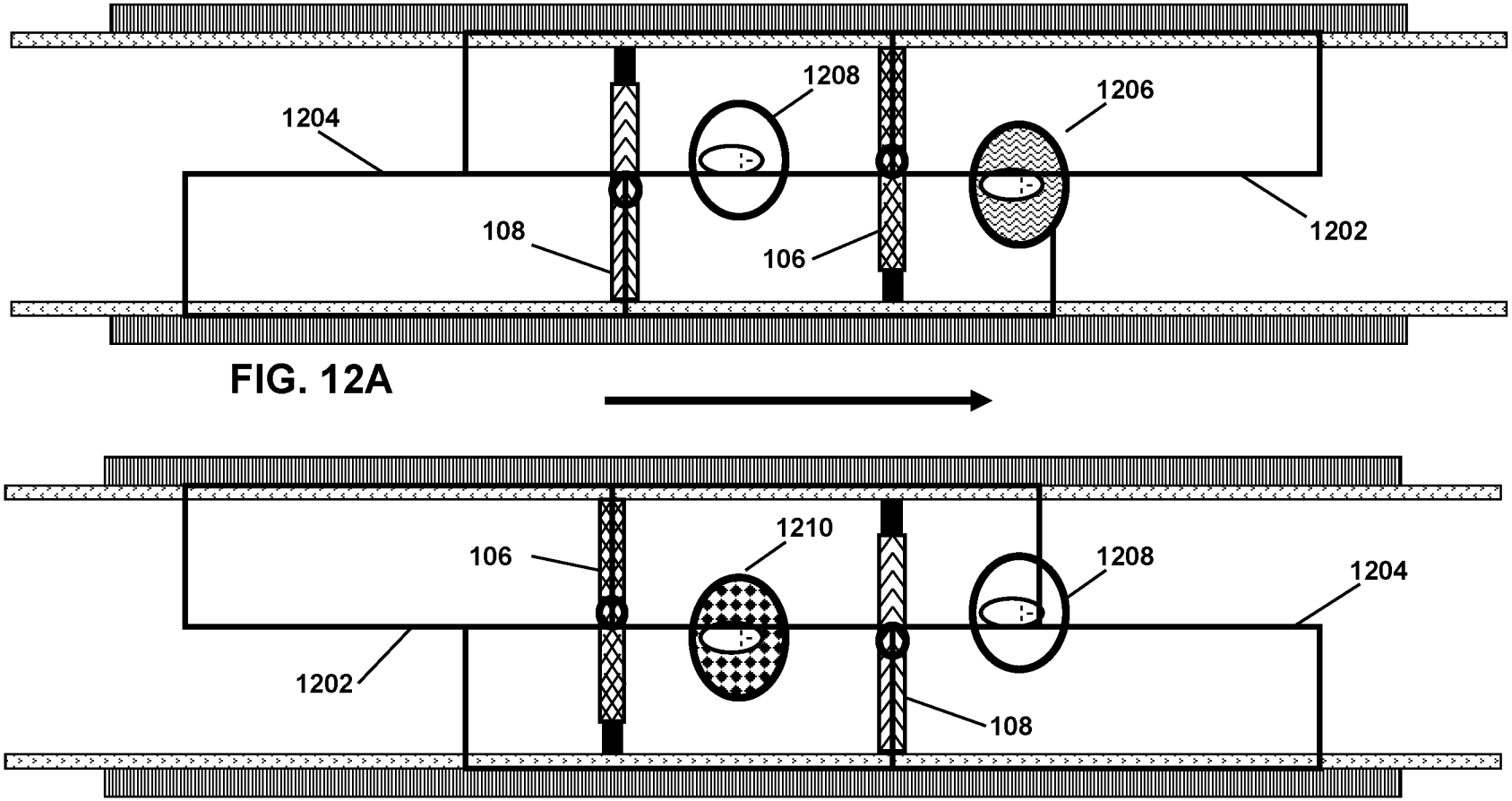
FIGS. 12A and 12B are top views of an embodiment of an LRD Portal in accordance with the present invention wherein sliding roof panels have replaced the moving arms of previous embodiments.

FIGS. 12A and 12B are top views of a portal according to the invention, including sliding roof panels which support and drive door panels 106 and 108. Each of FIGS. 12A and 12B is shown with the sliding panels at an extreme position of movement. In FIG. 12A subject 1206 is just exiting the portal, and subject 1208 is in the detection chamber between door panels 106 and 108. Here, sliding roof panel 1202 is at an extreme position in the forward direction, while sliding roof panel 1204 is in an extreme position towards a rearward direction. FIG. 12B shows just the opposite. Here subject 1208 is now exiting the portal, and subject 1210 is in the detection chamber between door panels 106 and 108. In FIG. 12B, sliding roof panel 1202 is now at an extreme position towards the entrance side of the portal, while sliding roof panel 1204 is at an extreme position on the exit side of the portal. Note that even at the extreme positions, the sliding roof panels form a cover over one or more door panels and therefore sealing the portal against an attacker who might attempt to toss a weapon over the top of a door panel.

Figure 13B:
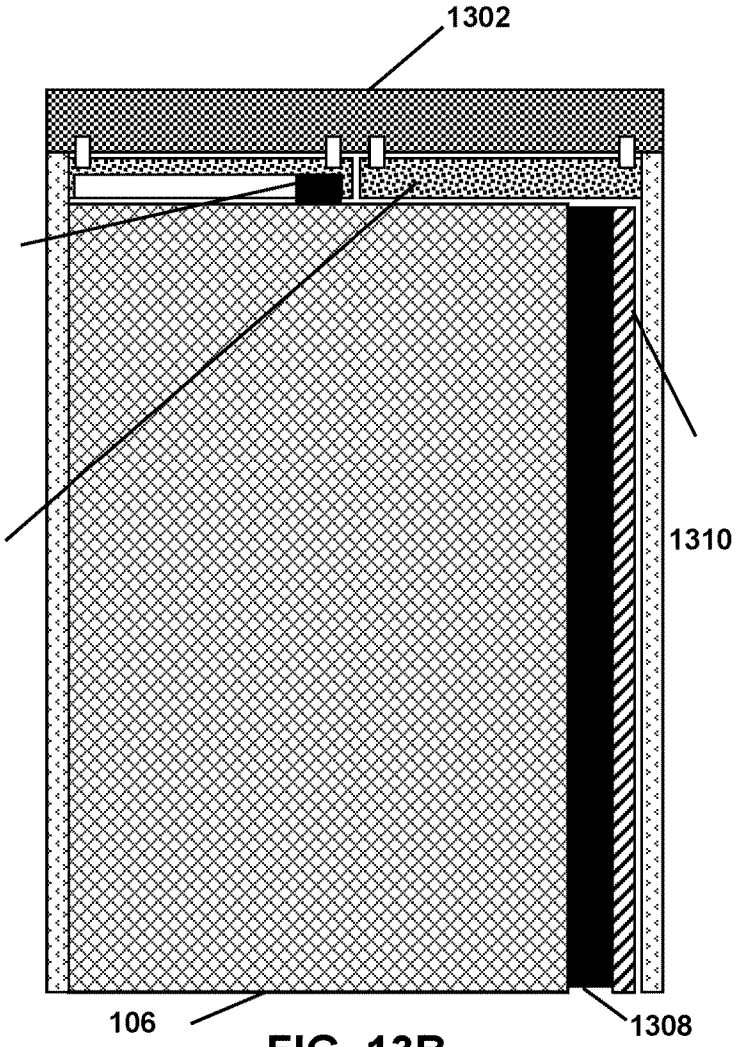
FIGS. 13A and 13B are cross-section views of an embodiment of an LRD Portal in accordance with the present invention wherein sliding roof panels have replaced the moving arms of previous embodiments.
Figure 13A:
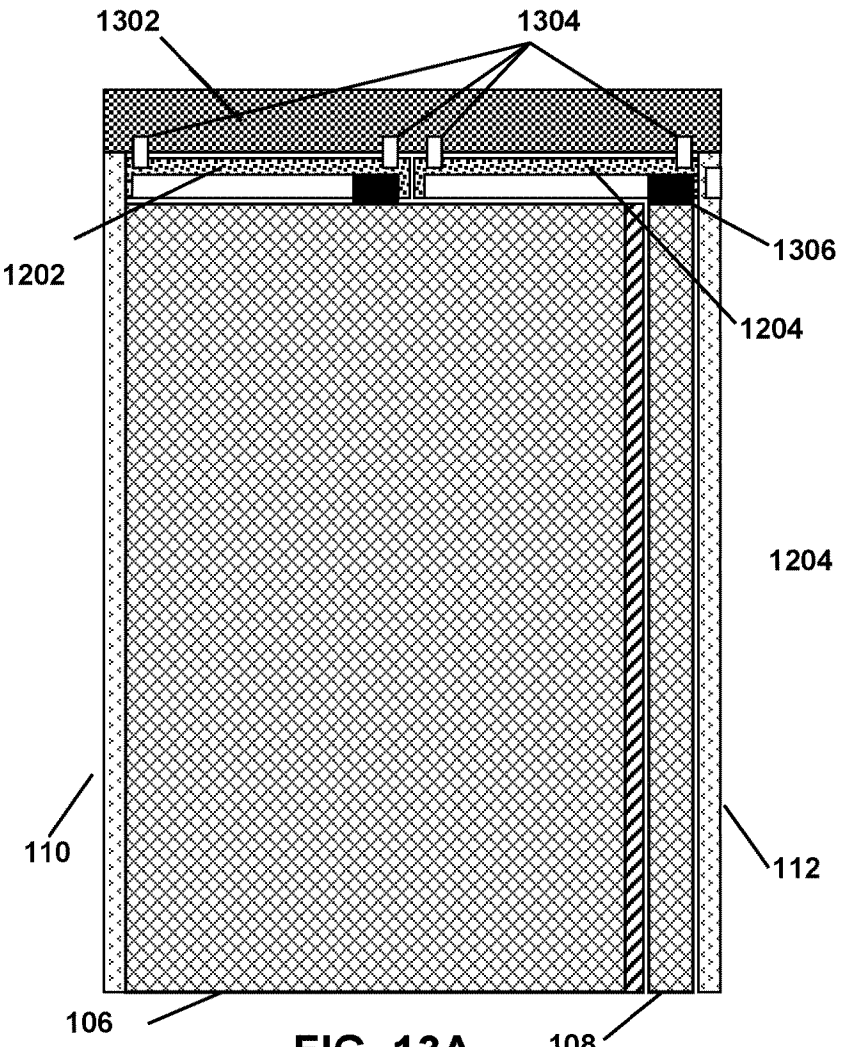

FIGS. 13A and 13B are cross-section views of a portal with FIG. 13A showing a cross-section at one point in the operational sequence while FIG. 13B shows a cross-section at another point. In FIG. 13A, door panel 106 is perpendicular to the sidewalls, and door panel 108 is parallel to the sidewalls and positioned between door panel 106 and the opposite sidewall. In FIG. 13B, door panel 106 is still perpendicular to the sidewalls however, door panel 108 is not shown since it is not positioned to be visible at the particular cross-section. In FIG. 13B, telescoping extension 1308 and seal 1310 are visible since door panel 108 is not included in the cross-section and therefore, the space between door panel 106 and the opposite sidewall must be temporarily filled. Note that each moving door panel in FIGS. 13A and 13B contains two extensions, such as 1308 since for each successive movement cycle of a door panel, a different side of the panel is typically oriented facing the gap between the panel and the opposite sidewall. The same is true for all embodiments described herein where any telescoping extension is shown for a moving door panel. Note also in both FIGS. 13A and 13B that sliding roof panels 1202 and 1204 support and drive door panels 106 and 108 respectively through drive mechanisms 1306, which in addition to rotating a door panel, are each movable laterally along the groove recessed into the respective sliding roof panel. Note that each sliding roof panel is suspended by suspension bearings 1304 from top cover 1302 which supports the sliding roof panels. Drive mechanisms are also included (not shown) that drive each sliding roof panel individually in a longitudinal direction parallel to the sidewalls.

Figure 14A:
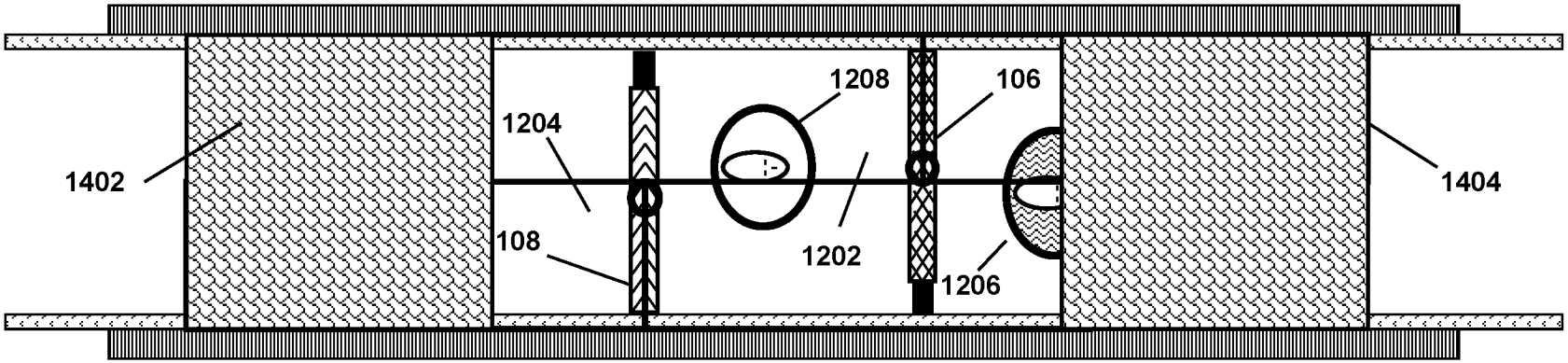
FIGS. 14A and 14B are top views of an LRD Portal where sliding roof panels have replaced the moving arms of previous figures, and receptacles are added to fill areas that may become open above when sliding panels are at extreme positions. For FIG. 14*a* the receptacles are shown and in FIG. 14*b* the receptacles are transparent.
Figure 14B:
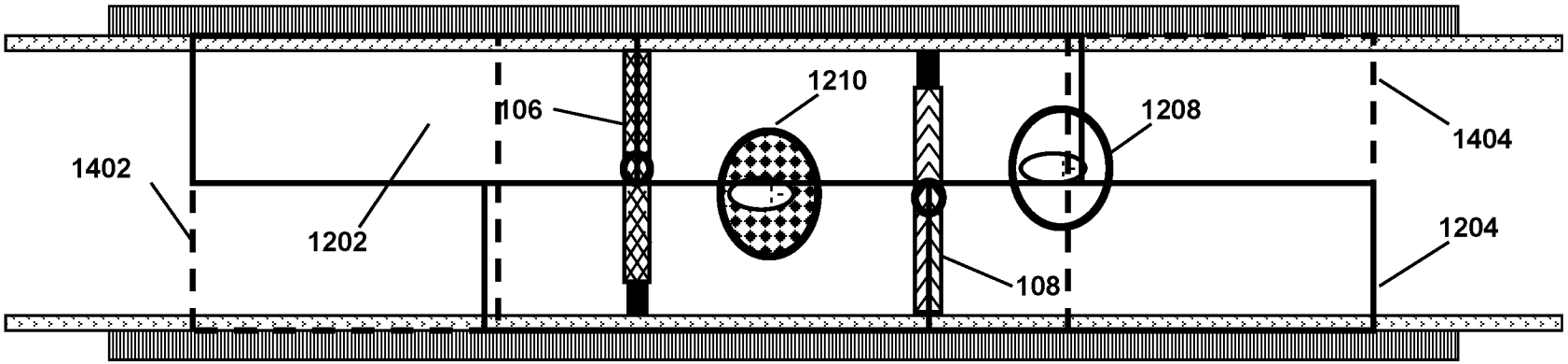

In most scenarios the sliding roof panels are sufficient to cover the tops door panels at all positions in their travel, however should it arise for a particular implementation that space is opened up above a door panel at some extreme movement of a sliding roof panel, that space may be filled by a receptacle which is added to the assembly according to FIGS. 14A and 14B and serves to fill the open space above a door panel when necessary. FIGS. 14A and 14B correspond to FIGS. 12A and 12B with regard to subjects passing through and to positions of sliding roof panels, except that receptacles 1402 and 1404 have been added. In FIG. 14A, receptacles are fully shown, and in FIG. 14B receptacles are shown with a dotted outline such that the position of the sliding roof panels can also be seen.

Figure 15:
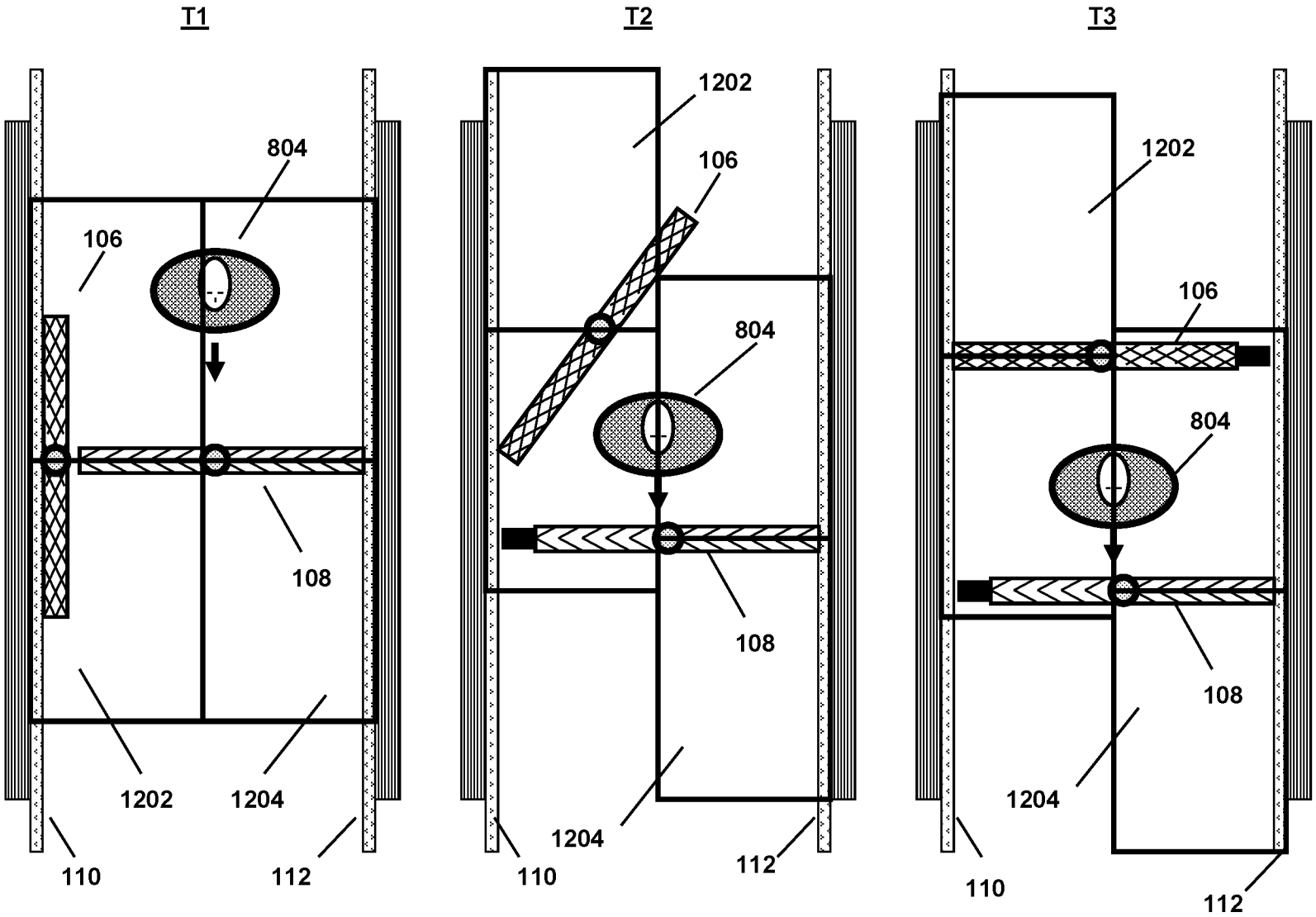
FIG. 15 is the first of two figures showing top views that demonstrate a sequence of operation for an embodiment of an LRD Portal in accordance with the present invention wherein moving door panels are suspended from and driven by mechanisms attached to sliding roof panels.
Figure 16:
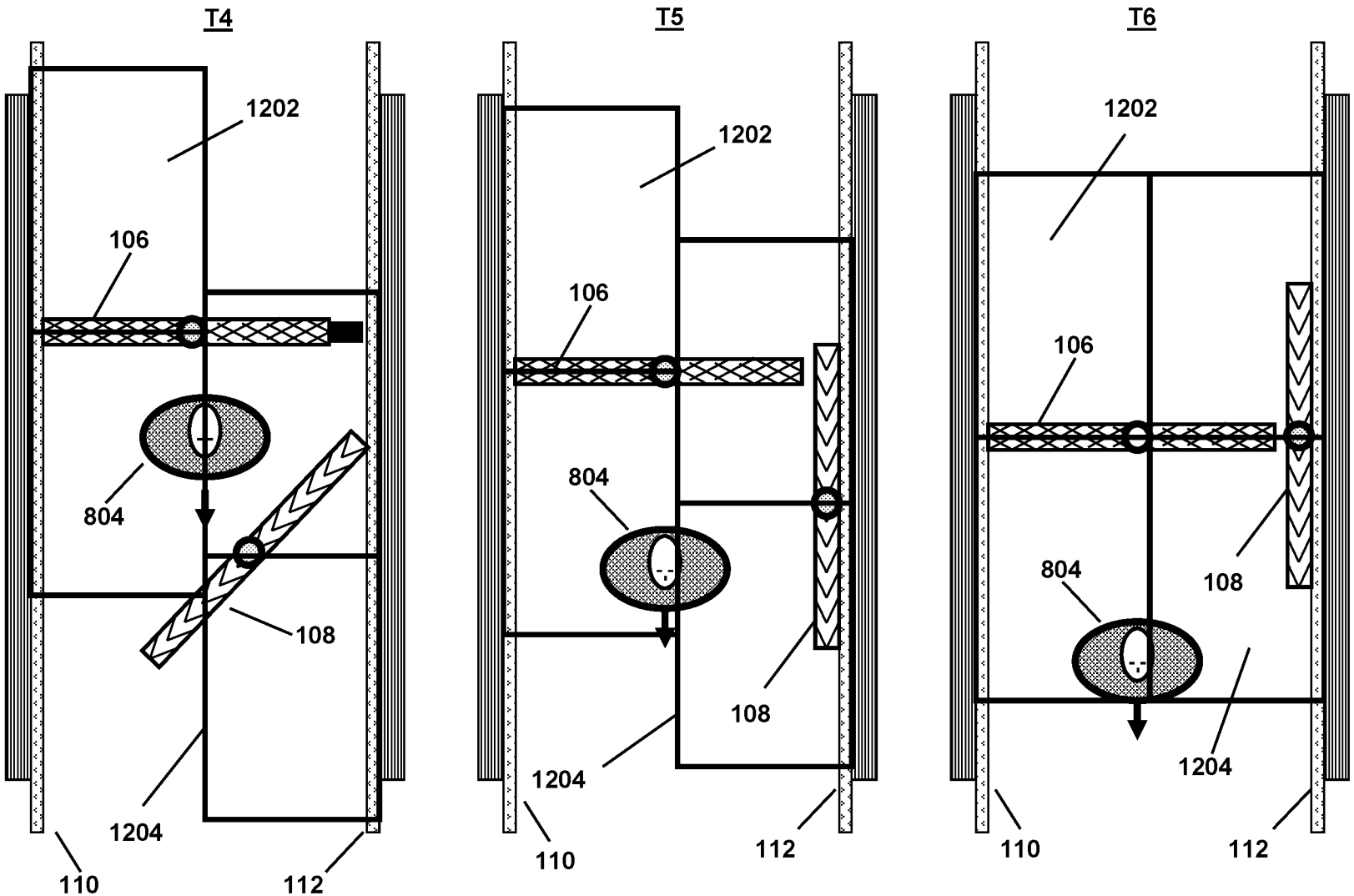
FIG. 16 is the second of two figures showing top views that demonstrate a sequence of operation for an embodiment of an LRD Portal in accordance with the present invention wherein moving door panels are suspended from and driven by mechanisms attached to sliding roof panels.

FIGS. 15 and 16 are top views of a portal with sliding roof panels during a sequence where one subject 804 passes through. This sequence demonstrates that an implementation of sliding roof panels will successfully provide a top cover for at least one perpendicular door panel at all times, and as such, prevent weapon passing when two or more attackers work in unison. The sequence starts with a neutral position at timeframe T1, similar to the starting point at T1 in FIG. 10. An extreme rearward position for sliding roof panel 1202 is reached in timeframe T2, while an extreme-forward position is reached for sliding roof panel 1204 in timeframe T4 of FIG. 16. During a subsequent cycle, the extreme positions of each sliding roof panel would essentially mirror those shown in FIGS. 15 and 16, thus demonstrating that at all times, the sliding roof panels effectively provide a top cover to prevent weapon passing.

Figure 17A:
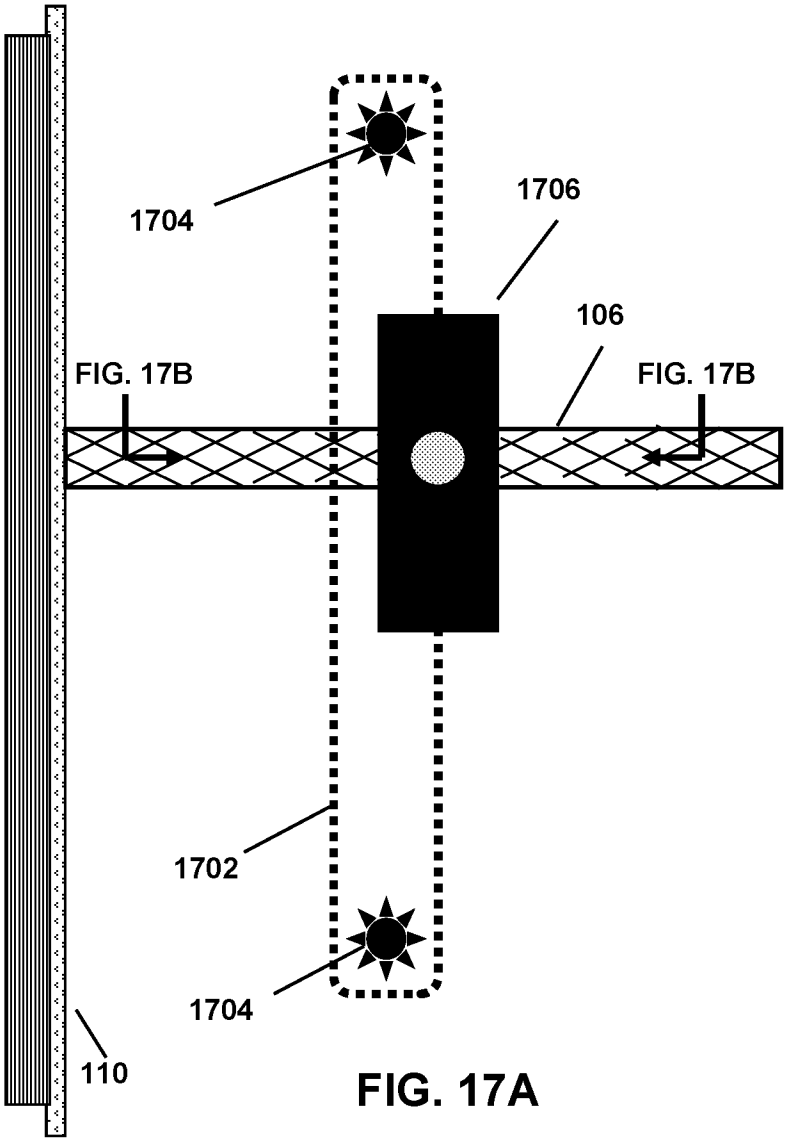
FIGS. 17A and 17B illustrate an embodiment of an anchor assembly in accordance with the present invention that descends from a door panel to engage a drive socket below in order to resist movement when a side impact or force is applied to the door panel.
Figure 17B:
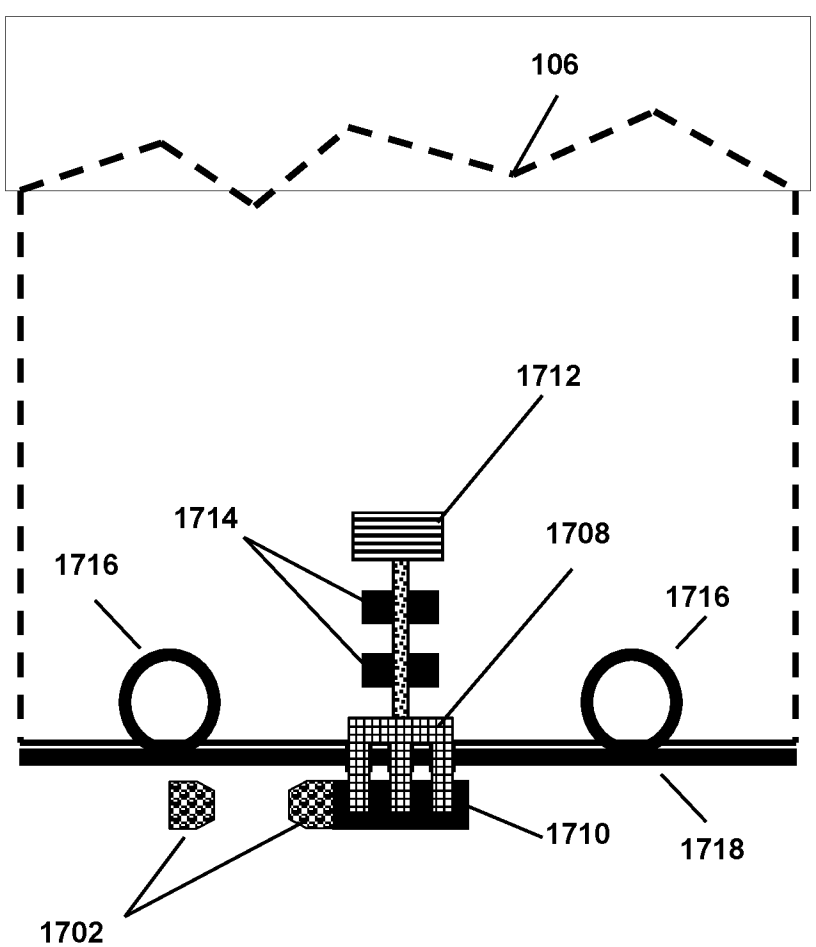

To ensure structural rigidity of a sliding door panel, including an ability to withstand side impacts applied by an attacker, especially when it is positioned fully perpendicular to the sidewalls, the mechanism of FIGS. 17A and 17B may be added. According to FIG. 17A, a belt drive or chain drive mechanism 1702 or other equivalent mechanisms for linearly driving is included under the floor panel 1718 of the portal per FIG. 17B. If a toothed belt or chain drive is utilized for 1702, then some form of sprocket 1704 may also be used to drive the belt or chain. One or more of the sprockets 1704 shown may apply drive, and the remainder may be idler sprockets. In the top view of FIG. 17A, a slotted grating 1706 has been placed into the floor panel of the portal such that forked anchor assembly 1708 of FIG. 17B may, at certain points in time, descend vertically through floor panel 1718 and engage with drive socket 1710, which is attached to a toothed belt or chain 1702. Immediately upon door panel 106 becoming perpendicular to sidewall 110, fork 1708 would descend through floor panel 1718 and engage with drive socket/receptacle 1710. Subsequently, as door panel 106 moves longitudinally in the direction parallel to sidewall 110, drive socket 1710 moves at the same rate as door panel 106 being driven by 1702 until the point where door panel 106 starts to swing open. At that point in time, drive fork 1708 ascends within door panel 106 above floor panel 1718 thus disengaging with drive socket 1710. Vertical motion of fork 1708 may be provided by a number of mechanisms, including for example, some form of a solenoid drive or motor-driven rack and pinion drive embodied in mechanism 1712 contained within door panel 106. A shaft connecting 1712 with drive fork 1708 may include bearings 1714. To support some of the weight of the door panel 106, coasters 1716 are shown as one example.

Figure 18:
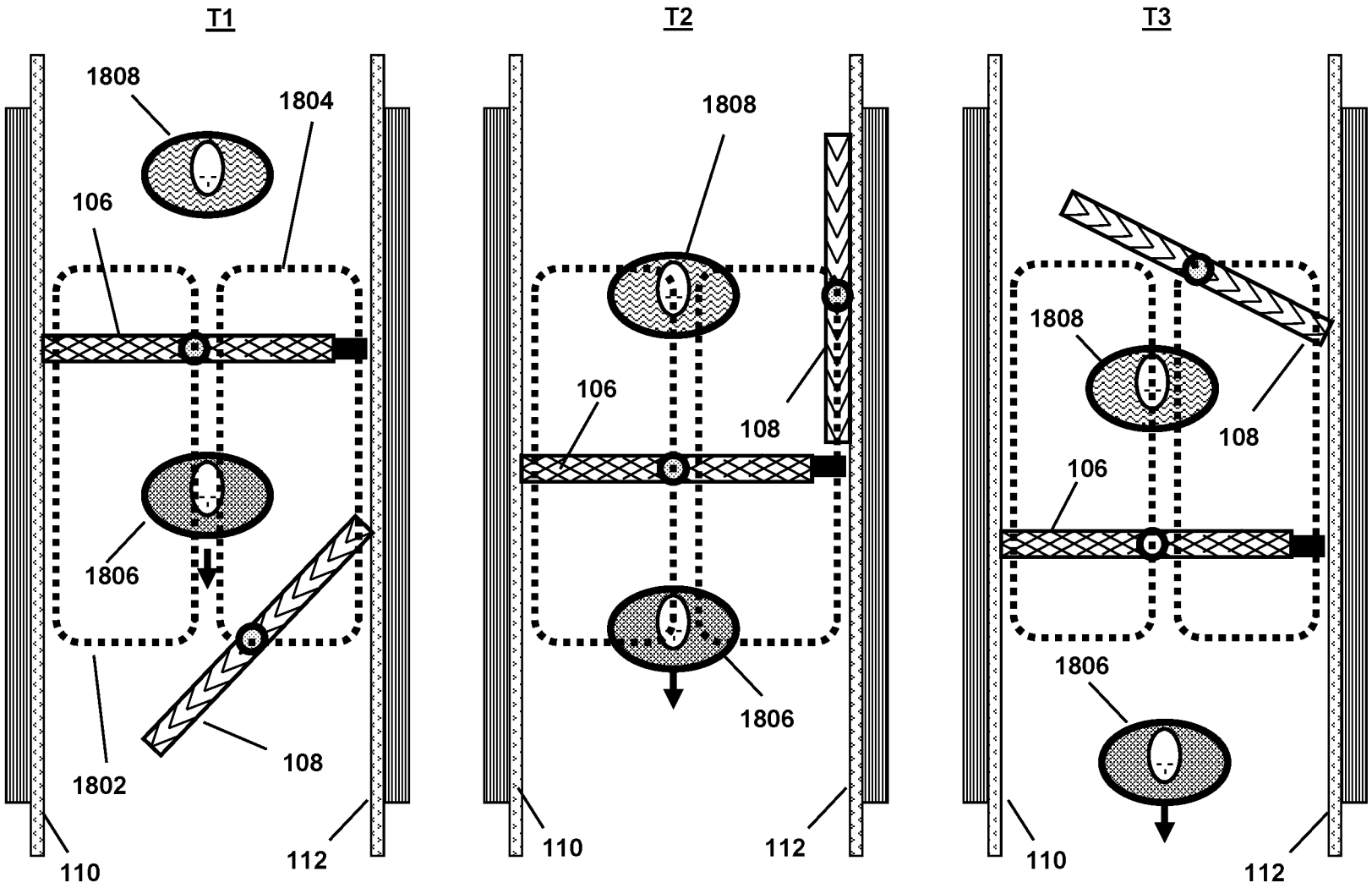
FIG. 18 is a top view showing different moments in time where embodiments of door panels in accordance with the present invention are driven at least in part from the bottom by a drive socket following a substantially rectangular path.

It may be advantageous to provide drive for moving door panels 106 and 108 from the bottom of those panels during their entire cycle of movement as the portal operates, as shown in FIG. 18. This would supplement any drive which might be provided from the tops of the portal and would also serve to help anchor the moving door panels from the bottom in order to provide resistance to any side-impact which might be applied by a subject attempting to force their way through the portal. Three points in time during a sequence of operations are shown in FIG. 18. In time period T1, two drive paths are shown. Drive path 1802 provides drive for door panel 106, and drive path 1804 provides drive for door panel 108, in both cases driving the panels from the bottom in both lateral and longitudinal directions. Rotational movement of each door panel may be provided by separate mechanisms where examples are shown earlier in this specification. Note that rotational movement of a door panel can be imparted to the door panel from either the top or the bottom or both, and that a rotational drive mechanism including a motor can be positioned below a door panel, above a door panel, or alternately be contained within a door panel. In time period T1 of FIG. 18, subject 1806 is between the door panels and just beginning to exit while subject 1808 is just approaching. Time period T2 shows the next progression in a cycle of the door panels within the portal, and time period T3 shows yet another point in the progression where subject 1808 is now almost enclosed in a detection chamber between moving door panels 106 and 108. Notice that in all of time periods T1 through T3, the center of each door panel is positioned over one of drive paths 1802 and 1804.

Figure 19B:
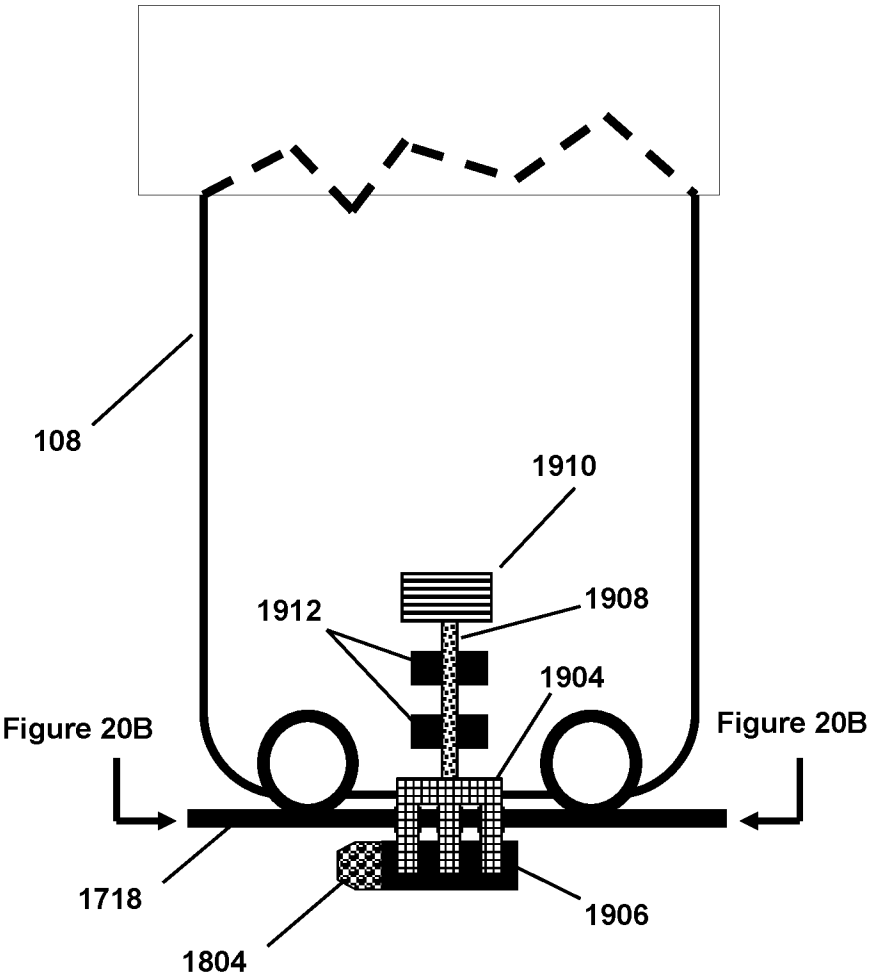
FIGS. 19A and 19B show additional detail for the embodiment of FIG. 18.
Figure 19A:
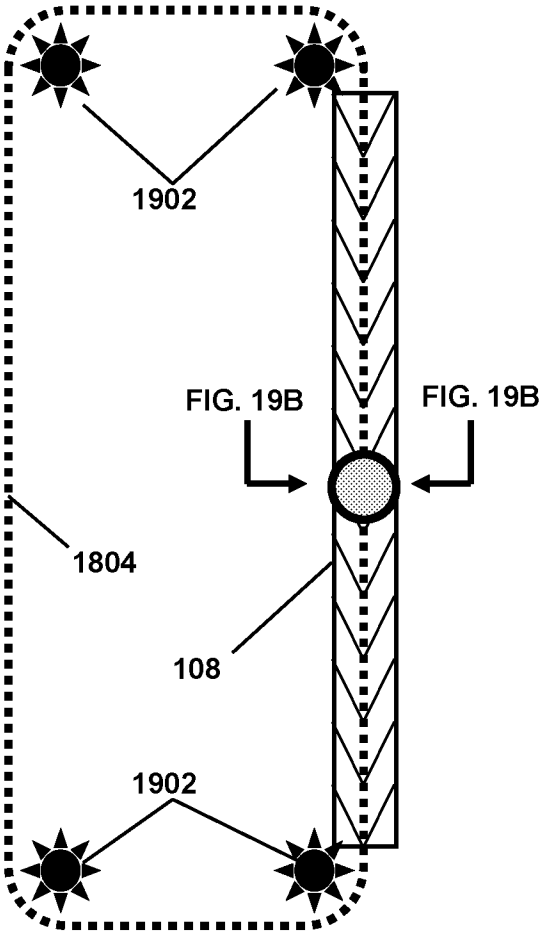

Drive path 1804 and door panel 108 are shown in FIG. 19A where sprockets 1902 are shown defining drive path 1804, which may be implemented with either a toothed belt, chain, or some other equivalent mechanism which defines the path. Cross-section of FIG. 19A is shown in FIG. 19B where a toothed belt implementing path 1804 is shown attached to a drive socket 1906, where both are located below floor panel 1718. Drive fork 1904 passes through slots in floor panel 1718 to engage with drive socket 1906. A shaft 1908 connects drive fork 1904 with an exemplary vertical drive mechanism 1910 through exemplary bearings 1912. In the embodiment of FIGS. 19A and 19B, drive fork 1904 would always be engaged with drive socket 1906 during normal operation and would only be raised when door panel 108 is accessed for service.

Figure 20B:
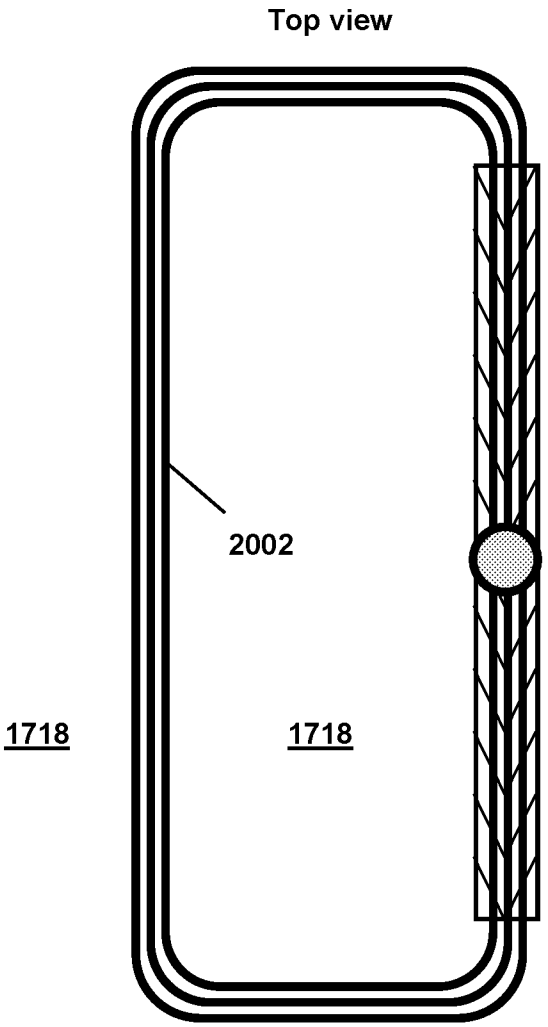
Figure 20A:
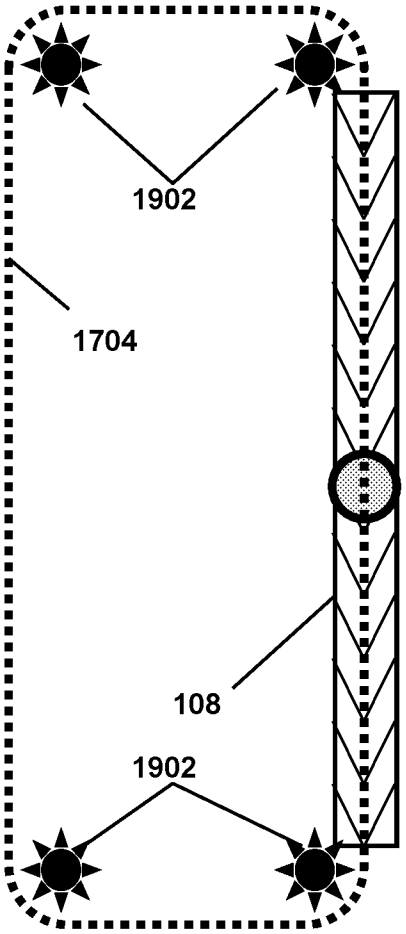
FIG. 20A is a top view of a door panel and an arrangement of sprockets and belt drive located below a floor panel for use with embodiments of the present invention.

A top view of the cross-section defined in FIG. 19A is shown in FIG. 20B. FIG. 20A repeats the contents of FIG. 19A for reference. FIG. 20B shows three slots 2002 in floor panel 1718 through which tined drive fork 1904 may pass in order to engage with drive socket 1906 located below floor panel 1718. Having a plurality of slots as opposed to one slot is advantageous since it allows each slot to be smaller. Smaller slots are advantageous since pedestrians walk on the slots.

Figure 21:
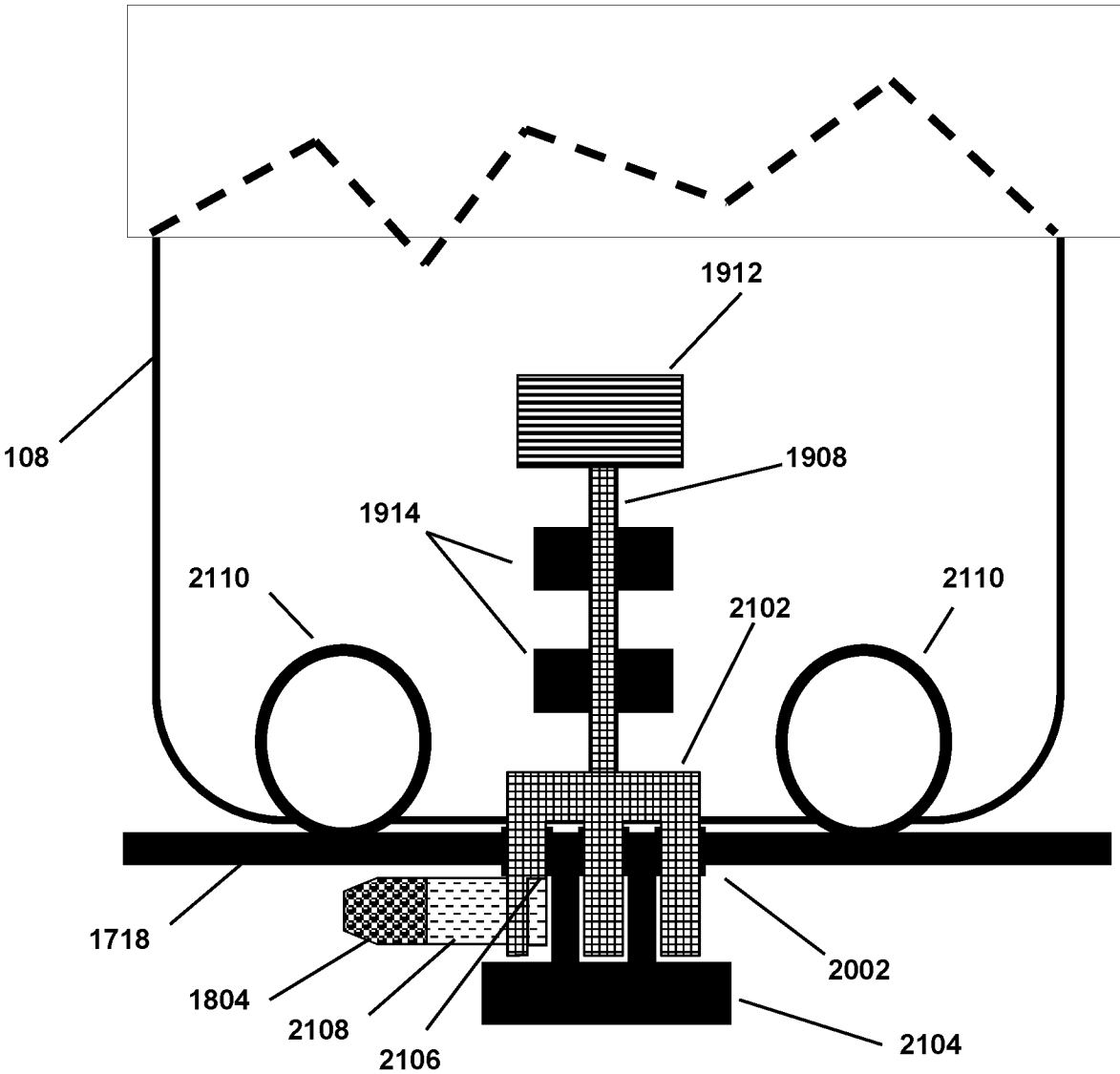
FIG. 21 is an enlarged view of the cross-section diagram of FIG. 19B, including a first alternate embodiment for the interface between the drive fork and drive socket.

A more detailed view at the cross-section defined in FIG. 19A is shown in FIG. 21. Per FIG. 21, drive fork 2102 passes through slots 2002 in floor panel 1718 to engage with drive socket 2108. Notice that drive fork 2102 has been notched or narrowed 2106 to allow drive fork 2106 to surround at least a portion of drive fork 2102 while still providing clearance with structure 2104 mounted below. Structure 2104 has forked structures protruding upwards that effectively define a portion of slots 2002. Notice that coasters 2110 have also been added within door panel 108.

Figure 22:
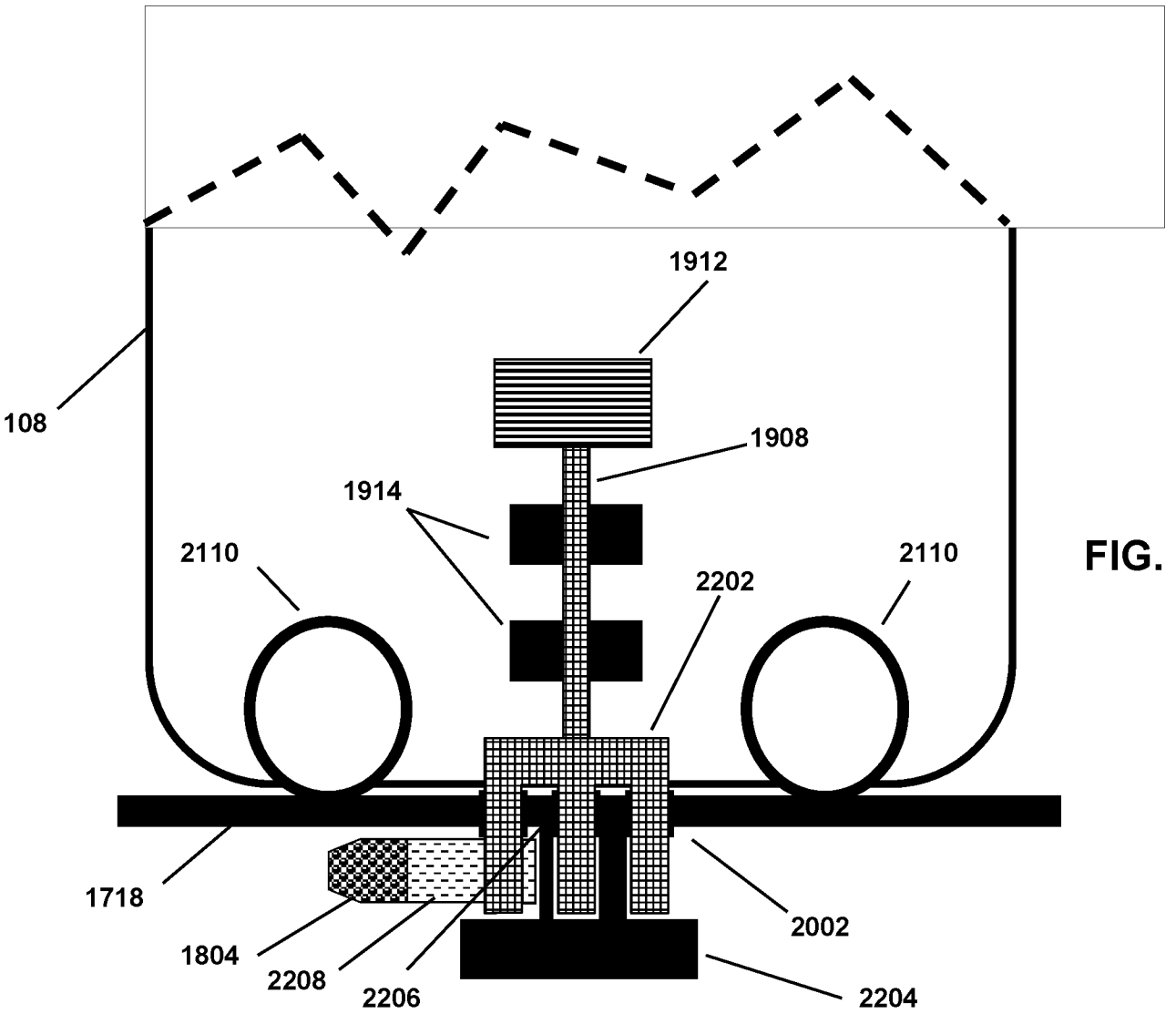
FIG. 22 is an enlarged view of the cross-section diagram of FIG. 19B, including a second alternate embodiment for the interface between the drive fork and drive socket.

An alternative embodiment to the mechanism shown in FIG. 21 is shown in FIG. 22. Here, drive fork 2202 passes through slots 2002 in floor panel 1718 and engages with drive socket 2208. Slots in floor panel 1718 are defined in part by structure 2204 mounted below. Note in particular that one fork of structure 2204 has been partially narrowed 2206 to provide clearance for drive socket 2208 such that drive fork 2202 need not be notched as shown in FIG. 21. Alternately some narrowing of structure 2204 might be utilized in combination with some degree of notching drive fork 2202, essentially combining the embodiments of FIGS. 21 and 22.

While earlier embodiments in this specification show moving door panels driven in lateral and longitudinal directions from the top by moving arms or sliding roof panels note that a drive path mechanism similar to that shown in the embodiments of FIGS. 18-22 could also be utilized for driving a door panel in lateral and longitudinal directions from above. Such mechanisms mounted above the door panels could also be used in conjunction with drive mechanisms driving the door panels from below, or alternately could be used above as the sole drive mechanisms for lateral and longitudinal movement of the door panels.

Figure 23:
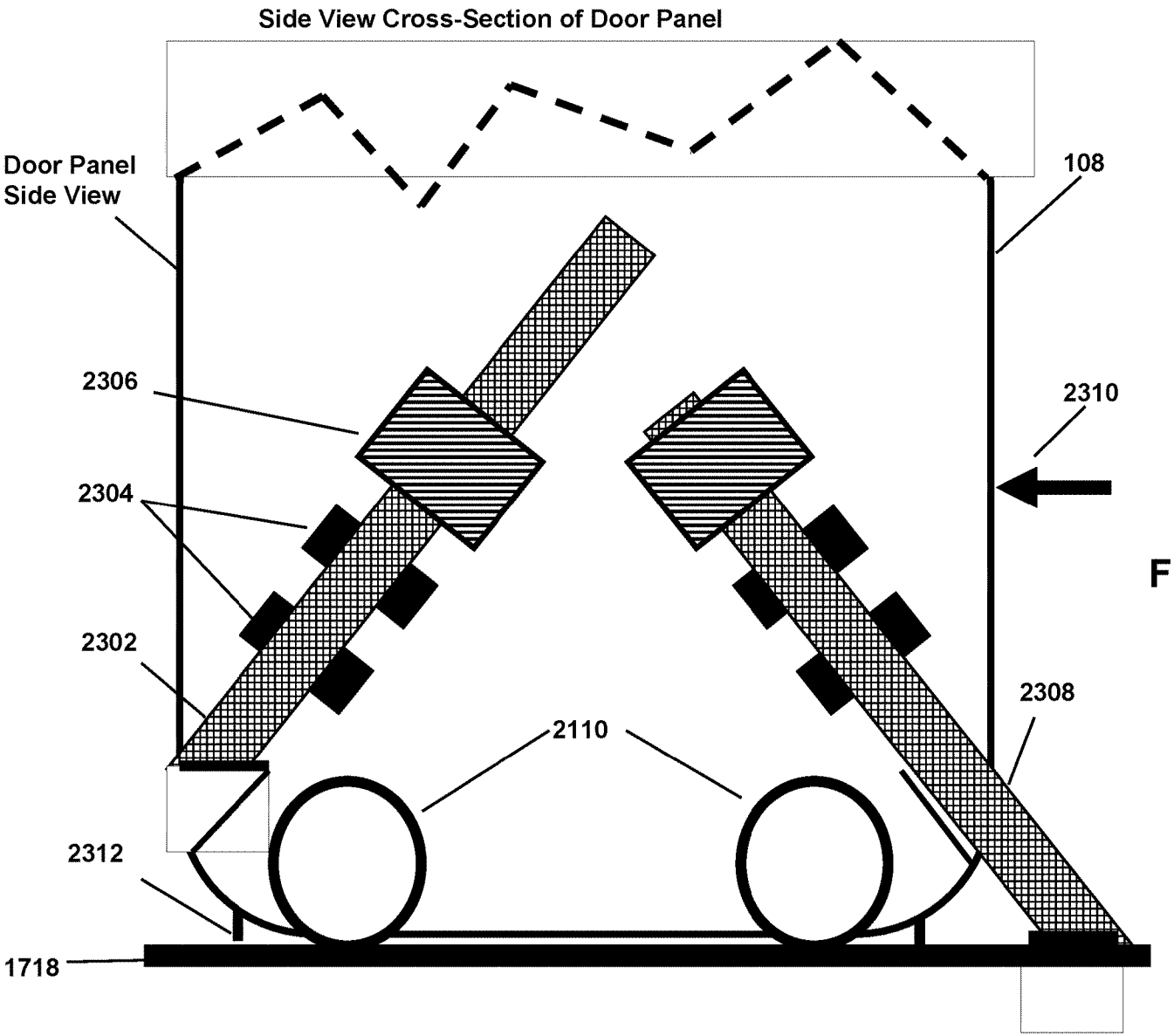
FIG. 23 is an exemplary cross-section of a door panel for use with embodiments of the present invention where brake assemblies have been included and wherein one deployed brake assembly is shown having descended in response to a side impact or pressure on a door panel.

An alternate embodiment for preventing undesired movement of a door panel resulting from an impact or side pressure on the door panel is shown in FIG. 23. Here, one or more anti-impact brake mechanisms 2302 may be included in the lower portion of a door panel. Brake mechanisms 2302 may be oriented vertically or at an angle as shown in FIG. 23, and may be supported by bearings 2304 and include some form of drive mechanism 2306, which could, for example, be a solenoid or motor drive. When a force 2310 is applied to the side of a door panel, such a force or impact is sensed by sensors incorporated either in the door panel or in structures connecting with the door panel, and subsequently, an anti-impact brake is deployed 2308 as shown in response to the impact or force. Note that when a gap of any consequential size exists between the lower surface of door panel 108 and floor 1718, skirts 2312 may be included to assist in sealing that gap. The use of optional coasters 2110 to assist in supporting the weight of door panel 108 may cause such a gap to exist, or a gap may exist when door panels are fully supported from above.

Figures 24A, 24B:
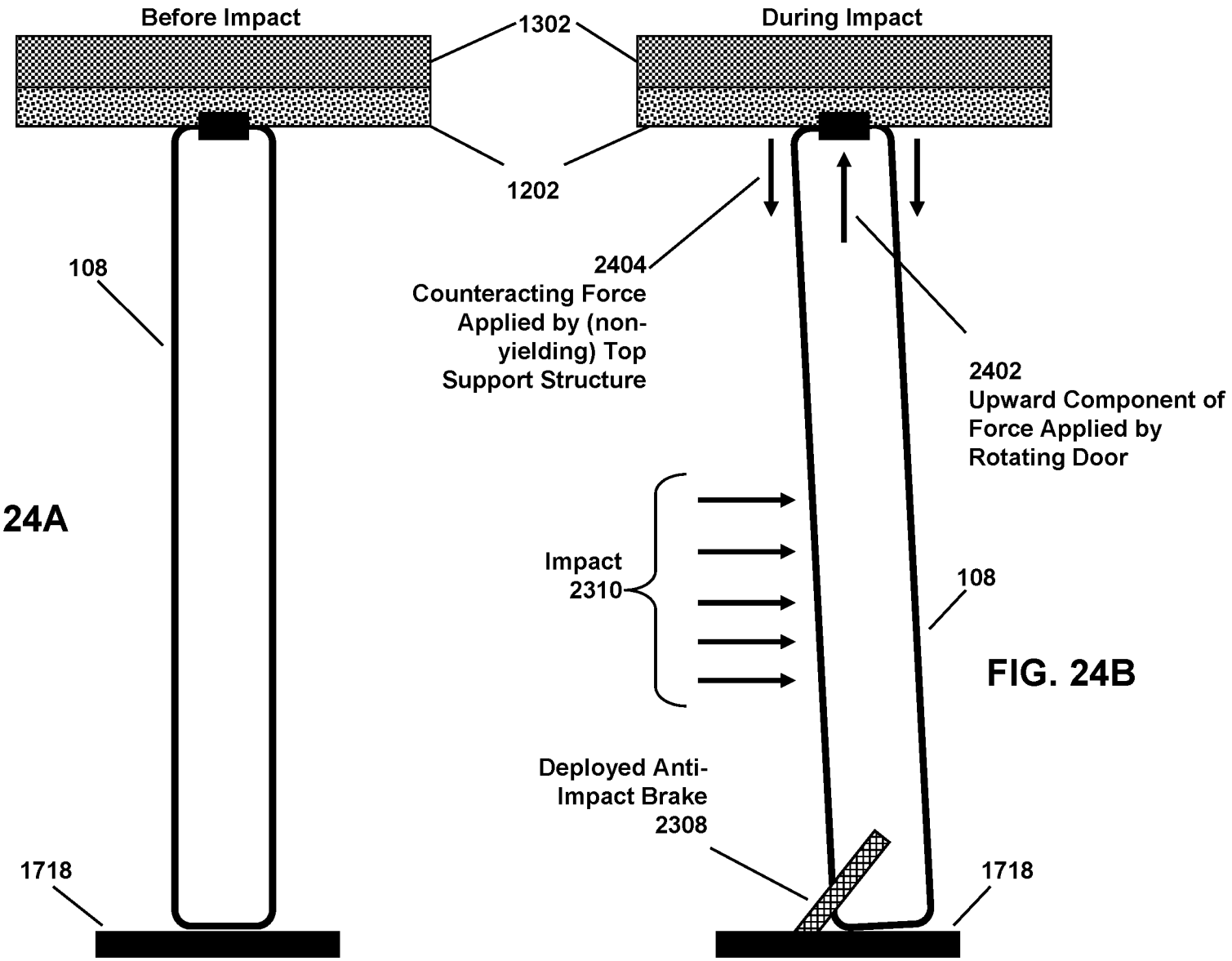
FIGS. 24A and 24B show the relative positioning of a door panel both before (FIG. 24A), and after (FIG. 24B) a side impact is applied to the door panel.

FIGS. 24A and 24B show the relative positioning of a door panel both before (FIG. 24A), and after (FIG. 24B) a side impact is applied to the door panel. Note that per FIG. 24B, as a door panel begins to rotate as a result of an impact, its effective height changes as the diagonal measurement of the door becomes a greater percentage of its height. As a result, upward force 2402 is applied by the door to sliding roof panel 1202, which in turn is supported by top cover 1302. A counteracting force 2404 is applied by these overhead structures in a downward vertical direction, and to the extent, the combination of structures 1202 and 1302 is rigid, acts to assist deployed impact brake 2308 in preventing further side movement of the door panel.

Figure 25:
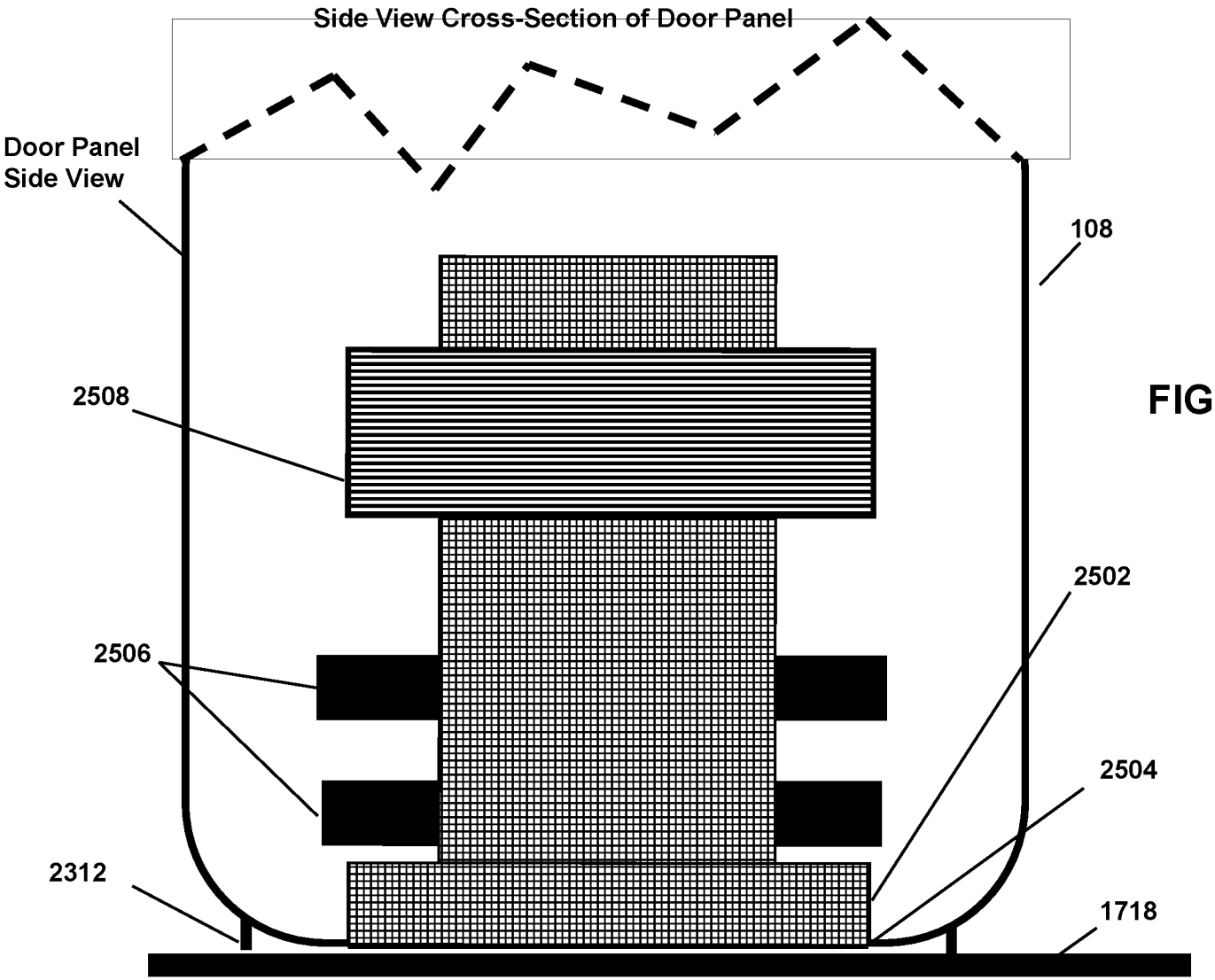
FIG. 25 is an enlarged cross-section of a door panel for use with embodiments of the present invention, including a vertically-oriented brake assembly for mitigating effects of a side impact by deploying in response to the impact and engaging with the floor.

FIG. 25 is an enlarged cross-section of a door panel including a brake assembly for mitigating effects of a side impact, whereby a brake deploys in response to the impact and engages with the floor. The brake is driven by drive assembly 2508 and is, for example, supported by bearings 2506. On the lower surface of anti-impact brake 2502 is a high grip surface 2504 suitable for engaging with material covering floor panel 1718. High grip surface 2504 may also be slightly radiused in order to provide a maximum gripping capability even when door panel 108 has been already rotated to some extent as a result of a side impact.

Figures 26A, 26B:
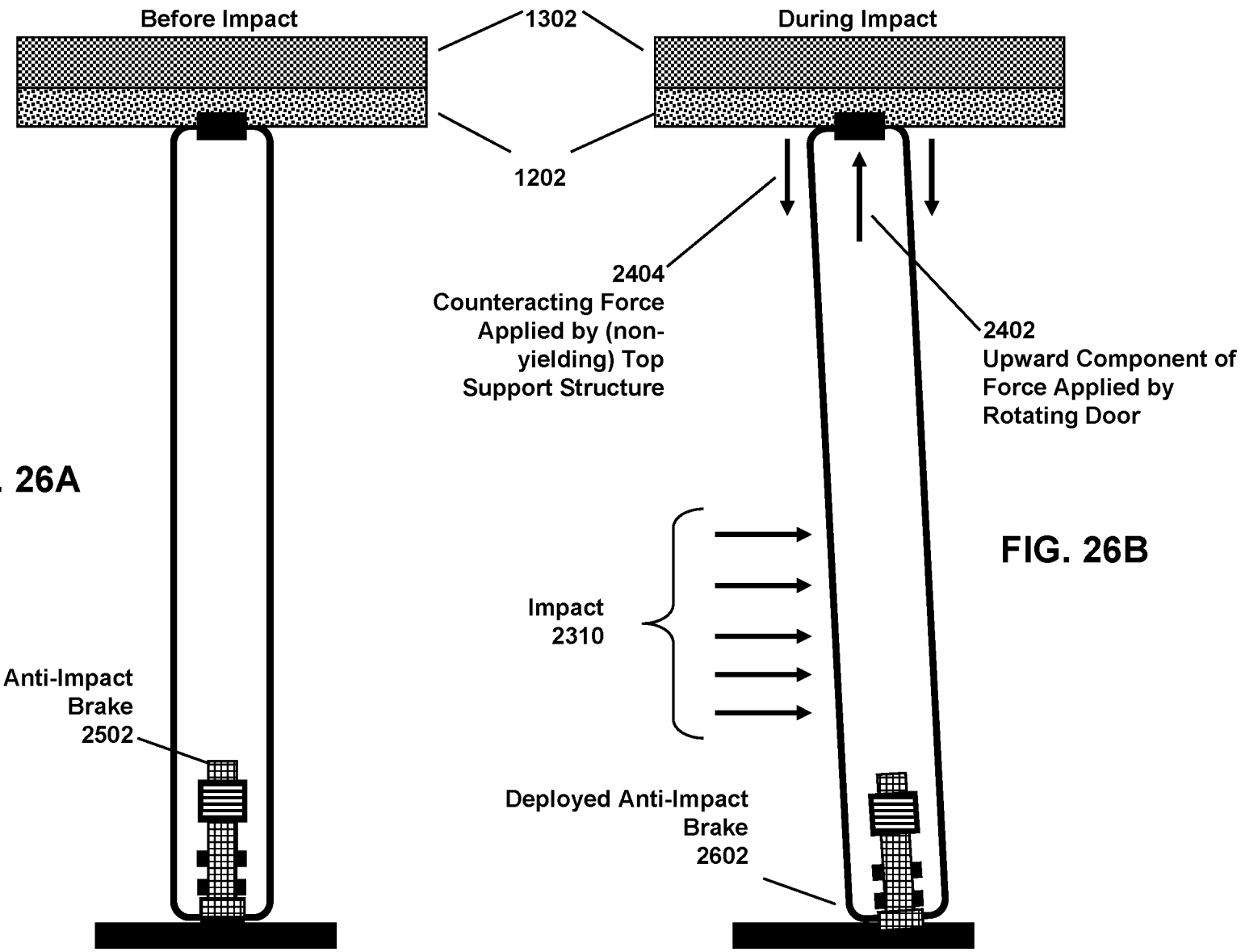
FIGS. 26A and 26B show the relative positioning of a door panel both before (FIG. 26A) and after (FIG. 26B) a side impact is applied to the door panel, and where a vertically-oriented anti-impact brake has been deployed as shown in FIG. 26B.

FIGS. 26A and 26B shows the relative positioning of a door panel both before (FIG. 26A), and after (FIG. 26B) a side impact is applied to the door panel, and where a vertically oriented anti-impact brake per FIG. 25 has been deployed 2602 as shown in FIG. 26B.

Figures 27A, 27B:
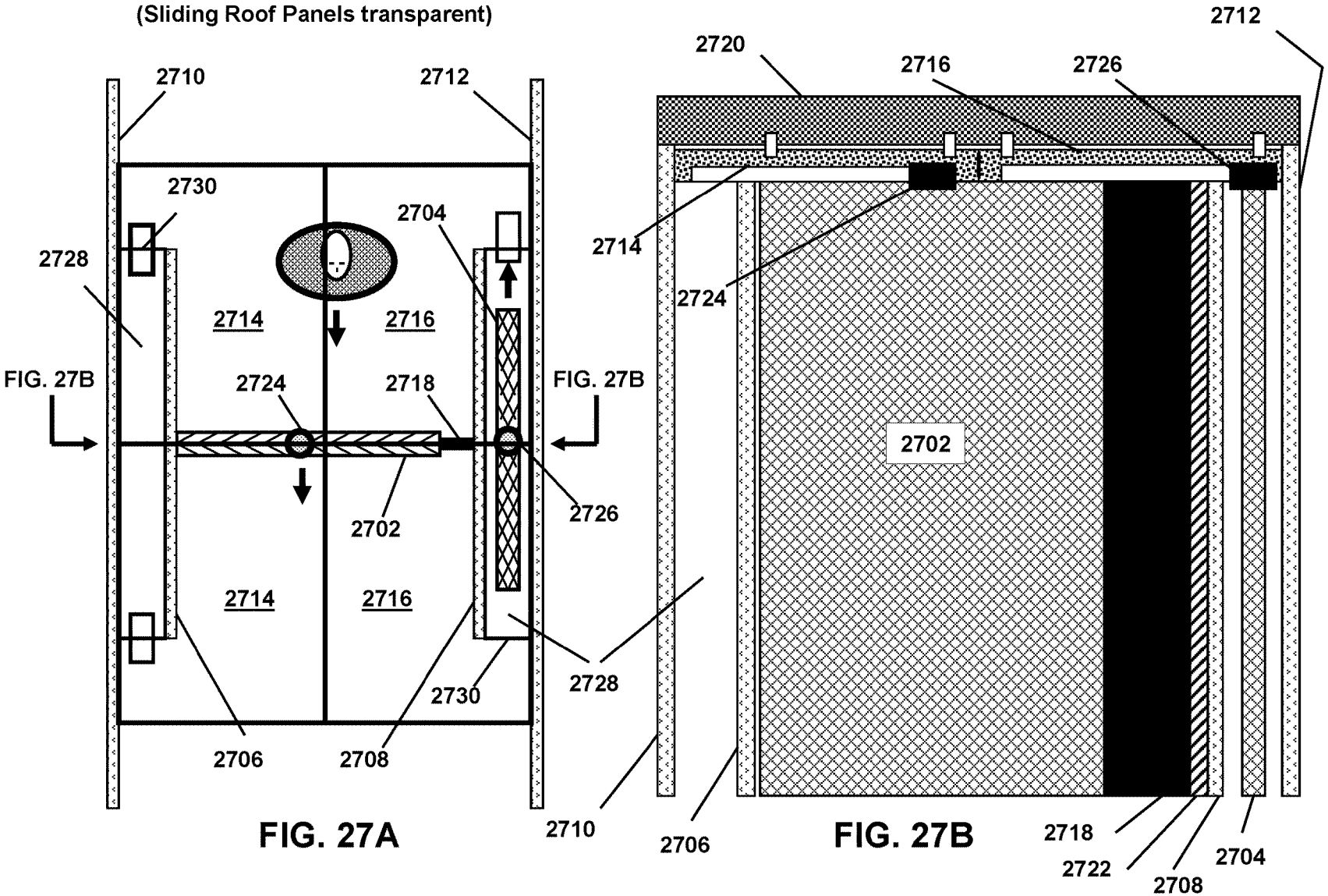
FIG. 27A is a top view of an entryway where sealed passageways have been added on either side of the sidewalls that define a pedestrian's path through the entryway. Each passageway allows a return path for a moving door panel as it rotates into a position parallel to a sidewall and moves in a direction opposite the current pedestrian direction of travel.
FIG. 27B is a cross-section side view of the embodiment of FIG. 27A, including a telescoping extension that fills a gap between a door panel and an opposite sidewall when the door panel is perpendicular to the sidewall.

FIG. 27A is a top view of an entryway where sealed passageways 2728 have been added on either side of the sidewalls that define a pedestrian's path through the entryway. These passageways allow a return path for a moving door panel as it rotates into a position parallel to a sidewall and moves in a direction opposite the current pedestrian direction of travel. By being sealed, these passageways prevent a clear space through the sealed passageways from occurring, thereby preventing weapon passing from one attacker to another. Door panels 2702 and 2704 move in a similar manner to moving door panels shown in previous figures, however when a door panel such as 2704 is parallel to entryway sidewall 2708 and is moving in a direction opposite that of a pedestrian currently within the entryway, door panel 2704 now passes through a sealed passageway 2728 formed by entryway sidewall 2708 and outer wall 2712. A similar passageway is formed on the opposite side of the entryway between sidewall 2706 and outer wall 2710. Note that rotational drive mechanisms 2724 and 2726 are shown positioned in alignment with the central axis of each respective door panel, and as such a gap is formed between the door panel and an opposite sidewall when the door panel is perpendicular to the sidewall. So for example, when door panel 2702 is perpendicular to the sidewalls as shown in FIG. 27A, a gap-filling mechanism such as telescoping extension 2718 is required to fill the gap between door panel 2702 and sidewall 2708. The exemplary embodiment shown in FIGS. 27A and 27B utilizes sliding roof panels 2714 and 2716 to drive and support moving door panels 2702 and 2704 respectively; however, other mechanisms described herein may instead be used to drive the moving door panels. Note that sliding roof panels 2714 and 2716 extend laterally beyond sidewalls 2706 and 2708 to reach outer walls 2710 and 2712, thus enabling lateral drive mechanisms for door panels 2702 and 2704 to position a door panel within a sealable passageway 2728 for the return path of a door panel such as that shown for door panel 2704 in FIG. 27A. Note that each end of a passageway 2728 is sealable by a door mechanism 2730 that opens to allow entry or exit of a moving door panel and is otherwise sealed. Door mechanism 2730 may comprise single or multiple structures and may be hinged at one side, hinged at both sides, or alternately comprise some form of sliding structure, or other door structure is known in the art.

FIG. 27B shows a top view cross-section of the embodiment of FIG. 27A, including telescoping extension 2718 and a seal 2722 that comprises the outer edge of telescoping extension 2718. Note in the cross-section shown in FIG. 27B that top cover 2720 extends beyond sidewalls 2706 and 2708 to outer walls 2710 and 2712.

Figure 28B:
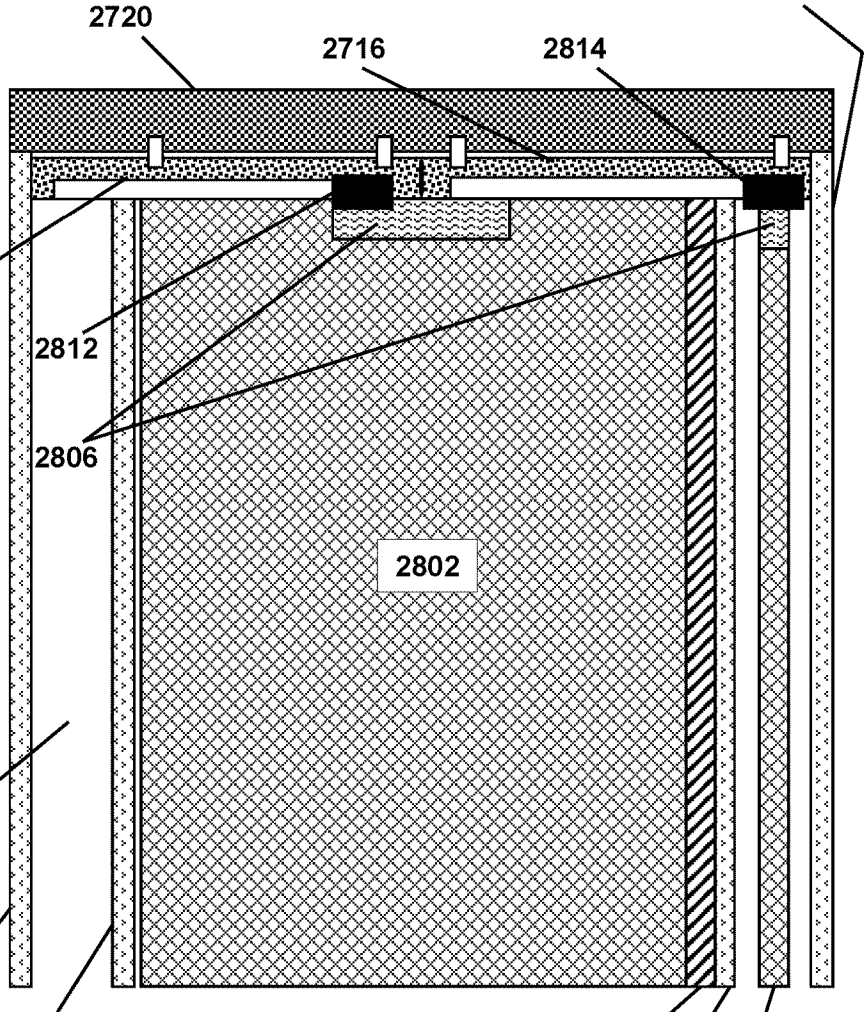
FIG. 28B is a cross-section side view of the embodiment of FIG. 28A. A slide mechanism is included that enables the rotational drive mechanism at the top of a door panel to change its position relative to the central axis of the door panel. Thus a telescoping extension is not required to fill a gap between a door panel and an opposite sidewall when the door panel is perpendicular to the sidewall. Per FIG. 28B, there is no gap.
Figure 28A:
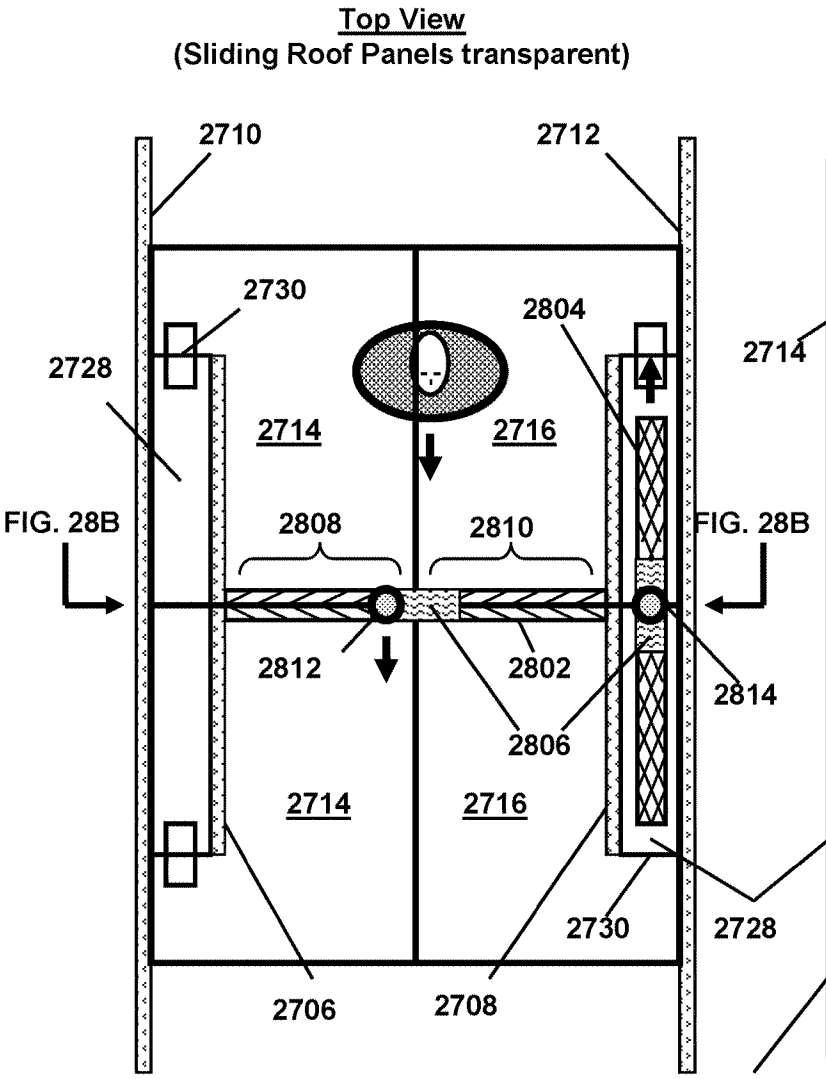
FIG. 28A is a top view of an entryway where sealed passageways have been added on either side of the sidewalls that define a pedestrian's path through the entryway. These passageways allow a return path for a moving door panel as it rotates into a position parallel to a sidewall and moves in a direction opposite the current pedestrian direction of travel.

FIG. 28A shows a top view of an entryway where sealed passageways 2728 have been added on either side of the sidewalls that define a pedestrian's path through the entryway. These passageways allow a return path for a moving door panel as it rotates into a position parallel to a sidewall and moves in a direction opposite the current pedestrian direction of travel. Door panels 2802 and 2804 move in a similar manner to moving door panels shown in previous figures, however when a door panel such as 2804 is parallel to entryway sidewall 2708 and is moving in a direction opposite that of a pedestrian currently within the entryway, door panel 2804 now passes through a sealed passageway 2728 formed by entryway sidewall 2708 and outer wall 2712. A similar passageway is formed on the opposite side of the entryway between sidewall 2706 and outer wall 2710.

Note that moving door panels 2802 and 2804 each include slider mechanism 2806 that enables the rotational drive mechanism at the top of a door panel to change its position relative to the central axis of the door panel. Thus, a telescoping extension is not required to fill a gap between a door panel and an opposite sidewall when the door panel is perpendicular to the sidewall, as shown in FIG. 28B. Per FIG. 28B, there is no gap. In FIG. 28A, rotational drive mechanism 2812 is shown positioned at the far left of slider mechanism 2806 and is therefore no longer aligned with the central axis of door panel 2802, enabling portion 2810 of door panel 2802 to reach the opposite sidewall 2708. Thus, a telescoping extension such as 2718 is not required. During the time that moving door panel 2804 is passing through a sealed passageway 2728, drive mechanism 2814 is repositioned within slider mechanism 2806 to move to the opposite side of door panel 2804. Note that on the next sequential cycle of the moving door panels, assuming the next pedestrian passes in the same direction as that shown in FIG. 28A, portion 2808 of door panel 2802 will be positioned such that it reaches sidewall 2708. Note that any re-positioning of a door panel rotational drive mechanism such as 2812 or 2814 can be done while passing through a sealed passageway. Thus, it is possible that a mechanism can be provided within each sealed passageway for re-positioning such drive mechanisms within their respective slider mechanisms 2806, and therefore no electromechanical drive mechanism for this specific purpose need be provided within the moving door panels themselves.

The exemplary embodiment shown in FIGS. 28A and 28B utilizes sliding roof panels 2714 and 2716 to drive and support moving door panels 2802 and 2804 respectively; however, other mechanisms described herein may instead be used to drive the moving door panels. Note that sliding roof panels 2714 and 2716 extend laterally beyond sidewalls 2706 and 2708 to reach outer walls 2710 and 2712, thus enabling lateral drive mechanisms for door panels 2802 and 2804 to position a door panel within a sealable passageway 2728 for the return path of a door panel such as that shown for door panel 2804 in FIG. 28A.

FIG. 28B shows a top view cross-section of the embodiment of FIG. 28A, including a seal 2722 that comprises the outer edge of moving door panel 2802. Note in the cross-section shown in FIG. 28B that top cover 2720 extends beyond sidewalls 2706 and 2708 to outer walls 2710 and 2712. Also, note in FIG. 28B the position of rotational drive mechanism 2812 relative to slider mechanism 2806 thus enabling door panel 2802 to essentially block passage through the entryway without the need for a telescoping extension.

Figure 29:
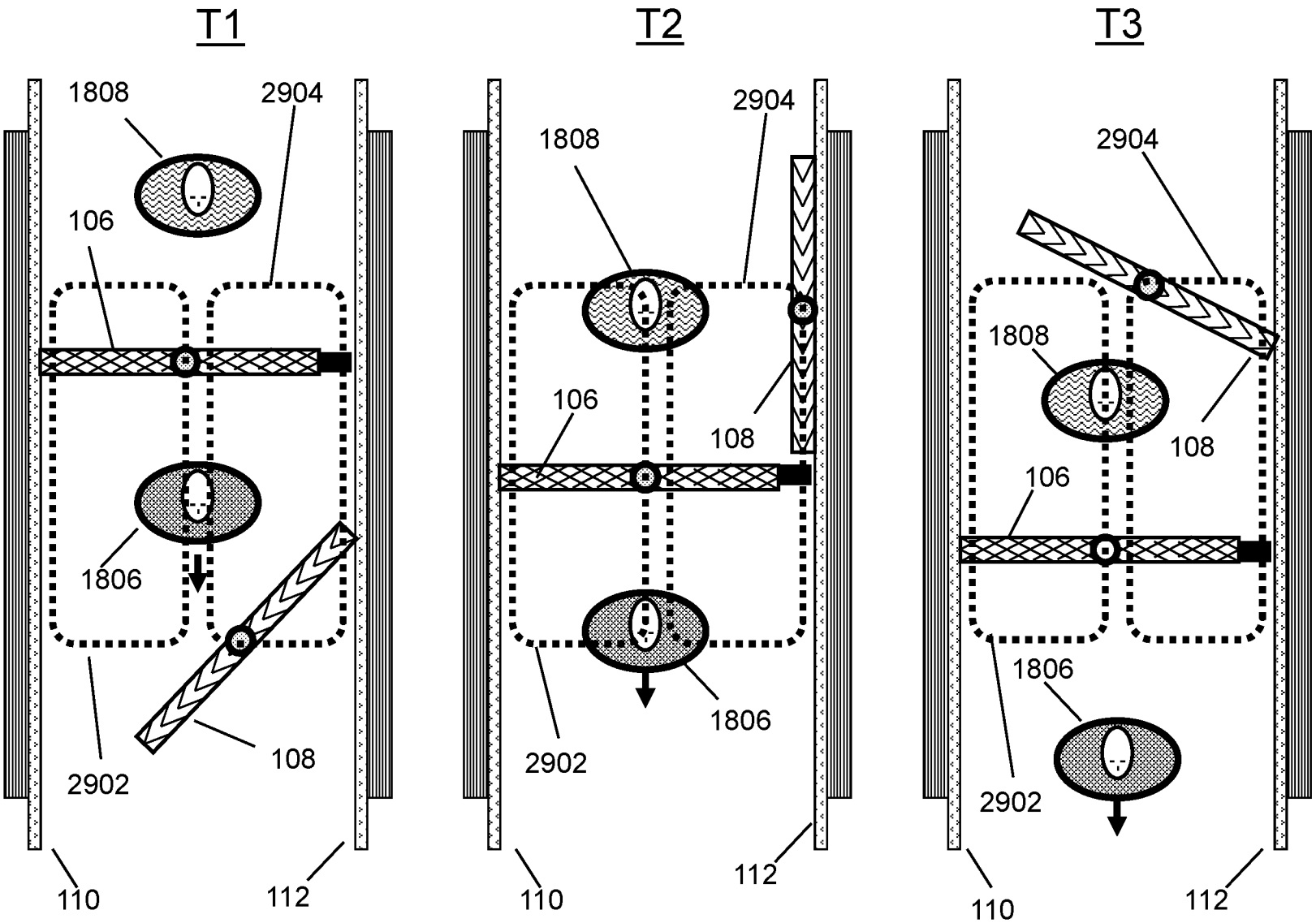
FIG. 29 shows a sequence of three time slots, T1 through T3, where moving door panels travel in closed-circuit paths and are driven from the top.

It was mentioned earlier in this specification with respect to FIGS. 18-22 that while earlier embodiments show moving door panels driven in lateral and longitudinal directions from the top by moving arms or sliding roof panels, a closed-loop drive path mechanism similar to that shown in the embodiments of FIGS. 18-22 could also be utilized for driving a door panel in lateral and longitudinal directions from above. Exemplary embodiments are shown in subsequent figures starting with FIG. 29 where closed-circuit paths 2902 and 2904 indicate how drive mechanisms mounted above moving door panels 106 and 108 respectively move along closed-circuit rectangular-shaped paths with rounded corners.

Figure 30B:
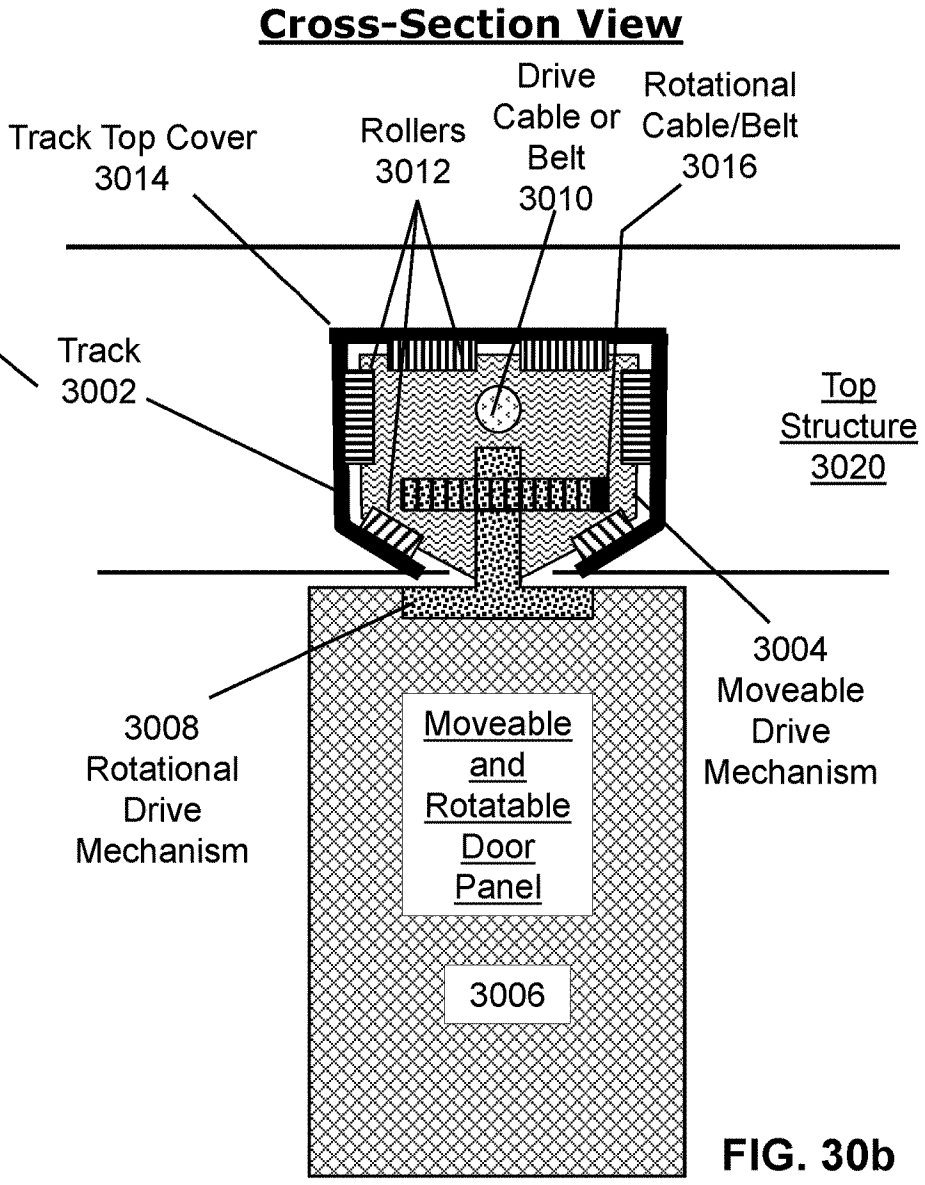
FIG. 30*b* shows a cross-section of a moving door panel and a drive mechanism attached above.
Figure 30A:
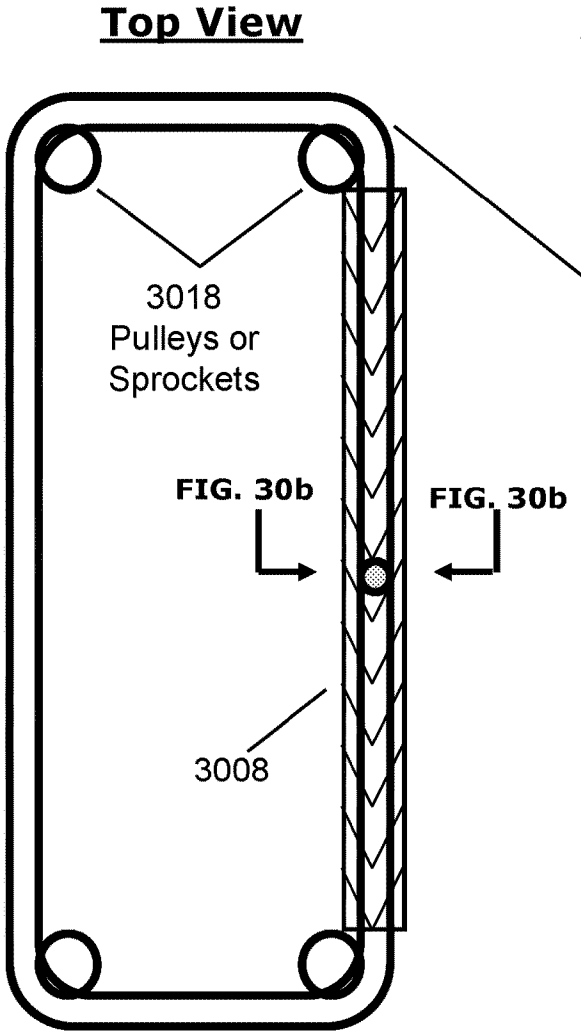
FIG. 30*a* shows a top view of a closed-circuit track for driving a moving door panel from the top.

FIG. 30*a* depicts a top view of a track 3002 that is positioned above the portal and allows a movable drive mechanism 3004, riding in and suspended from track 3002, to follow a closed-circuit pathway essentially shaped like a rectangle with curved or rounded corners. Movable drive mechanism 3004—shown in the cross-section view of FIG. 30B—connects to an exemplary movable and rotatable door panel 3006 by way of rotational drive mechanism 3008. Movable drive mechanism 3004 is driven along track 3002, for example, by a drive cable or belt 3010, which in FIG. 30*b* is shown as a cable. For ease of movement, rollers 3012 are included, and top cover 3014 prevents upward movement of movable drive mechanism 3004 should there be an impact on movable and rotatable door panel 3006. Track 3002 and top cover 3014 are supported in top structure 3020. A rotational cable or drive belt 3016, shown in FIG. 30*b* as a toothed belt, will cause rotation of movable door panel 3006 when drive mechanism 3004 is stationary within track 3002. When the drive cable or belt 3010 is moving, causing movable drive mechanism 3004 to move, rotation of the door panel 3006 can be prevented—for straight sections of track 3002—by causing rotational cable or belt 3016 to move at the same rate as drive cable or belt 3010. Essentially, for this exemplary and non-limiting embodiment, the rotational position of door panel 3006 is controlled according to a differential rate of movement between drive cable or belt 3010 and rotational cable or belt 3016. At one or more locations along track 3002, pulleys or sprockets 3018 are included to either drive cables and/or belts or alternately provide support for cables and/or belts traveling around a corner. Sensors (not shown) determine the position of the moveable drive mechanism 3004 within track 3002 as well as the rotational position of door panel 3006 so that a central controller can properly control all movements.

Figure 31B:
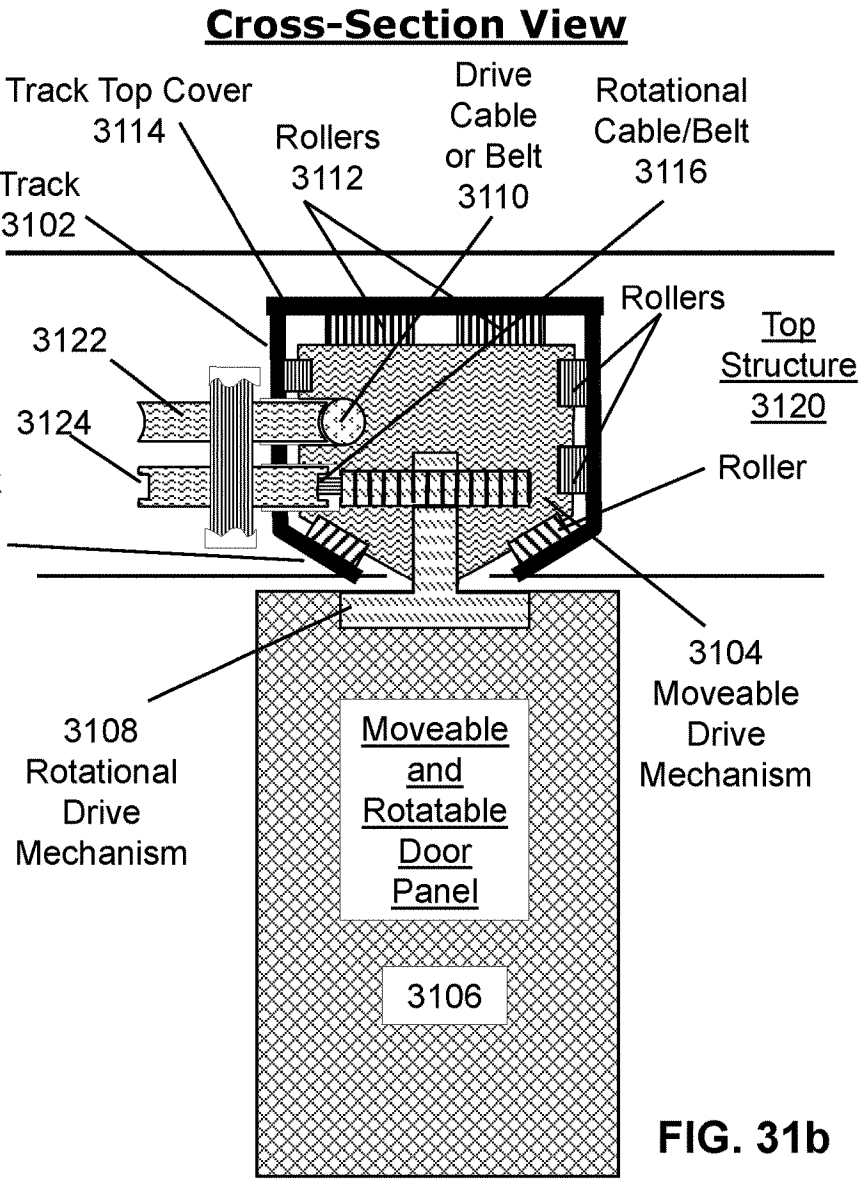
FIG. 31*b* shows a cross-section of a moving door panel and a drive mechanism attached above.
Figure 31A:
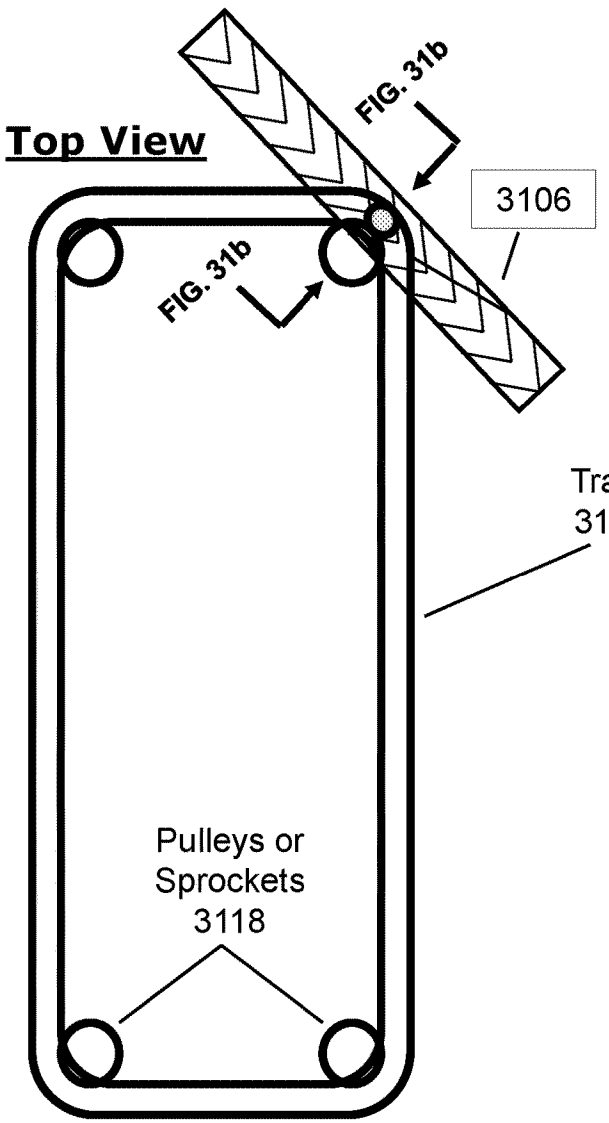
FIG. 31*a* shows a top view of a closed-circuit track for driving a moving door panel from above, with a door panel positioned at a corner of the track.

FIGS. 31*a* and 31*b* show another exemplary implementation of movable and rotatable door panels driven from above by a movable drive mechanism traveling in a closed-circuit track. FIG. 31*a* depicts a top view of a track 3102 that is positioned above the portal and allows a movable drive mechanism 3104 riding in track 3102 to follow a closed-circuit pathway essentially shaped like a rectangle with curved or rounded corners. Movable drive mechanism 3104—shown in the cross-section view of FIG. 31*b*—connects to an exemplary movable and rotatable door panel 3106 by way of rotational drive mechanism 3108. Movable drive mechanism 3104 is driven along track 3102, for example, by a drive cable or belt 3110, which in FIG. 31*b* is shown as a cable. For ease of movement, rollers 3112 are included, and top cover 3114 prevents upward movement of movable drive mechanism 3104 should there be an impact on movable and rotatable door panel 3106. Track 3102 and top cover 3114 are supported in top structure 3120. A rotational cable or drive belt 3116, shown in FIG. 31*b* as a toothed belt, will cause rotation of movable door panel 3106 when drive mechanism 3104 is stationary within track 3102. When drive cable or belt 3110 is moving, thereby causing movable drive mechanism 3104 to move, rotation of the door panel 3106 can be prevented—for straight sections of track 3102—by causing rotational cable or belt 3116 to move at the same rate as drive cable or belt 3110. Essentially, the rotational position of door panel 3106 is controlled according to a differential rate of movement between drive cable or belt 3110 and rotational cable or belt 3116. At one or more locations along track 3102, pulleys or sprockets 3118 are included to either drive cables and/or belts, or alternately provide support for cables and/or belts traveling around a corner. Sensors (not shown) determine the position of moveable drive mechanism 3104 within track 3102 as well as the rotational position of door panel 3106 so that a central controller can properly control all movements. Pulley 3122 is shown in the cross-section view of FIG. 31*b* drives or supports cable 3110, while sprocket 3124 drives or supports toothed belt 3116, which in turn controls the rotation of moveable and rotatable door panel 3106.

Figure 32:
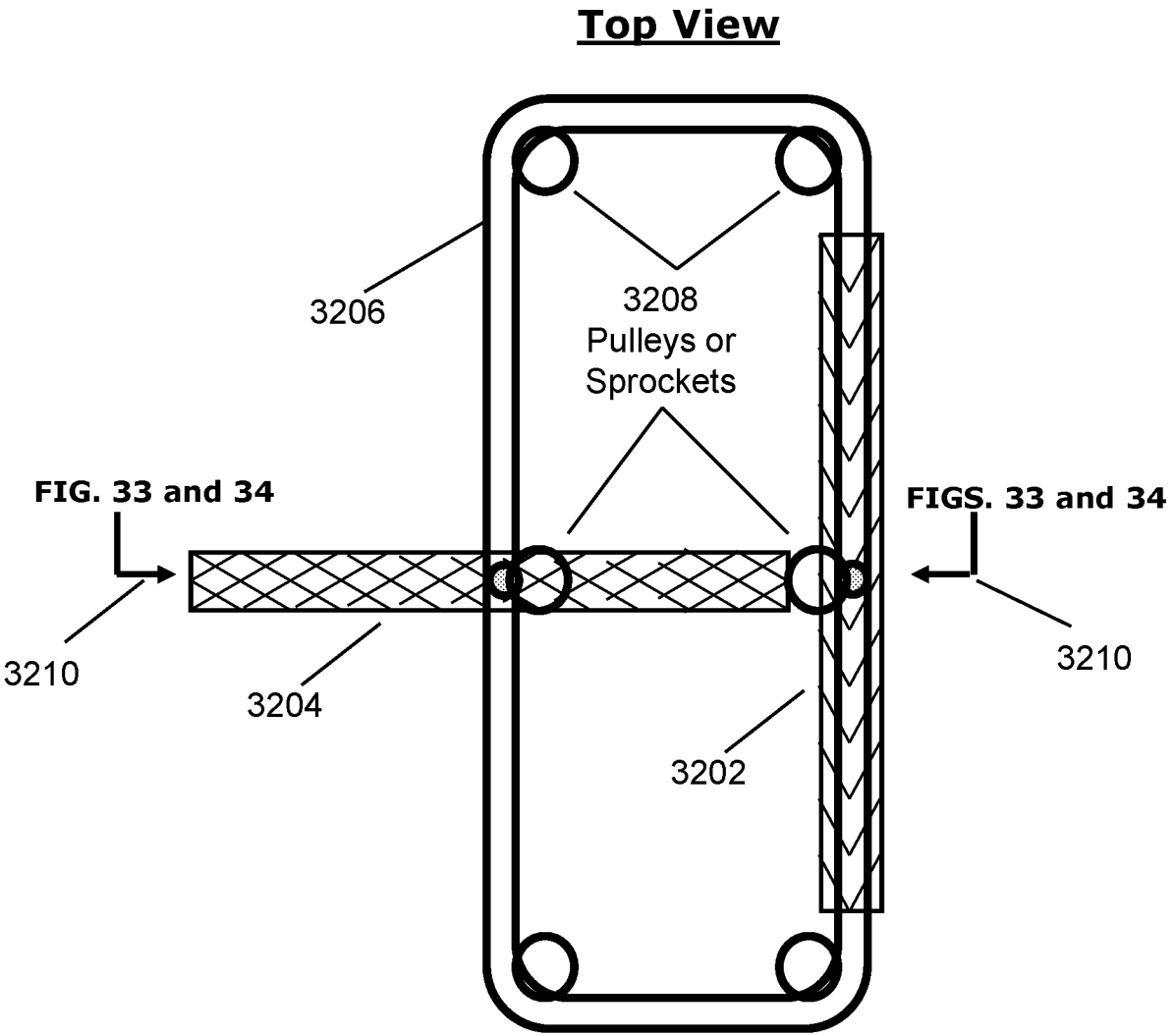
FIG. 32 shows a top view of a closed-circuit track for driving moving door panels from the top and two moving and rotatable door panels that both ride in the same closed-circuit track.

FIG. 32 shows a top view with two door panels 3202 and 3204, both suspended from drive mechanisms riding in the same track 3206. Pulleys or sprockets 3208 are placed at various points along track 3206, some for guiding belts or cables that drive and control the door panels, and two or more pulleys or sprockets typically driving belts or cables. The cross-section indicators 3210 define exemplary cross-sections shown in FIGS. 33 and 34.

Figures 33A, 33B:
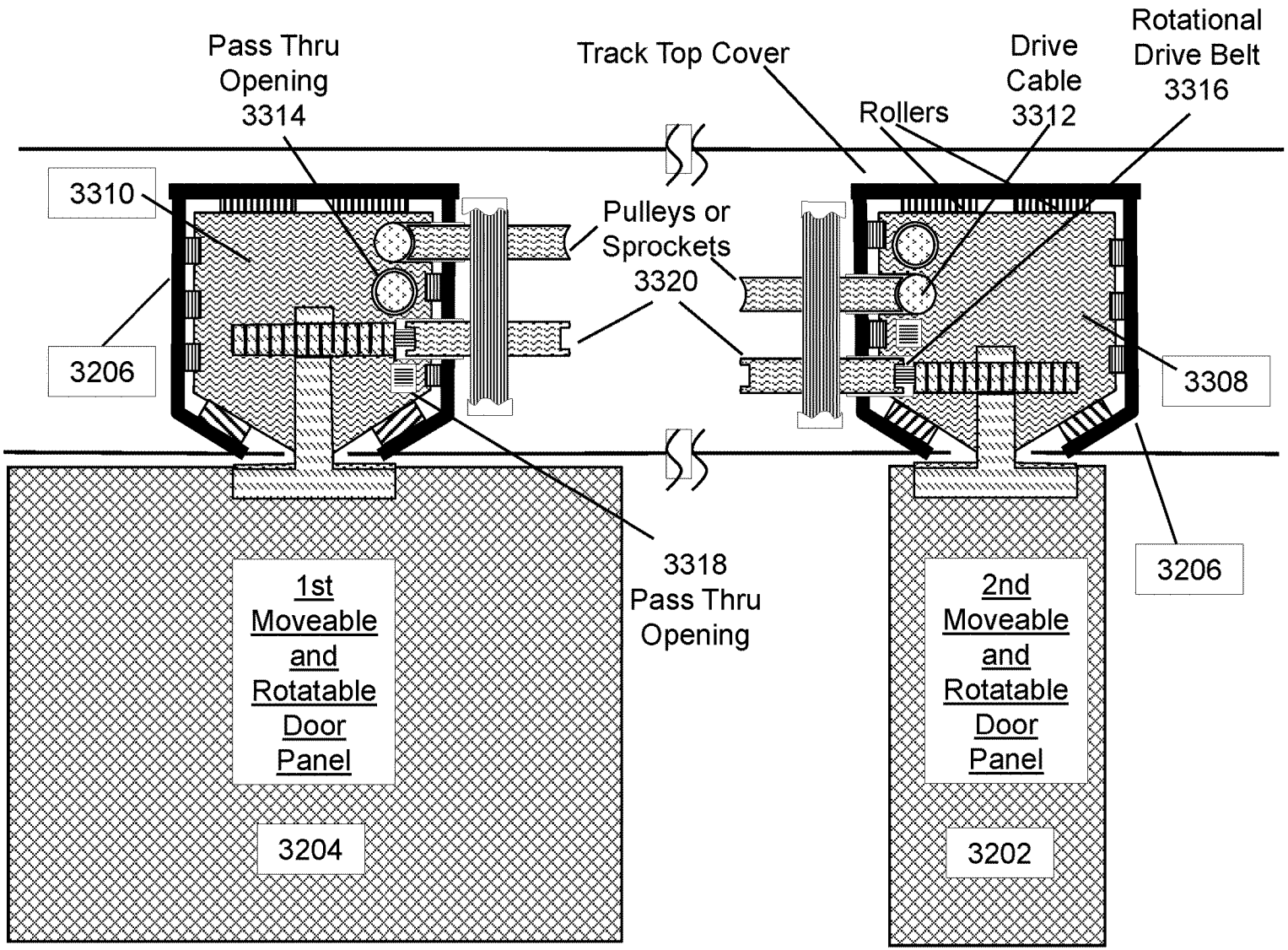
FIGS. 33*a* and 33*b* show cross-sections of the two moving door panels of FIG. 32, along with drive mechanisms attached above each door panel.

FIGS. 33*a* and 33*b* show cross-sections of door panels 3204 and 3202, respectively, along with cross-sections shown for drive mechanisms 3310 and 3308, respectively. Drive mechanisms 3310 and 3308 both travel the same closed circuit path by riding in track 3206. In this exemplary diagram, each of drive mechanisms 3310 and 3308 is driven by its own drive cable or belt, for instance, drive cable 3312 for drive mechanism 3308. Note that where drive cable 3312 passes through drive mechanism 3310 there is a pass-through opening 3314 in drive mechanism 3310. Likewise, where rotational drive belt 3316 for drive mechanism 3308 passes through drive mechanism 3310, there is a pass-through opening 3318 in drive mechanism 3310. In a similar manner, drive cables and/or drive belts for moving drive mechanism 3310 pass-through openings in drive mechanism 3308. Note that drive cables and/or drive belts may be either driven by pulleys or sprockets 3320 or alternately simply be supported and/or guided by pulleys or sprockets 3320.

Figures 34A, 34B:
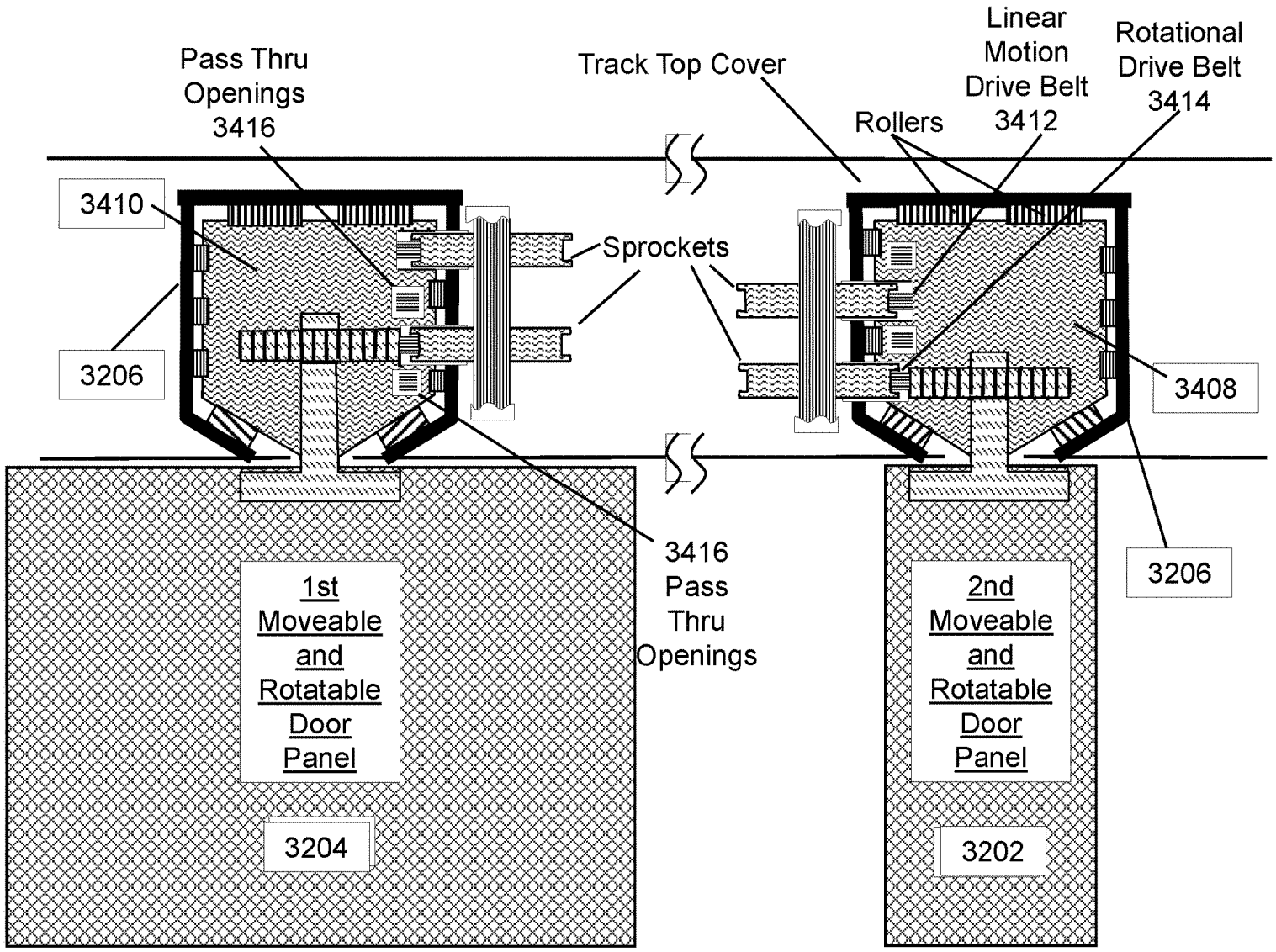
FIGS. 34*a* and 34*b* show cross-sections for alternative embodiments of the two moving door panels of FIG. 32, along with drive mechanisms attached above each door panel.

FIGS. 34*a* and 34*b* show cross-sections for alternate embodiments of door panels 3204 and 3202, respectively, along with cross-sections shown for drive mechanisms 3410 and 3408, respectively. Drive mechanisms 3410 and 3408 both travel the same closed circuit path by riding in track 3206. In this exemplary diagram, each of drive mechanisms 3410 and 3408 is driven for linear motion—along track 3206—by its own toothed drive belt, for instance, drive belt 3412 for drive mechanism 3408. Also, each door panel is rotated by its own toothed rotational drive belt, for instance, rotational drive belt 3414. Note, for example, that drive mechanism 3410 has pass-through openings 3416 to allow toothed belts 3412 and 3414 to pass through unimpeded. In a similar manner, provision can be made for additional motion drive belts and rotational drive belts to support three or more drive mechanisms and moving door panels. Also note that although the embodiments of FIGS. 30, 31, 33, and 34 do not show a motor included with or integral with the moveable drive mechanism, such mechanisms could instead include motors for linear motion drive along a track and/or for a rotational drive. Depending on the threat sensors chosen for the portal, it may be advantageous to locate drive motors away from the center of the portal. As such, the embodiments shown may reduce sensor interference by remotely locating and/or shielding motors, and further by implementing pulleys, sprockets, and gears with plastic or composite material, or alternately with non-magnetic metal such as stainless steel. Further, it may for some embodiments be a requirement to make electrical power and or control signals available to moveable drive mechanisms and to the door panels themselves. One configuration that can provide this capability is to have each half of a closed-circuit track, such as track 3206 be electrically isolated from the other half or alternately have each half at least in part comprise a conductive strip carrying electrical current.

Figure 35B:
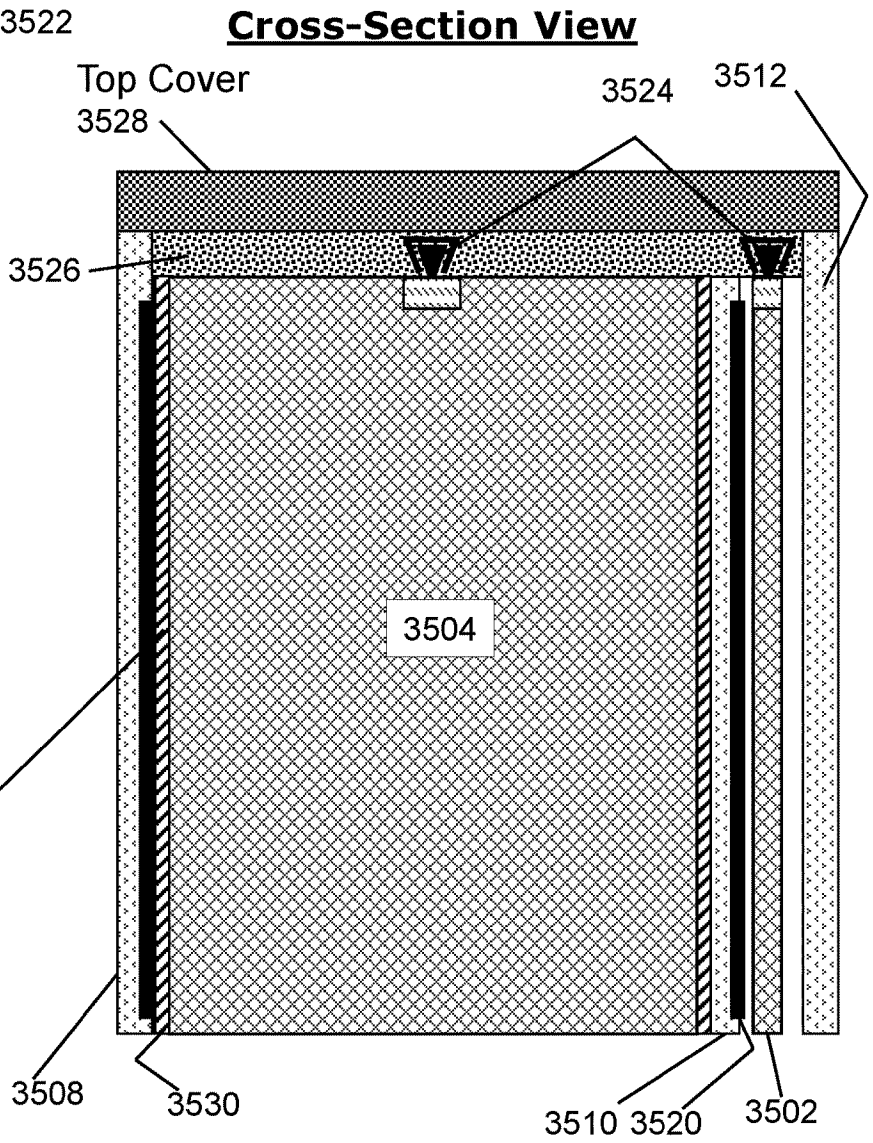
FIG. 35*b* is a cross-section view of FIG. 35*a*.
Figure 35A:
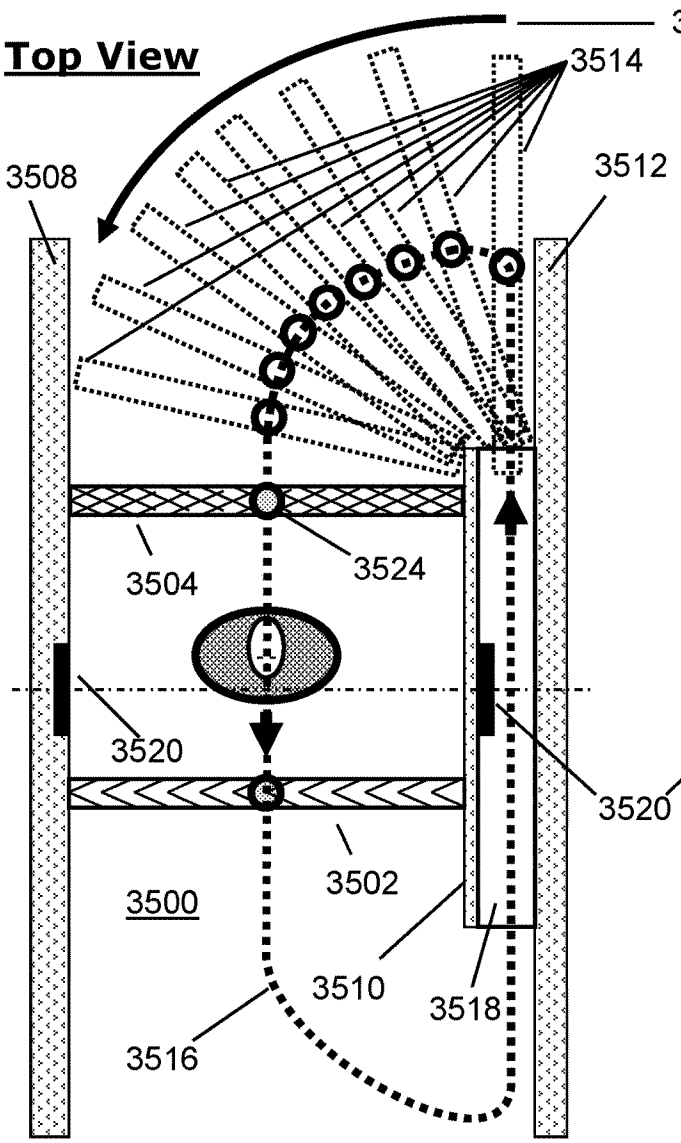
FIG. 35*a* shows a top view of a portal with two moving door panels driven from above by drive mechanisms riding in the same closed-circuit track mounted above. A sealed passageway is provided for the return path of the door panels, and a sequence of door panel positions is shown as a panel leaves the sealed passageway and swings into position to pass through the pedestrian passageway.

FIG. 35*a* shows a top view of a portal that includes a sealed passageway similar to that of FIGS. 27 and 28 to allow a return path for moving door panels without passing through pedestrian passageway 3500. Moveable and rotatable door panels 3502 and 3504 follow a closed circuit path 3516 that includes passing between sidewalls 3508 and 3510, and passing through sealed passageway 3518 located between pedestrian passageway sidewall 3510 and outer wall 3512. In passing through sealed passageway 3518, moving door panels 3502 and 3504 pass around one of the metal detector panels 3520. This enables both metal detectors in a portal to be as close to the pedestrian passageway 3500 as possible, increasing their effectiveness. A sequence of dotted outline images 3514 of door panel 3504 are shown in a sweeping motion 3522 as drive mechanism 3424 for door panel 3504 follows closed-circuit pathway 3516. For the configuration shown, notice that closed-circuit pathway 3516 forms a quasi-trapezoidal shape. Other shapes are possible depending on the overall configuration of the portal.

FIG. 35*b* shows a top view of the portal of FIG. 35*a*, but at a different point in the cycle where the door panels are positioned with one parallel to—and one perpendicular to—linear pedestrian passageway sidewall 3510. Drive mechanisms 3524 are located in this exemplary embodiment at the tops of door panels 3502 and 3504 and are supported within structure 3526 that is below top cover 3528. For this embodiment, drive mechanisms 3524 run in and are suspended from a closed-circuit track. Note that alternately structure 3526 and top cover 3528 can be one and the same structure. Additionally, door panels 3502 and 3504 may have optional seals 3530 located on the ends to fill spaces between the door panels and the pedestrian passageway sidewalls when a door panel is perpendicular to a sidewall.

Sealed passageway 3518 has openings at each end that are sealed unless a moving door panel is present at an opening. Each opening has a moveable door or doors that are closed and locked when a door panel is not present. A preferred embodiment would be two doors in the form of a swinging "saloon door" configuration with a locking mechanism so that objects or weapons cannot be passed or forced there-through when closed.

Figures 36A, 36B:
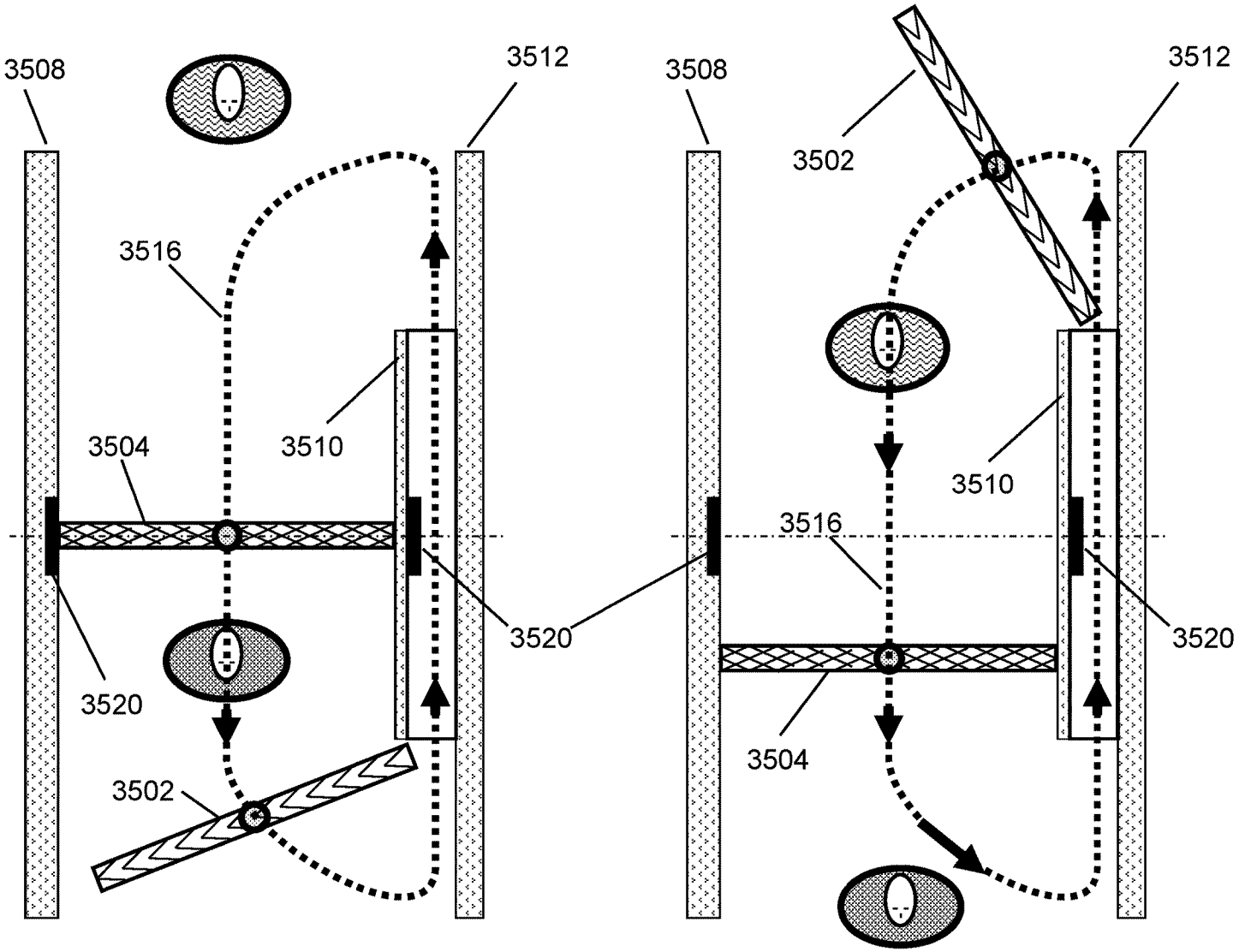
FIGS. 36*a* and 36*b* show top views of the portal embodiment of FIGS. 35*a* and 35*b*, including a sequence of two different positions at different points in time.

FIGS. 36*a* and 36*b* illustrate an exemplary sequence of door panel movements for the embodiment of FIGS. 35*a*, and 35*b*. Note that for FIGS. 36*a* and 36*b*, as well as for other figures, for a sequence of pedestrian subjects passing through in a first direction, a first side of a specific moveable and rotatable door panel will face a first subject, and then a second side of the same specific moveable and rotatable door panel will face a subsequent subject.

Figure 37B:
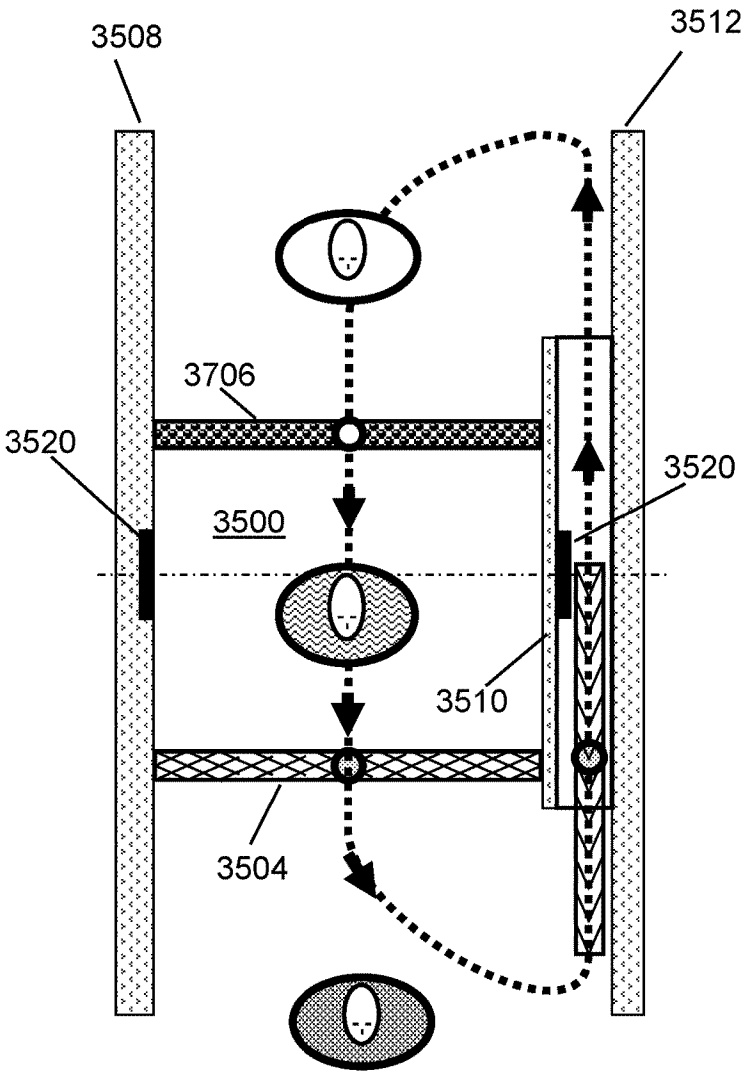
FIGS. 37*a* and 37*b* show top views of the portal embodiment of FIGS. 35*a* and 35*b* including a sequence of two different positions at different points in time, and also including a third moving door panel also riding in a common closed circuit track with the two door panels of FIGS. 35*a*, and 35*b*.
Figure 37A:
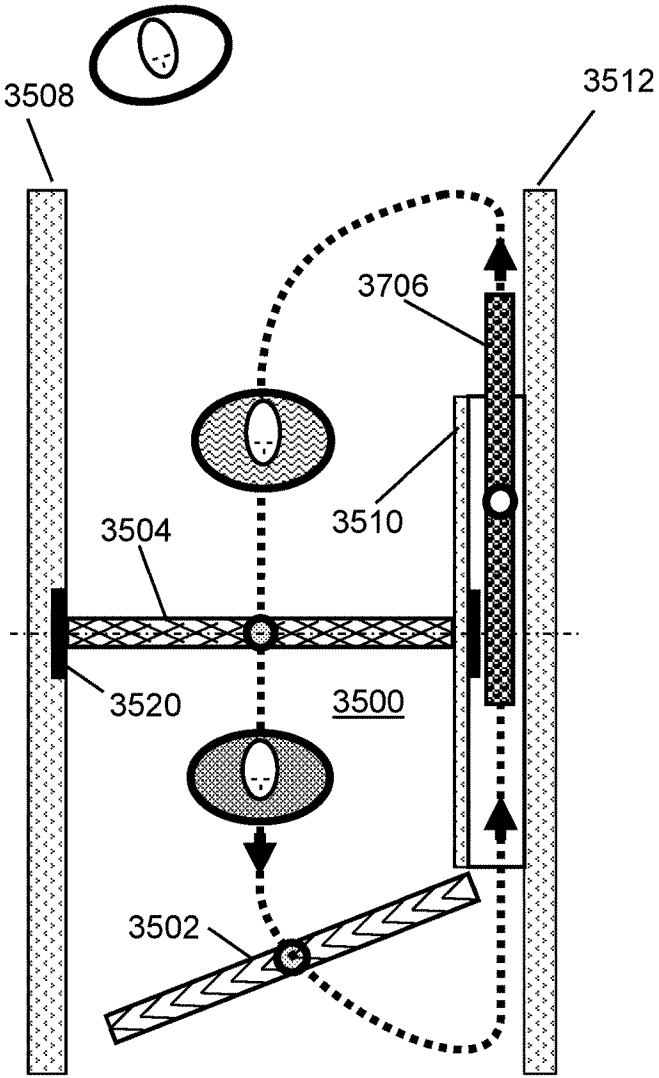

FIGS. 37*a* and 37*b* introduce a third moveable and rotatable door panel 3706 to the embodiments of FIGS. 35*a* and 35*b*. FIGS. 37*a* and 37*b* illustrate an exemplary sequence of door panel movements when three moveable and rotatable door panels are utilized in the invention, and in this embodiment, all follow the same closed circuit path. These three door panels in an embodiment may be driven and suspended from the top and ride in the same track.

Figures 38A, 38B:
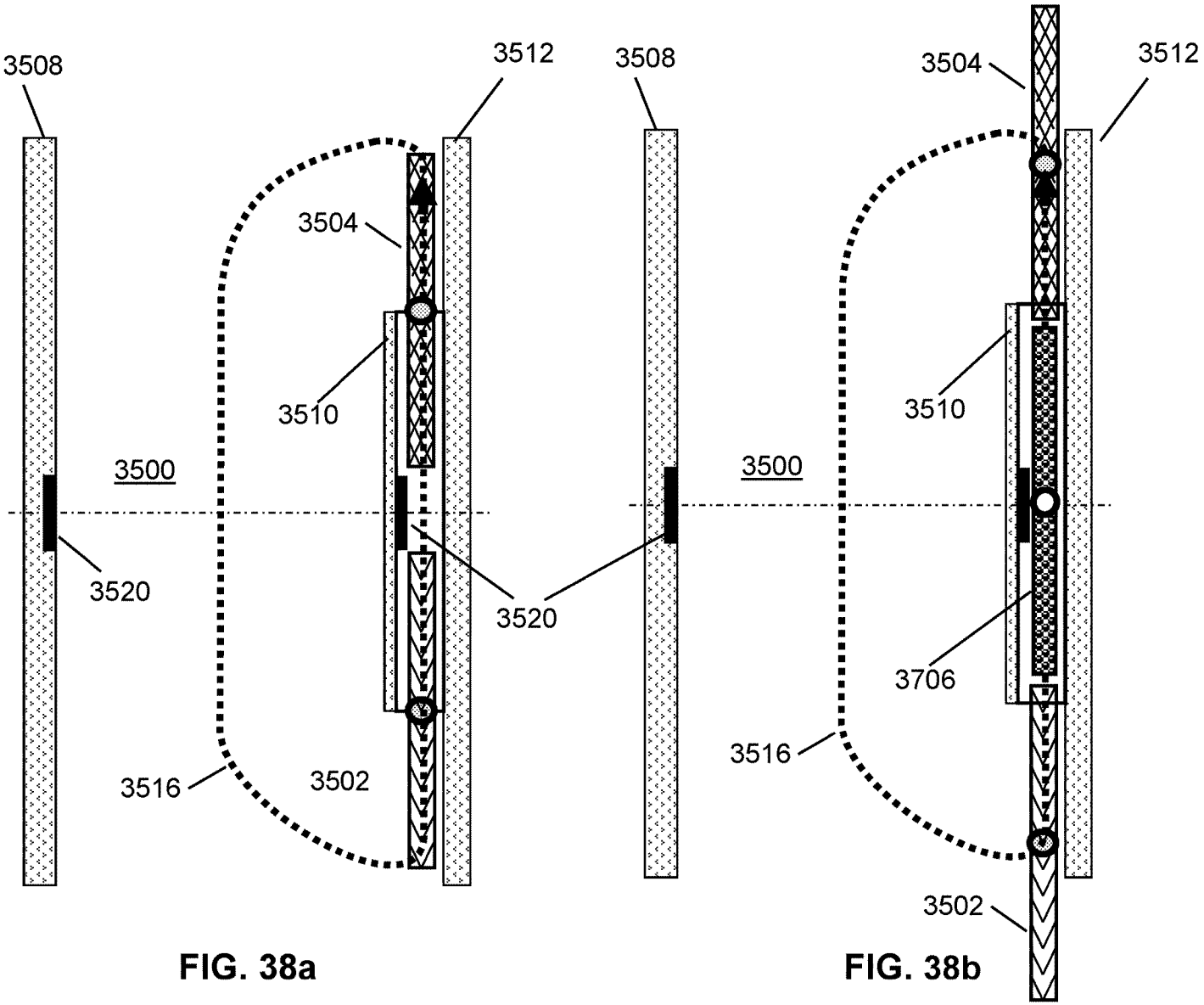
FIG. 38*a* shows a top view of the portal embodiment of FIG. 35 with two moving door panels.
FIG. 38*b* shows a top view of the portal embodiment of FIG. 37 with three moving door panels. Both

FIGS. 38*a* and 38*b* illustrate emergency scenarios where moveable and rotatable door panels are positioned so as to allow unimpeded passage for pedestrian subjects through pedestrian passageway 3500. Such emergencies include, for instance, evacuation of a building as a result of fire or another disaster. For such emergencies, the portal would typically be activated to allow unimpeded passage only after the emergency is validated by a responsible person, thus preventing two attackers working together from opening the doors by triggering a fire alarm. FIG. 38*a* includes two door panels while FIG. 38*b* includes three door panels. For the scenarios of both FIGS. 38*a* and 38*b*, all door panels are positioned parallel to and adjacent sidewall 3510, thus allowing unimpeded passage through pedestrian passageway 3500.

Figures 39A, 39B:
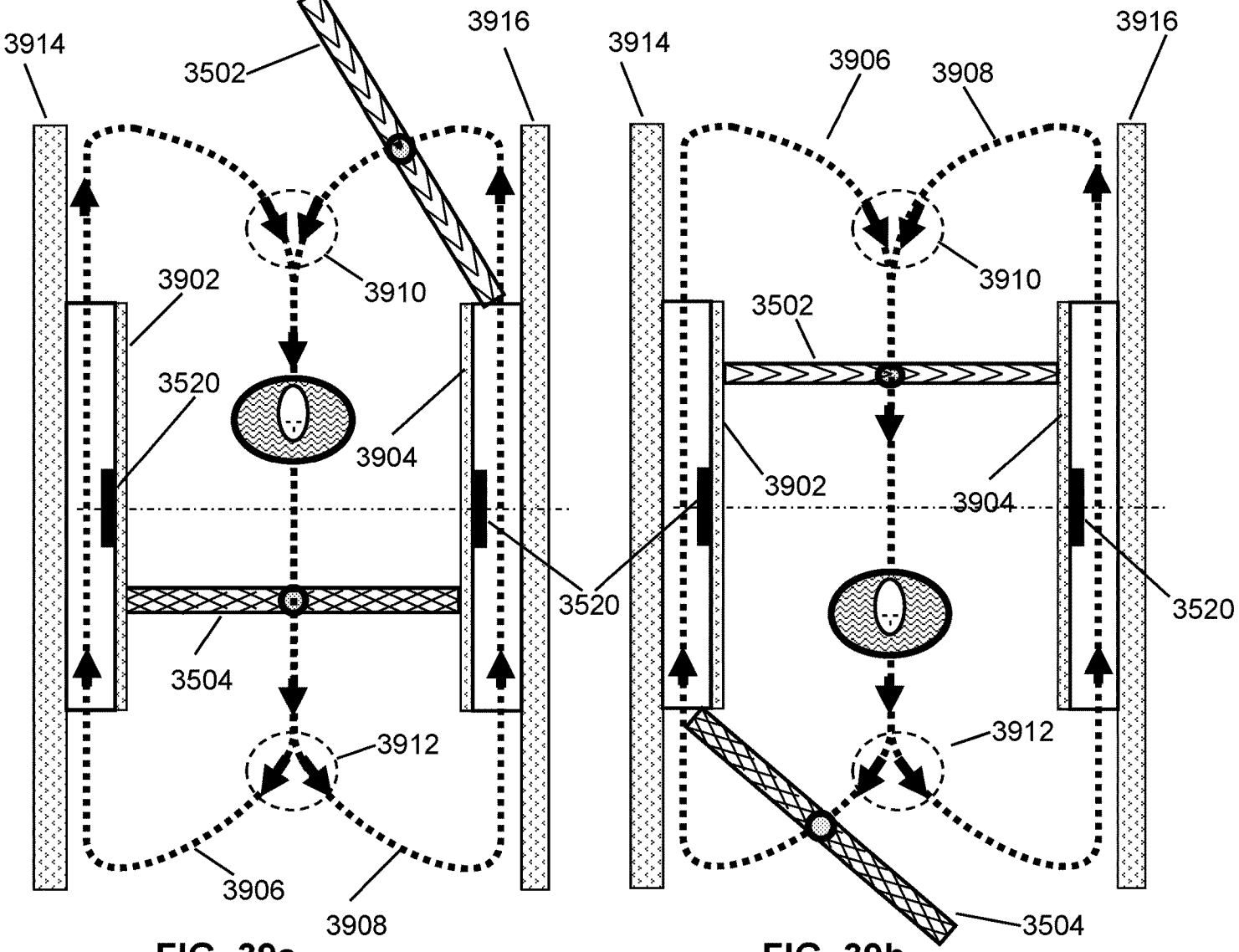
FIGS. 39*a* and 39*b* show two sequential views of a portal embodiment where each portal includes two sealed passageways for door panel return paths and two tracks that merge along the centerline of the portal. For this embodiment, both doors travel in the same track when passing through the center of the pedestrian passageway, and each door travels in a different track branch for the remainder of a circuit.

FIGS. 39*a* and 39*b* show two sequential views of a portal embodiment where each portal includes two sealed passageways bordered by inner sidewalls 3902 and 3904 and outer sidewalls 3914 and 3916, respectively. The sealed passageways provide door panel return paths and are otherwise sealed to prevent weapon passing. More than two moving door panels may be used as shown in previous figures; however, only two are shown here for clarity. For this embodiment, both door panels travel in the same track when passing through the center of the pedestrian passageway and each door travels in a different track branch for the remainder of a circuit. The two tracks 3906 and 3908 merge along the centerline of the portal. Door panel 3502 will follow track 3908 while passing through a sealed passageway adjacent inner sidewall 3904 and when the drive mechanism for door panel 3502 reaches track junction 3910, its path will join that of track 3906 and travel on a common section of track with track 3906 until reaching track junction 3912, whereupon it travels again on a track portion belonging exclusively to track 3908. If cables or belts are used to move a drive mechanism for door panel 3502, the cable or belt for door panel 3502 can provide a means for ensuring that the drive mechanism for door panel 3502 takes the correct path at junction 3912. Likewise, door panel 3504 follows a similar path with respect to track 3906.

Figure 40B:
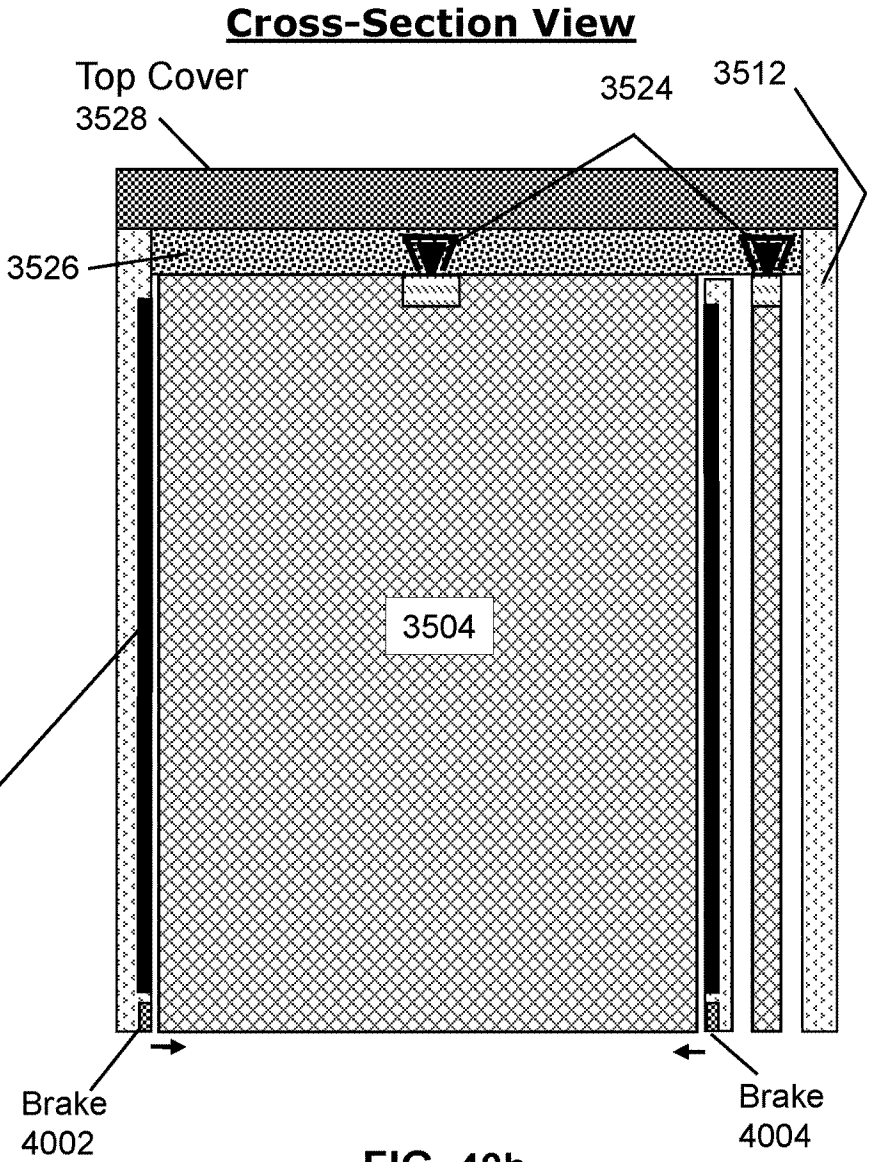
FIGS. 40*a* and 40*b* show top and cross-section views of a portal embodiment where brake mechanisms have been incorporated into the sidewalls to prevent excessive movement of moving door panels caused by excessive side pressure or impacts.
Figure 40A:
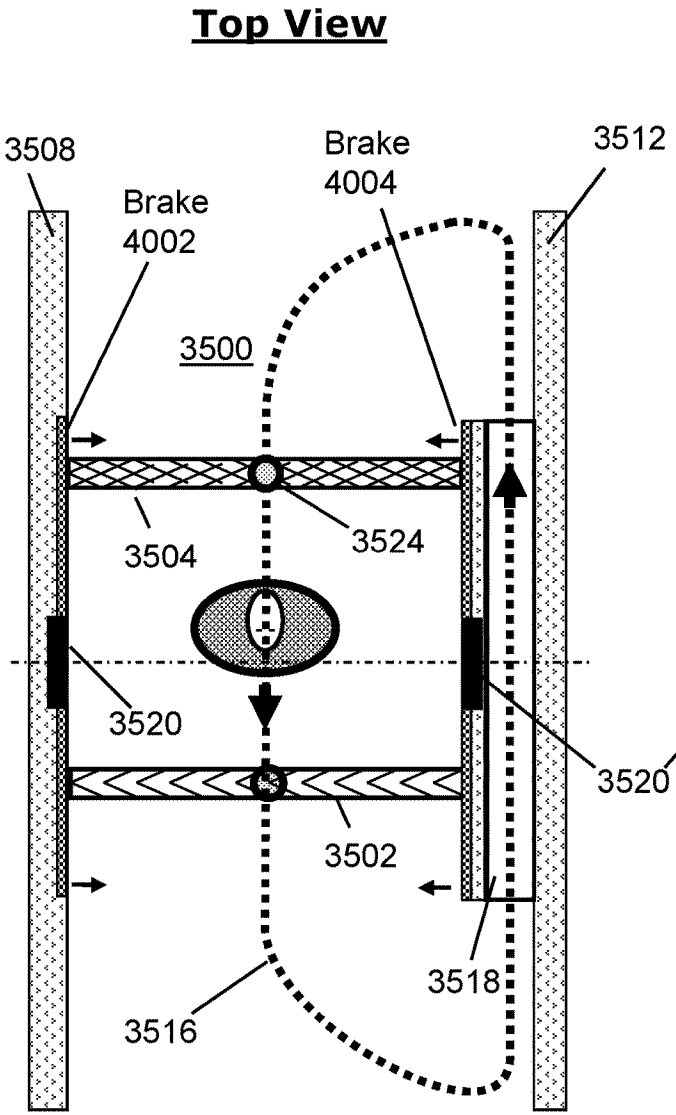

FIGS. 40A and 40B include an alternate embodiment for a brake mechanism for preventing undesired movement of a door panel resulting from an impact or pressure directed into the larger surface of the door panel. For this embodiment, brake surfaces 4002 and 4004 are incorporated into sidewalls 3508 and 3512, respectively where these brake surfaces are oriented longitudinally relative to passageway 3500 and also located at the bottom of the sidewalls such that they do not interfere with detection by metal detectors 3520. Depending on how moving door panels 3502 and 3504 are driven, only one of brake mechanisms 4002 and 4004 may be required in an alternative embodiment.

Figure 41B:
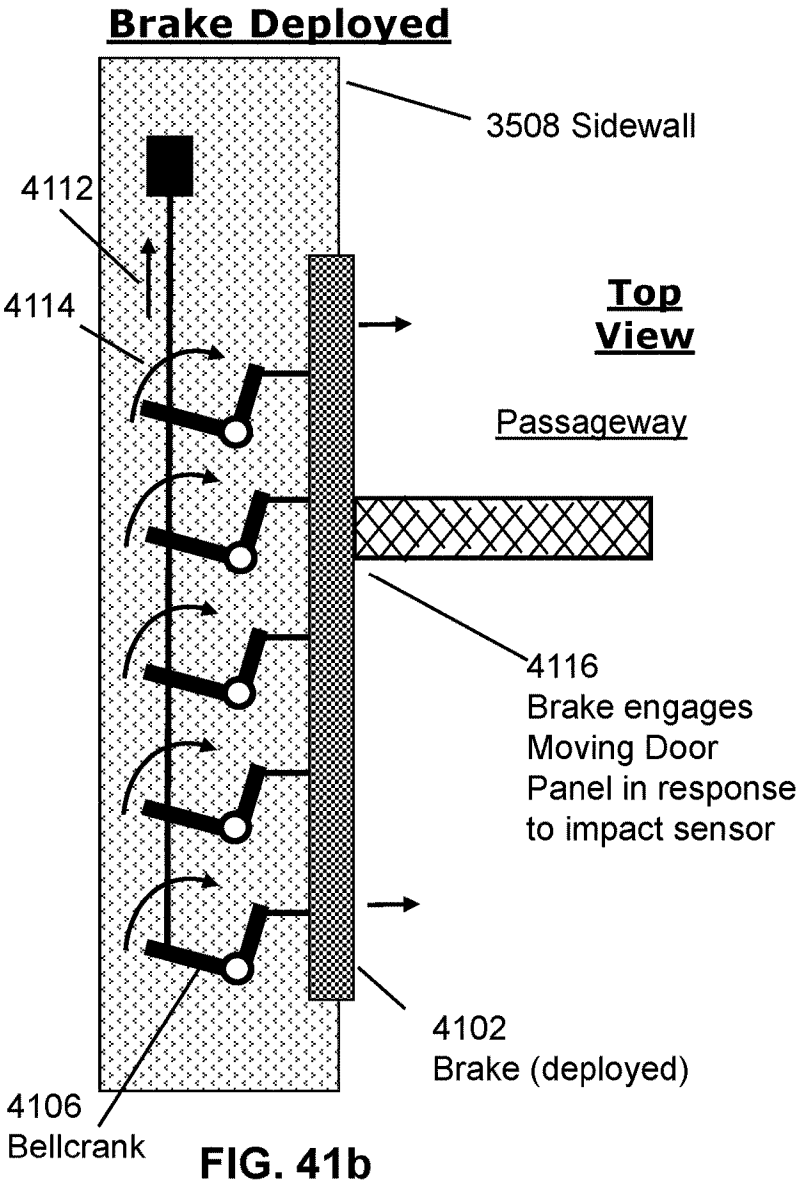
FIGS. 41*a* and 41*b* show an exemplary mechanism for activating the brake mechanisms of FIGS. 40*a* and 40*b*, where
Figure 41A:
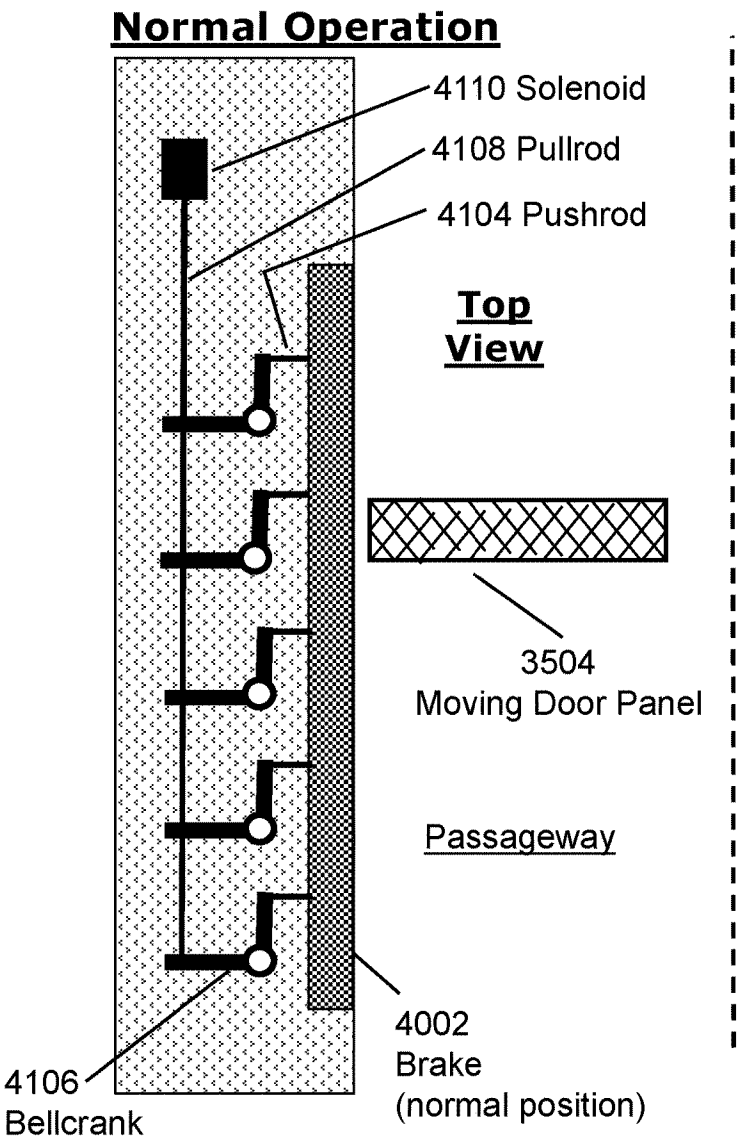

An exemplary and non-limiting mechanism for activating brake mechanisms 4002 and 4004 are shown in FIGS. 41A and 41B. Brake surface 4002 is shown in FIG. 41A in a deactivated position as it would normally be during the operation of the portal. When an impact or pressure directed into the larger surface of the door panel is detected, brake 4002 is activated by pushrod 4104, which in turn is driven by bellcrank 4106. Bellcrank 4106 is in turn activated by pull rod 4108, which is driven by a solenoid or motor 4110. Thus as shown in FIG. 41B, in response to such a detection of abnormal pressure on the door panel, not only does the door panel drive mechanism cease to move the door panel, solenoid or motor 4110 will move 4112 pull rod 4108, thus causing bellcrank 4106 to rotate 4114 thus causing brake surface 4002 to move towards the pedestrian passageway thus engaging with door panel 3504 thereby assuming deployed position 4102 and preventing unwanted movement that may damage the door panel and/or its drive mechanism.

Figures 42A, 42B:
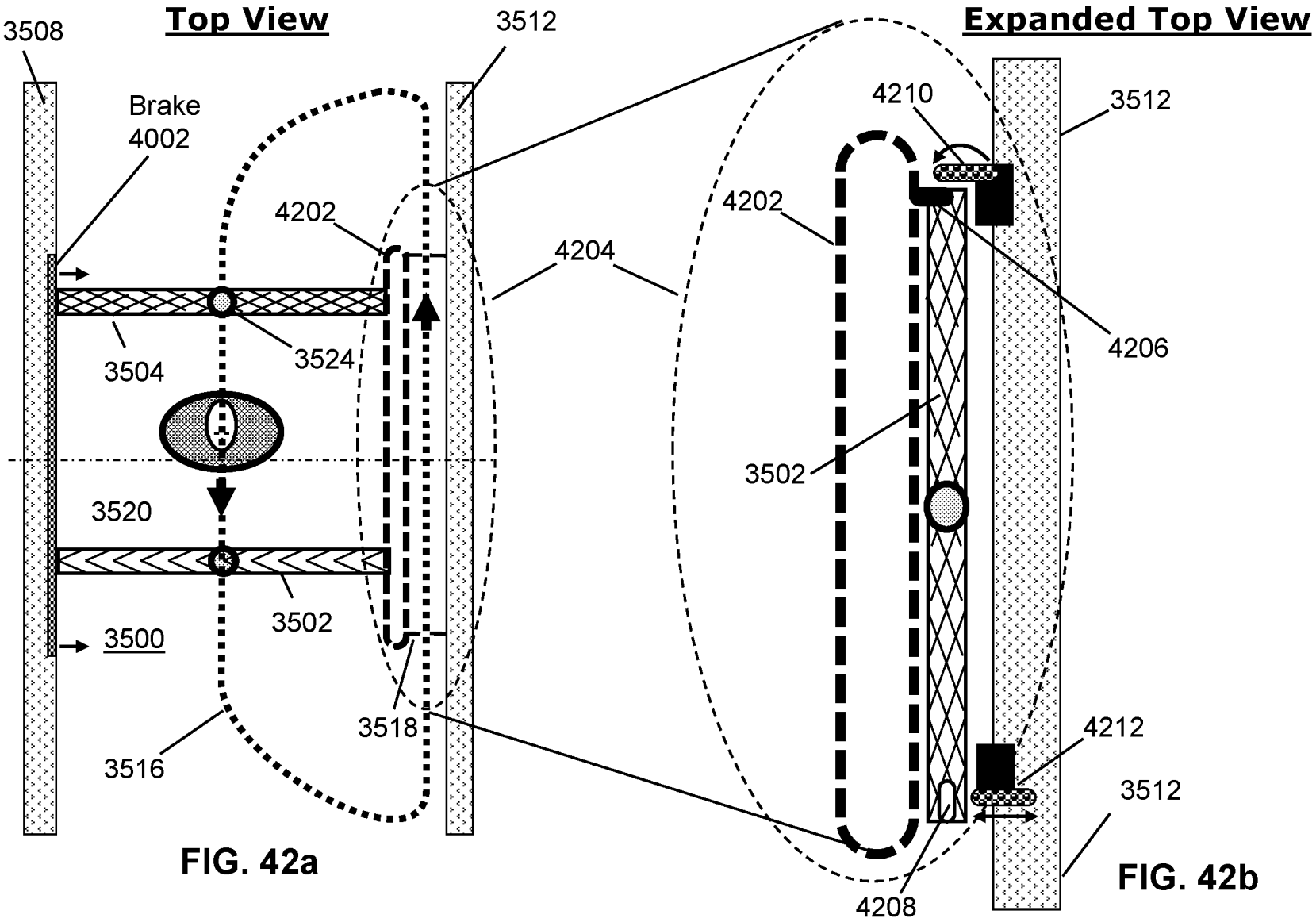
FIGS. 42*a* and 42*b* show a top view and expanded top view, respectively, for a portal embodiment where a conveyor mechanism is utilized to drive moving door panels in a closed-circuit path.

An alternate embodiment for a drive mechanism for the moving door panels according to the invention is shown, for example, in FIGS. 42A and 42B. The diagram shown in FIG. 42A is similar to that of FIGS. 35A and 40A, except that there is now included a conveyor mechanism 4202 that is used to drive door panels 3502 and 3504 along closed circuit path 3516. One or more conveyor mechanisms 4202 may be present in a single portal implementation as shown, for example, in FIGS. 45 and 46. An enlarged view of a portion of FIG. 42A containing conveyor mechanism 4202 is shown in FIG. 42B. Each door panel, such as 3502 will have an engagement drive point at each end, such as 4206 and 4208. As a door panel passes through the sealed passageway between conveyor 4202 and sidewall 3512 one such engagement drive point will engage with conveyor mechanism 4202 while the other engagement drive point will disengage. For some period of time, depending upon the implementation, both drive points 4206 and 4208 may both be engaged. Engagement drive points such as 4206 and 4208 may be activated by engagement control mechanisms contained within door panel 3502, or alternately may be activated by external engagement control mechanisms such as 4210 and 4212 shown attached to sidewall 3512. Such engagement control mechanisms would typically extend towards door panel 3502 at some point in time to cause either engagement or disengagement of a particular engagement drive point. External engagement control mechanism 4210 is shown with an appendage that rotates in order to activate engagement drive point 4206. Alternately, an external engagement control mechanism such as 4210 may include an appendage that slides in order to activate engagement drive point 4206.

Figures 43A, 43B, 43C, 43D:
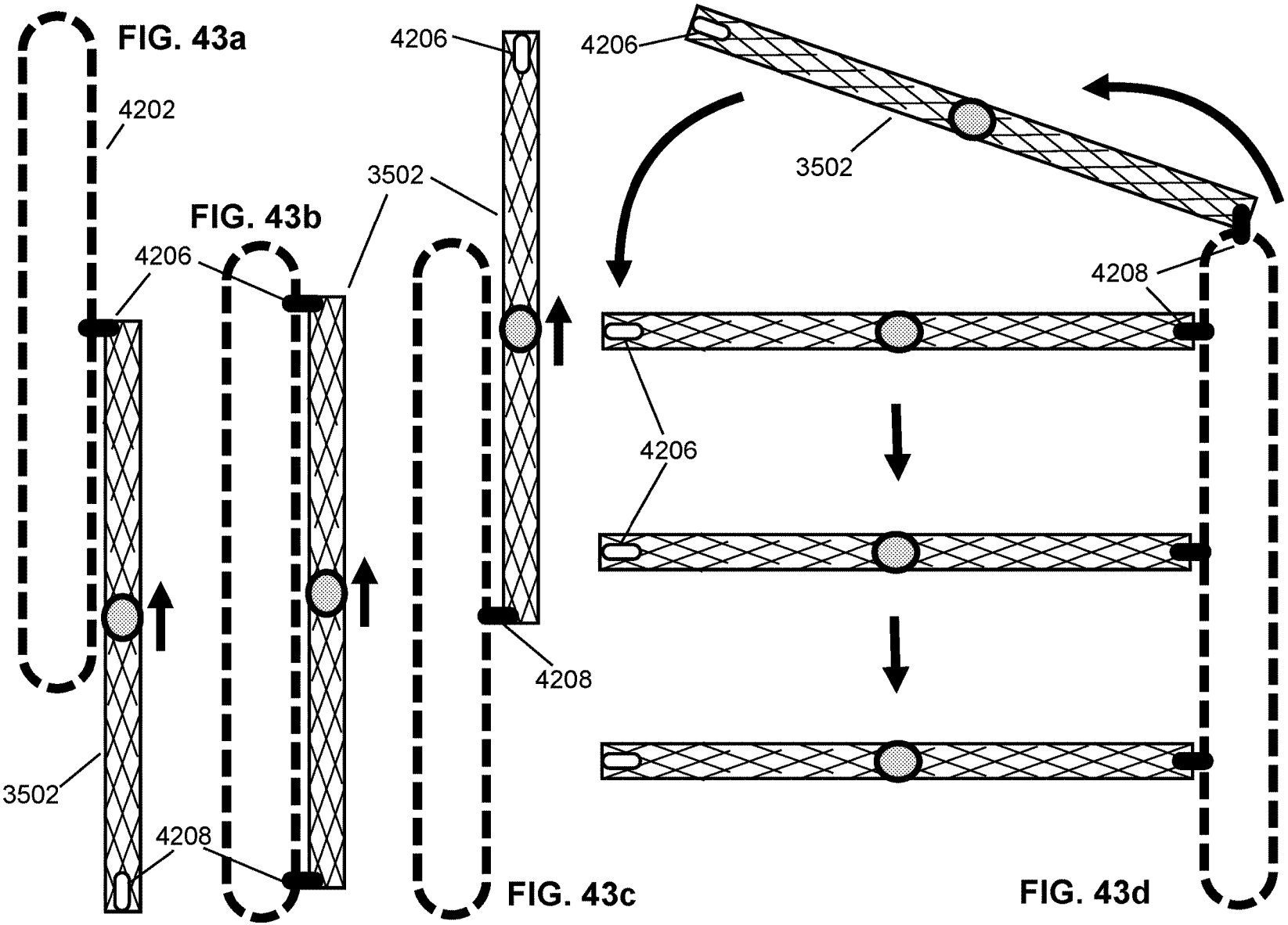
FIGS. 43*a* through 43*d* show a sequence of movement for a door panel for a portion of a closed-circuit path showing how engagement drive points are utilized to engage a door panel with a conveyor mechanism and where engagement is initiated from engagement drive points contained in the door panel.

An exemplary sequence of operation for moving door panels according to the invention, including a conveyor mechanism, is shown in FIGS. 43A through 43D. In FIG. 43A, door panel 3502 is engaged with conveyor 4202 by way of engagement point 4206. As door panel 3502 becomes contained within the sealed passageway, engagement drive point 4208 at the other end of door panel 3502 also becomes engaged with conveyor 4202, followed by engagement point 4206 becoming disengaged as shown in FIG. 43C. Subsequently, per FIG. 43D, door panel 3502 is caused to rotate and enter the pedestrian passageway driven solely by engagement drive point 4208. For FIGS. 43A through 43D, as well as subsequent figures, an engagement drive point is shown colored solidly in black if engaged and with a white fill pattern when not engaged. Note that for FIGS. 43A through 43D, engagement drive points are shown associated with a specific door panel and extend out to engage with conveyor 4202 when activated.

Figures 44A, 44B, 44C, 44D:
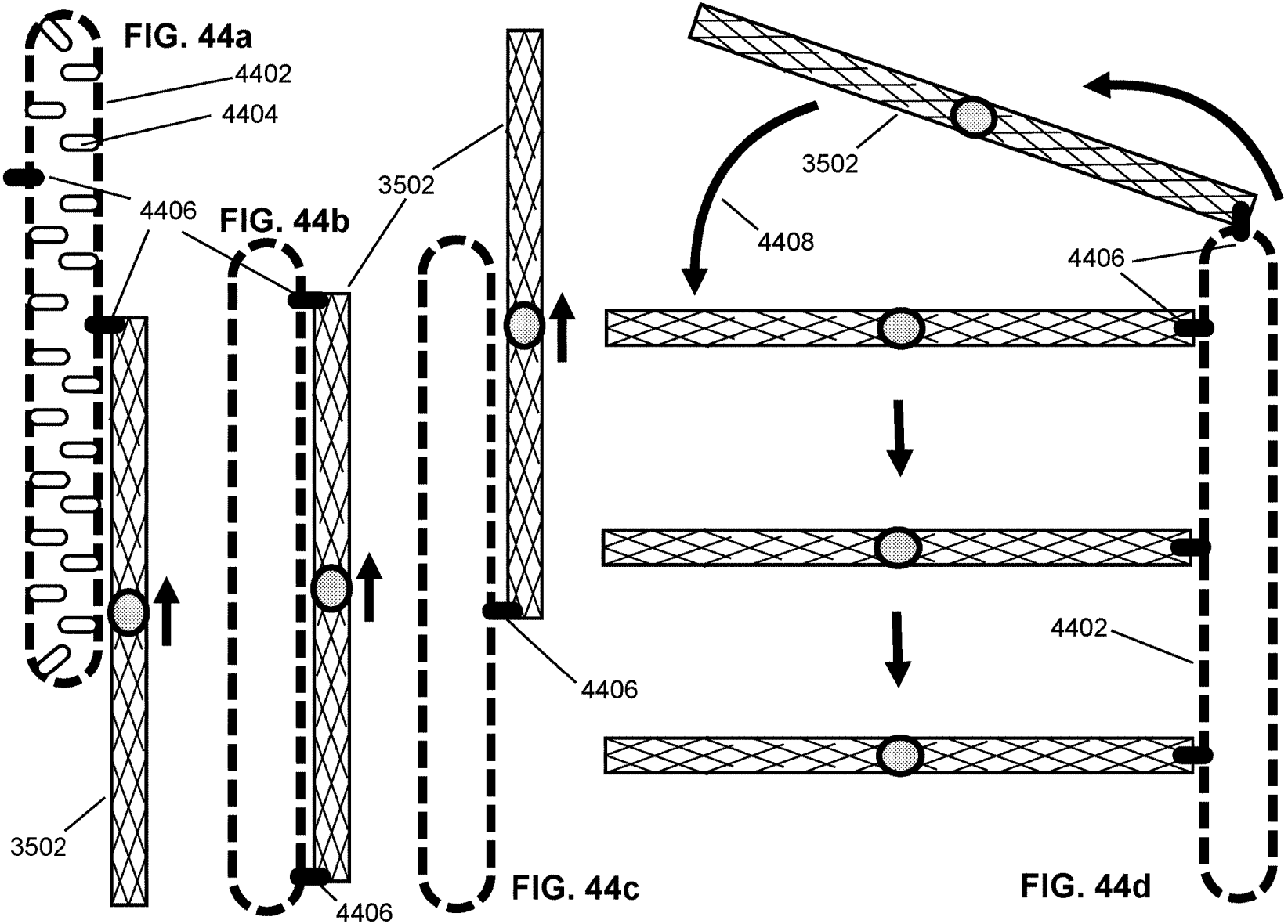
FIGS. 44*a* through 44*d* show a sequence of movement for a door panel for a portion of a closed-circuit path showing how engagement drive points are utilized to engage a door panel with a conveyor mechanism and where engagement is initiated from engagement drive points contained within the conveyor mechanism.

FIGS. 44A through 44D show a similar sequence of movements to those of FIGS. 43A through 43D, except that for FIGS. 44A through 44D engagement drive points are contained as part of conveyor mechanism 4402 and are capable of engaging with either end of a door panel. Here, drive points extended from conveyor 4402 to engage with moving door panels such as 3502 are shown in solid black 4406, and when not engaged, are shown with a white fill pattern 4404. Thus in FIG. 44*a*, door panel 3502 is engaged with conveyor 4402 by way of one engagement drive point 4406. In FIG. 44B, door panel 3502 is engaged simultaneously with two engagement drive points 4406. In FIG. 44C, one engagement drive point has disengaged, and the other remains engaged. In FIG. 44D, the engaged drive point 4406 continues to drive door panel 3502 as it rotates 4408 and begins its longitudinal movement through the pedestrian passageway.

Figures 45A, 45B:
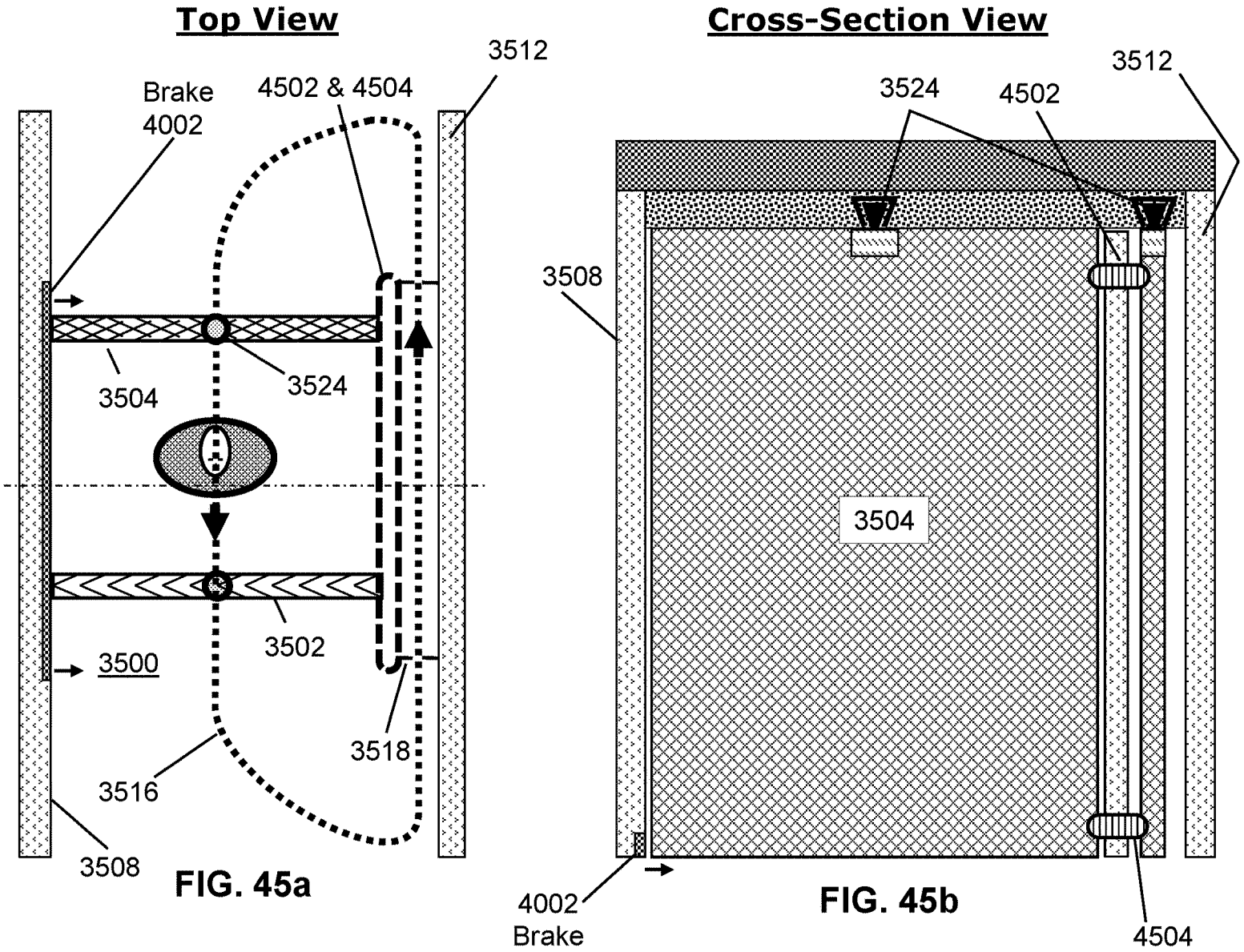
FIGS. 45*a* and 45*b* show top and cross-section views of a portal embodiment where multiple conveyor units are utilized in conjunction with a single sidewall.

FIG. 45A is similar to FIG. 42A, except that the conveyor mechanism is now marked as 4502 and 4504 in the top view diagram of FIG. 45A. The reason for marking as such becomes more apparent in the cross-section view of FIG. 45B, where conveyor 4502 is located near the top of the portal and conveyor 4504 is located near the bottom. Note that track mechanisms 3524 are shown at the top of the portal. These may optionally be used in conjunction with conveyor mechanisms 4502 and 4504 to support the weight of moving door panels such as 3504 and also to guide the moving door panels as they follow a closed circuit path such as path 3516. Alternately conveyor mechanisms such as 4502 and 4504 may singly or together be used to both drive and support door panel 3504. Also, note in FIG. 45B that only one brake mechanism 4002 is shown. A brake mechanism such as 4004 would not be required for the implementation of FIG. 45B since conveyor 4504 engages with door panel 3504 as it moves through the pedestrian passageway and therefore secures that side of door panel 3504 against movement from abnormal impacts or pressure applied to the door panel.

Figure 46B:
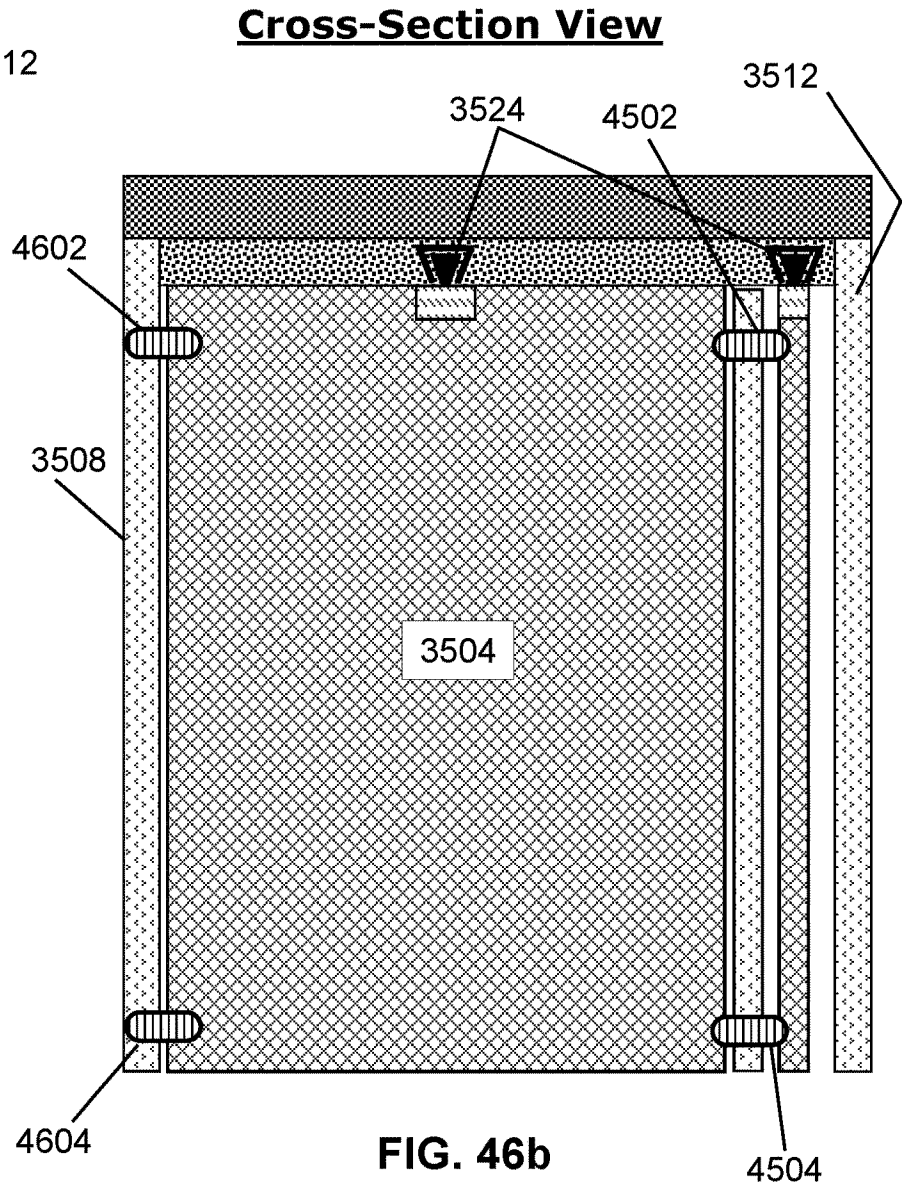
FIGS. 46*a* and 46*b* show top and cross-section views of a portal embodiment where multiple conveyor units are utilized in conjunction with both sidewalls.
Figure 46A:
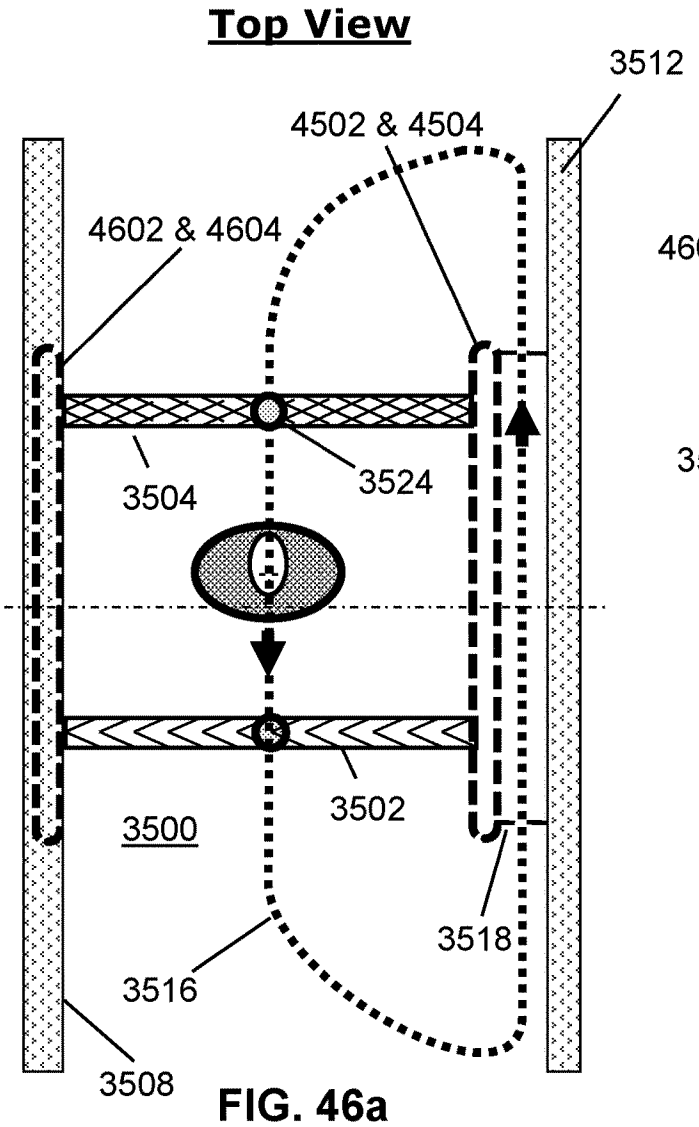

FIGS. 46A and 46B are similar to FIGS. 45A and 45B, except that additional conveyor mechanism 4602 and 4604 have been added to sidewall 3508 in order to assist in driving door panel 3502 as it moves through the pedestrian passageway, and in doing so also provide a braking function, thus eliminating the need for brake mechanism 4002.

Figure 47:
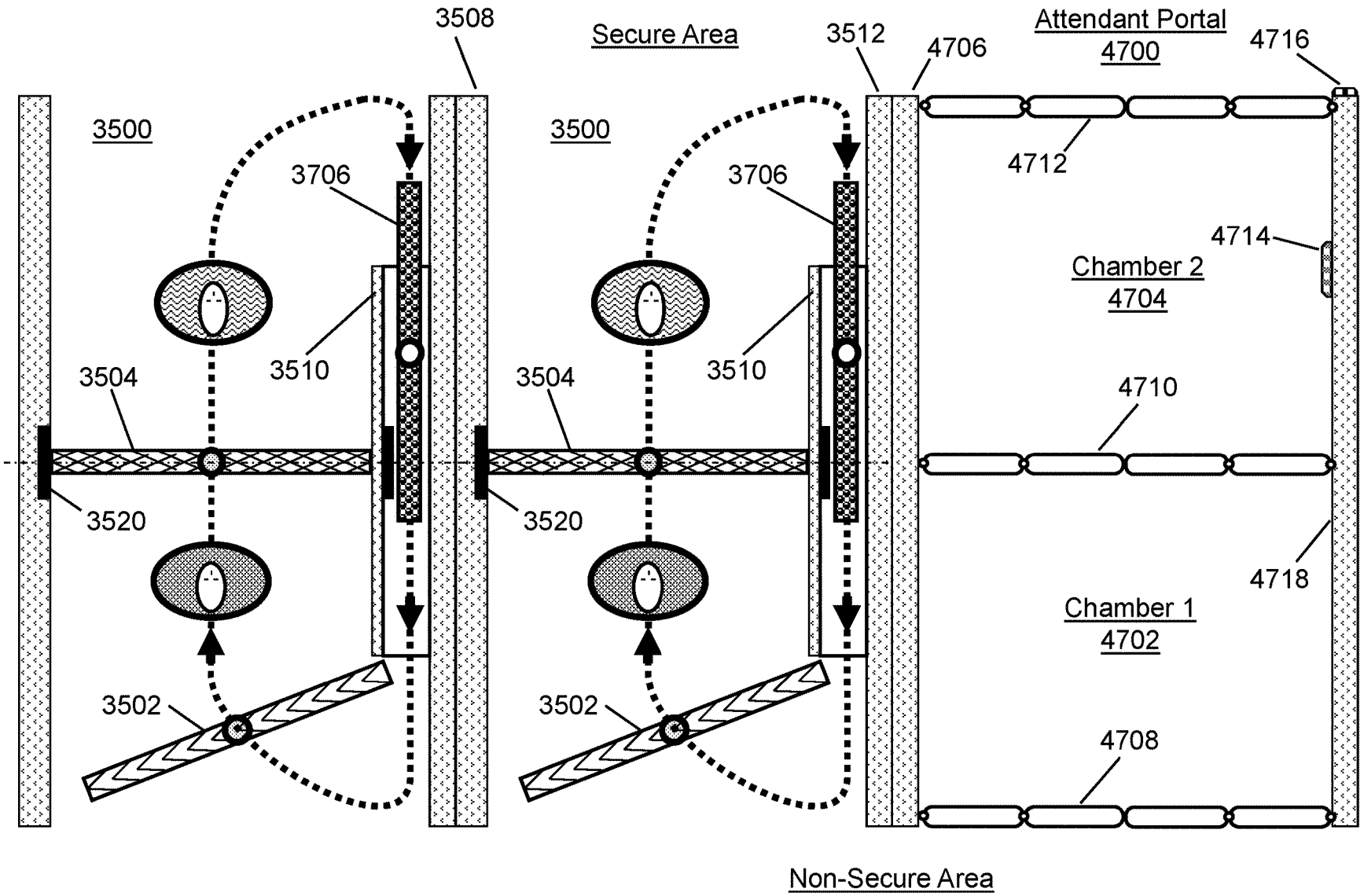
FIG. 47 shows a portal cluster where two automatic/robotic portals are used in conjunction with an attendant portal, the attended portal having two separate chambers and three sets of electronically controllable doors.

As discussed up to this point in the present specification, all pedestrian security portal embodiments are automated and robotic. There are times, however, when a pedestrian may require special consideration when entering the secure area, such that the automated portal embodiments are not suitable. For instance, someone in a metallic wheelchair would not be appropriate to pass through an automated portal if that portal depended upon metal detection for weapon detection. Also, from time to time, there may be false alarms triggered in an automated portal such that a subject triggering such a false alarm will need to be examined separately by an attendant. In order to assist an attendant in examining the subject, while at the same time providing as much security as possible to prevent a subject with a weapon from entering the secure area, an attendant portal can be provided such as that shown for example in FIG. 47 as a companion to one or more automated robotic portals. As shown in FIG. 47, an exemplary attendant portal 4700 comprises a first chamber 4702 and a second chamber 4704 with sidewalls 4706 and 4718, and electronically controllable movable doors at the entry and exit points as well as between the two chambers. A pedestrian being screened by an attendant would enter chamber 4702 by way of electronically controllable movable doors 4708. An attendant controls all of the electronically controllable doors 4708, 4710, and 4712 by way of control panels 4714 and 4716. All of doors 4708, 4710, and 4712 may be transparent such that the attendant can view all actions of a subject entering chamber one. Video cameras may also be used to provide additional views of a subject for the attendant or other operators to scrutinize. The operation of electronically controllable doors 4708, 4710, and 4712 may also be controlled remotely by an attendant or operator in a different location who observes activity within attendant portal 4700 by way of the video feeds. In this way, one operator may simultaneously control the doors within multiple attendant portals at different locations.

Figure 48:
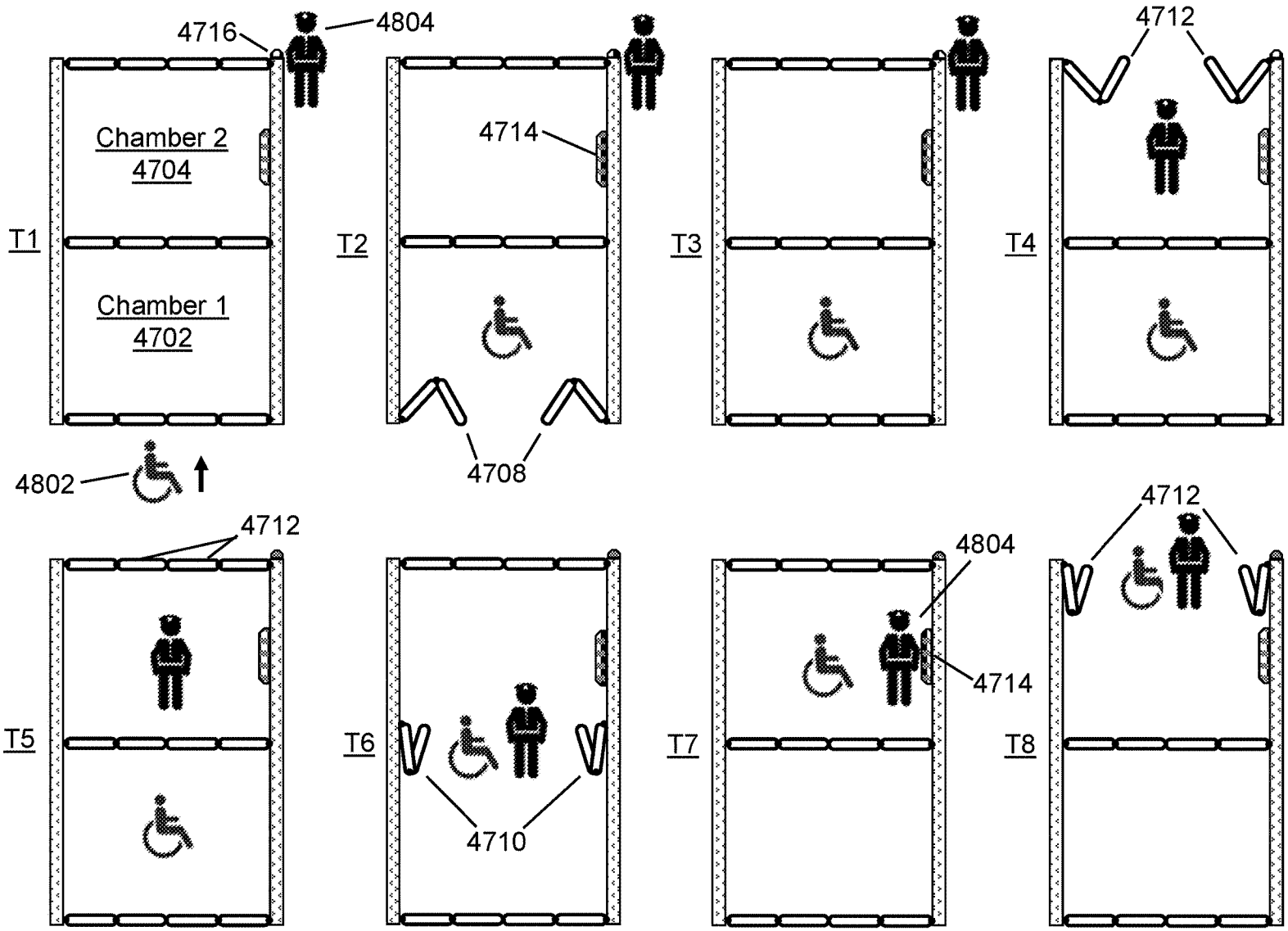
FIG. 48 shows a sequence of operations for an attendant portal according to the invention, where eight separate time frames are described for a sequence where an attendant enables a person in a wheelchair to pass from a non-secure area to a secure area.

An exemplary sequence of operation for the use of an attendant portal is shown in FIG. 48, where a time sequence of events comprising timeframes T1 through T8 is shown. In timeframe T1, a subject 4802 shown here in a wheelchair, is observed to be requesting entrance to the secure area. This request may be performed by pressing a button adjacent the exterior of the attendant portal or alternately simply by being observed by an attendant through transparent doors or video as described previously. Attendant 4804 responds to the request by causing movable doors 4708 to open as shown in timeframe T2. This may be performed by operating the external control panel 4716 or some other remote control means as known in the art. Once the subject has entered chamber 4702 an operator causes doors 4708 to close, and the subject can be observed either visually or through video. Also, during timeframe T2, an additional person may enter Chamber 1 to assist another, for instance, rolling another's wheelchair into the chamber, followed by the additional person leaving through doors 4708.

Also, in timeframe T3 an attendant or operator may also verify that only one subject is within the attendant portal. Without the 3-door/2-chamber configuration, it would be possible for multiple subjects to enter and instantly be one door away from the secure area, as well as potentially overwhelming a guard/attendant should that attendant have already entered a portal with a single chamber configuration. During timeframe T3, other checks of a subject may be optionally performed according to the invention through video image analysis—facial recognition and/or biometrics—or some form of scanning such as millimeter-wave scanning and imaging. Chemical vapor analysis may also be performed if available to check for explosives. Another advantage of the invention over a single chamber attendant portal is that if a subject enters a single chamber before the guard/attendant enters, the doors to the secure area must be opened to allow the guard/attendant to enter the single chamber. With the two-chamber configuration of the present invention, those disadvantages do not occur.

Once attendant 4804 determines that subject 4802 does not appear to be a threat, electronically controllable door 4712 is caused to open, allowing attendant 4804 to enter chamber 2 as shown in timeframe T4. Subsequently, in timeframe T5, electronically controllable door 4712 is caused to close, thereby sealing the attendant portal from the secure area. Next in timeframe T6, electronically controllable door 4710 is caused to open, allowing attendant 4804 to examine subject 4802, and in the case of a subject needing assistance such as for instance a child, elderly person, or someone in a wheelchair, may assist that subject in moving through now open door panel 4710 to Chamber 2 4704. In timeframe, T7 electronically controllable doors 4710 are caused to close. If attendant 4804 is satisfied that subject 4802 does not comprise a threat, they may operate control panel 4714 by way of a code or other identification mechanism that cannot be duplicated by an observer, causing electronically controllable doors 4712 to open as shown in timeframe T8. After the attendant and subject have successfully arrived in the secure area, electronically controllable doors 4712 are again closed, and the portal returns to a condition equivalent to that shown in timeframe T1.

The various embodiments described throughout this specification also include the software and object code used to control the access control device according to various embodiments of this invention. These embodiments include a computer program product which is a storage medium (media) having instructions stored thereon/in, which can be used to program a general-purpose or specialized computing processor(s)/device(s) to perform any of the features presented herein. As a non-limiting illustration, the instructions stored on the computer-readable storage medium can cause a processor to rotate and move the panels of the security door in a particular sequence/manner. Similarly, the instructions can cause the processor to start, stop, and resume the rotation of the door according to signals received from a set of sensors embedded in the security door. Additionally, the instructions can cause the processor to reverse the sequence of movement of the door panels after a suspected threat is detected such that the subject is compelled to back out of the access control device or optionally be restrained within the access control device.

The storage medium can include but is not limited to one or more of the following: any type of physical media including floppy disks, optical discs, DVDs, CD-ROMs, microdrives, magneto-optical disks, holographic storage, ROMs, RAMs, PRAMS, EPROMs, EEPROMs, DRAMs, VRAMs, flash memory devices, magnetic or optical cards, nanosystems (including molecular memory ICs); paper or paper-based media; and any type of media or device suitable for storing instructions and/or information.

Stored on one or more of the computer readable medium (media), the present disclosure includes software for controlling both the hardware of general purpose/specialized computer(s) and/or processor(s), and for enabling the computer(s) and/or processor(s) to interact with a human user or other mechanism utilizing the results of the present invention. Such software may include but is not limited to device drivers, operating systems, execution environments/containers, user interfaces, and applications.

The foregoing description of the preferred embodiments of the present invention has been provided for purposes of illustration and description. It is not intended to be exhaustive or to limit the invention to the precise forms disclosed. Many modifications and variations can be apparent to the practitioner skilled in the art. Embodiments were chosen and described in order to best explain the principles of the invention and its practical application, thereby enabling others skilled in the relevant art to understand the invention. It is intended that the scope of the invention be defined by the following claims and their equivalents.

The invention claimed is:

1. An access control device for controlling passage between two areas, comprising:

a passageway including at least two moveable and rotatable door panels operating in conjunction with at least two sidewalls including at least one linear sidewall;

wherein each of said at least two door panels rotates to a first position perpendicular to said at least one linear sidewall and a second position parallel to said at least one linear sidewall;

wherein for a unidirectional direction of traffic flow through the passageway and while a specific one of said at least two moveable and rotatable door panels is within the passageway, a first side of the specific one of said at least two moveable and rotatable door panels will face in the direction of traffic flow while in the first position during a first traversal of the passageway in the direction of traffic flow by said specific one door panel, and a second side of the specific one of said at least two moveable and rotatable door panels will face in the direction of traffic flow while in the first position during a second traversal of the passageway in the direction of traffic flow by said specific one door panel.

2. The access control device of claim 1, wherein each of said at least two door panels rotates to the first position while moving in a first longitudinal direction; and wherein each of said two door panels moves in a second longitudinal direction that is parallel to said at least one linear sidewall while simultaneously being fixed in the second position wherein the second longitudinal direction is substantially opposite the first longitudinal direction.

3. The access control device of claim 2, wherein while the specific one of said at least two moveable and rotatable door panels is within the passageway and positioned in the first position perpendicular to said at least one linear sidewall, a second of the at least two moveable and rotatable door panels, while positioned in the second position parallel to said at least one linear sidewall, maintains a gap from the specific one of said at least two moveable and rotatable door panels.

4. The access control device of claim 1, wherein the access control device is capable of bi-directional operation under electronic control, wherein two successive subjects pass through the passageway of the access control device, travelling in opposite directions to each other, for two successive traversals of the access control device.

5. The access control device of claim 4, wherein the electronic control for the access control device decides which direction of passage to allow first based on a greater demand.

6. The access control device of claim 4, further comprising programming for operation supporting bi-directional passage by successive subjects, the programming causing the access control device to behave according to at least the steps of:

starting a bi-directional sequence of passage with a first of the at least two door panels oriented in a neutral position substantially longitudinally centered in the access control device and also positioned substantially perpendicular to the at least one linear sidewall; and when approached by a first subject moving in a first longitudinal direction, moving the first of the at least two door panels in the first longitudinal direction, while simultaneously moving a second of the at least two door panels initially in a second longitudinal direction opposite the first, followed by rotating and moving the second of the at least two door panels in the first longitudinal direction such that after the first subject has passed through the access control device the second of the at least two door panels has assumed the neutral position substantially longitudinally centered in the access control device and also positioned substantially perpendicular to the at least one linear sidewall.

7. The access control device of claim 6, wherein the programming for operation supporting bi-directional passage further causes the access control device to behave according to at least the steps of:

starting with the second of the at least two door panels positioned in the neutral position substantially longitudinally centered in the access control device and also positioned substantially perpendicular to the at least one linear sidewall, when approached by a second and successive subject moving in the second longitudinal direction opposite the first longitudinal direction, moving the second of the at least two door panels in the second longitudinal direction, while simultaneously moving the first of the at least two door panels initially in the first longitudinal direction.

8. The access control device of claim 1, wherein during an emergency, each of the at least two moveable and rotatable door panels of the access control device are positioned parallel to and adjacent to one of the passageway sidewalls to allow unimpeded movement between the two areas.

9. The access control device of claim 1, wherein the access control device operates unattended for extended periods of time.

10. The access control device of claim 1, wherein the access control device includes position sensors to determine positions of all portions of each subject passing therethrough;

wherein the position sensors include one or more of visual, sonic, I.R., U.V., or R.F. sensor technology; and wherein based on said determinations, each of the at least two moveable and rotatable door panels of the access control device move automatically without requiring or allowing any contact between the at least two moveable and rotatable door panels and subjects passing through the access control device.

11. The access control device of claim 10, wherein by determining a position and movement of a subject passing through the access control device, door panel movements within the access control device are automatically controlled to adjust a rate of movement of the each moveable and rotatable door panel within the access control device to match a speed of movement of the subject, thus maximizing a throughput rate of the access control device by adapting to a rate of movement of each subject passing therethrough.

12. An apparatus for controlling access between two areas, comprising:

a cluster of access control devices, wherein each access control device in the cluster is electronically controlled for direction of traffic flow and rates of door panel movements within each access control device;

wherein each access control device in the cluster further comprises:

a passageway including at least two moveable and rotatable door panels operating in conjunction with at least two sidewalls including at least one linear sidewall;

wherein each of said at least two door panels rotates to a first position perpendicular to said at least one linear sidewall and a second position parallel to said at least one linear sidewall;

wherein for a unidirectional direction of traffic flow through the passageway and while a specific one of said at least two moveable and rotatable door panels is within the passageway, a first side of the specific one of said at least two moveable and rotatable door panels will face in the direction of traffic flow while in the first position during a first traversal of the passageway in the direction of traffic flow by said specific one door panel, and a second side of the specific one of said at least two moveable and rotatable door panels will face in the direction of traffic flow while in the first position during a second traversal of the passageway in the direction of traffic flow by said specific one door panel.

13. The apparatus of claim 12, wherein the apparatus is capable of bi-directional operation under automatic program control, wherein two successive subjects pass through the passageway of an access control device within the cluster of access control devices, travelling in opposite directions to each other, for two successive traversals of the access control device.

14. The apparatus of claim 12, wherein one or more of the access control devices in the cluster is configured for bi-directional operation under automatic program control; and wherein a number of devices in the cluster allowing flow in one direction relative to the opposite direction is varied according to aggregate demand for directional traffic flow.

15. The apparatus of claim 14, wherein the aggregate demand for directional traffic flow is determined by one or more sensors that observe the two areas; and wherein said sensors utilize at least one or more of visual, sonic, I.R., U.V., or R.F. sensor technology.

16. The apparatus of claim 12, wherein a plurality of access control devices in the cluster are positioned side by side.

17. The apparatus of claim 12, wherein one or more access control devices in the cluster displays a message to a subject desiring to traverse the access control device, indicating a status with respect to traversal of the access control device by the subject.

18. The apparatus of claim 17, wherein at a point in time the message indicates a time remaining until the access control device changes direction.

19. The apparatus of claim 12, wherein during an emergency, the at least two moveable and rotatable door panels of one or more of the one or more access control devices are positioned to allow unimpeded movement between the two areas.

20. The apparatus of claim 12, wherein each access control device in the cluster includes position sensors to determine positions of all portions of each subject passing therethrough;

wherein the position sensors include one or more of visual, sonic, I.R., U.V., or R.F. sensor technology; and wherein based on said determinations, each of the at least two moveable and rotatable door panels of each access control device move automatically without requiring or allowing any contact between the at least two moveable and rotatable door panels and subjects passing through the access control device.

21. The apparatus of claim 20, wherein by determining a position and movement of a subject passing through each access control device, door panel movements within the access control device are automatically controlled to adjust a rate of movement of the each moveable and rotatable door panel within the access control device to match a speed of movement of the subject, thus maximizing a throughput rate of the access control device by adapting to a rate of movement of each subject passing therethrough.

22. The apparatus of claim 12, wherein one or more access control devices in the cluster include cameras to capture optical images of a subject including their face;

wherein an analysis of the subject's face is performed; and wherein one of said cameras is mounted on each side of a moving door panel within each of the one or more access control devices.

23. The apparatus of claim 12, wherein one or more access control devices in the cluster operate unattended for extended periods of time.

* * * * *